US005601958A

United States Patent [19]

Kato et al.

[11] Patent Number: 5,601,958

[45] Date of Patent: Feb. 11, 1997

[54] METHOD FOR PREPARATION OF PRINTING PLATE BY ELECTROPHOTOGRAPHIC PROCESS

[75] Inventors: Eiichi Kato; Makoto Momota; Hiroyuki Ohishi, all of Shizuoka, Japan

[73] Assignee: Fuji Photo Film Co., Ltd., Kanagawa, Japan

[21] Appl. No.: 413,467

[22] Filed: Mar. 28, 1995

[30] Foreign Application Priority Data

Apr. 8, 1994 [JP] Japan ..... 6-095691

[51] Int. Cl.$^6$ ..... G03G 13/28

[52] U.S. Cl. ..... 430/49; 430/96

[58] Field of Search ..... 430/49, 96

[56] References Cited

U.S. PATENT DOCUMENTS 4,434,198 2/1984 Clark ..... 430/49
5,147,752 9/1992 Kato et al. ..... 430/96

FOREIGN PATENT DOCUMENTS 20632338 1/1995 European Pat. Off. .
WO9316418 8/1993 WIPO .

*Primary Examiner*—John Goodrow

*Attorney, Agent, or Firm*—Sughrue, Mion, Zinn, Macpeak & Seas

[57] ABSTRACT

A method for preparation of a printing plate by an electrophotographic process comprising forming a peelable transfer layer capable of being removed upon a chemical reaction treatment on a surface of an electrophotographic light-sensitive element, forming a toner image by an electrophotographic process on the transfer layer, heat-transferring the toner image together with the transfer layer onto a receiving material having a surface capable of providing a hydrophilic surface suitable for lithographic printing at the time of printing, and removing the transfer layer on the receiving material upon the chemical reaction treatment wherein the transfer layer is formed by an electrodeposition coating method using thermoplastic resin grains (AL) each containing a rein ($A_1$) having a glass transition point of from 10° C. to 140° C. or a softening point of from 35° C. to 180° C. and a resin ($A_2$) having a glass transition point of not more than 45° C. or a softening point of not more than 60° C. and its glass transition point or softening point is at least 2° C. lower than that of the resin ($A_1$).

The transfer layer according to the present invention has excellent transferability onto a receiving material under transfer conditions of low temperature and high speed to form transferred images of good qualities thereby providing prints of good image qualities.

17 Claims, 2 Drawing Sheets

METHOD FOR PREPARATION OF PRINTING PLATE BY ELECTROPHOTOGRAPHIC PROCESS

FIELD OF THE INVENTION

The present invention relates to a method for preparation of a printing plate by an electrophotographic process, and more particularly to a method for preparation of a printing plate by an electrophotographic process including formation, transfer and removal of a transfer layer wherein the transfer layer is easily transferred and removed and good image qualities are maintained during a plate making process thereby providing prints of good image qualities.

BACKGROUND OF THE INVENTION

Owing to the recent technical advancements of image processing by a computer, storage of a large amount of data and data communication, input of information, revision, edition, layout, and pagination are consistently computerized, and electronic editorial system enabling instantaneous output on a remote terminal plotter through a high speed communication network or a communications satellite has been practically used.

Light-sensitive materials having high photo-sensitivity which may provide direct type printing plate precursors directly preparing printing plates based on the output from a terminal plotter include electrophotographic light-sensitive materials.

In order to form a lithographic printing plate using an electrophotographic light-sensitive material, a method wherein after the formation of toner image by an electrophotographic process, non-image areas are subjected to oil-desensitization with an oil-desensitizing solution to obtain a lithographic printing plate, and a method wherein after the formation of toner image, a photoconductive layer is removed in non-image areas to obtain a lithographic printing plate are known.

However, in these method, since the light-sensitive layer is subjected to treatment for rendering it hydrophilic to form hydrophilic non-image areas or removed by dissolving out it in the non-image areas to expose an underlying hydrophilic surface of support, there are various restrictions on the light-sensitive material, particularly a photoconductive compound and a binder resin employed in the photoconductive layer. Further, printing plates obtained have several problems on their image qualities or durability.

In order to solve these problems there is proposed a method comprising providing a transfer layer composed of a thermoplastic resin capable of being removed upon a chemical reaction treatment on a surface of an electrophotographic light-sensitive element, forming a toner image on the transfer layer by a conventional electrophotographic process, transferring the toner image together with the transfer layer onto a receiving material capable of forming a hydrophilic surface suitable for a lithographic printing, and removing the transfer layer to leave the toner image on the receiving material whereby a lithographic printing plate is prepared as described in WO 93/16418.

Since the method for preparation of printing plate using a transfer layer is different from the method for forming hydrophilic non-image areas by modification of the surface of light-sensitive layer or dissolution of the light-sensitive layer, and the former comprises the formation of toner image not on the light-sensitive layer but on the transfer layer, the transfer of toner image together with the transfer layer onto another support having a hydrophilic surface and the removal of the transfer layer by a chemical reaction treatment, printing plates having good image qualities are obtained without various restrictions on the photoconductive layer employed as described above.

However, good image qualities cannot be obtained in the plate-making process, if the transfer of toner image together with the transfer layer is incomplete.

It is desired that the toner image be wholly transferred together with the transfer layer onto a receiving material even when the transfer layer has a reduced thickness or the transfer conditions are changed, for example, when a transfer temperature is decreased or a transfer speed is increased.

SUMMARY OF THE INVENTION

The present invention is to solve the above-described various problems associated with conventional plate-making techniques.

An object of the present invention is to provide a method for preparation of a printing plate by an electrophotographic process which provides a printing plate excellent in image qualities.

Another object of the present invention is to provide a method for preparation of a printing plate in which a transfer layer has improved transferability.

Other objects of the present invention will become apparent from the following description.

It has been found that the above-described objects of the present invention are accomplished by a method for preparation of a printing plate by an electrophotographic process comprising forming a peelable transfer layer capable of being removed upon a chemical reaction treatment on a surface of an electrophotographic light-sensitive element, forming a toner image by an electrophotographic process on the transfer layer, heat-transferring the toner image together with the transfer layer onto a receiving material having a surface capable of providing a hydrophilic surface suitable for lithographic printing at the time of printing, and removing the transfer layer on the receiving material upon the chemical reaction treatment wherein the transfer layer is formed by an electrodeposition coating method using thermoplastic resin grains (AL) each containing a rein ($A_1$) having a glass transition point of from 10° C. to 140° C. or a softening point of from 35° C. to 180° C. and a resin ($A_2$) having a glass transition point of not more than 45° C. or a softening point of not more than 60° C. and its glass transition point or softening point is at least 2° C. lower than that of the resin ($A_1$).

BRIEF DESCRIPTION OF THE ACCOMPANYING DRAWINGS

Figure 1:
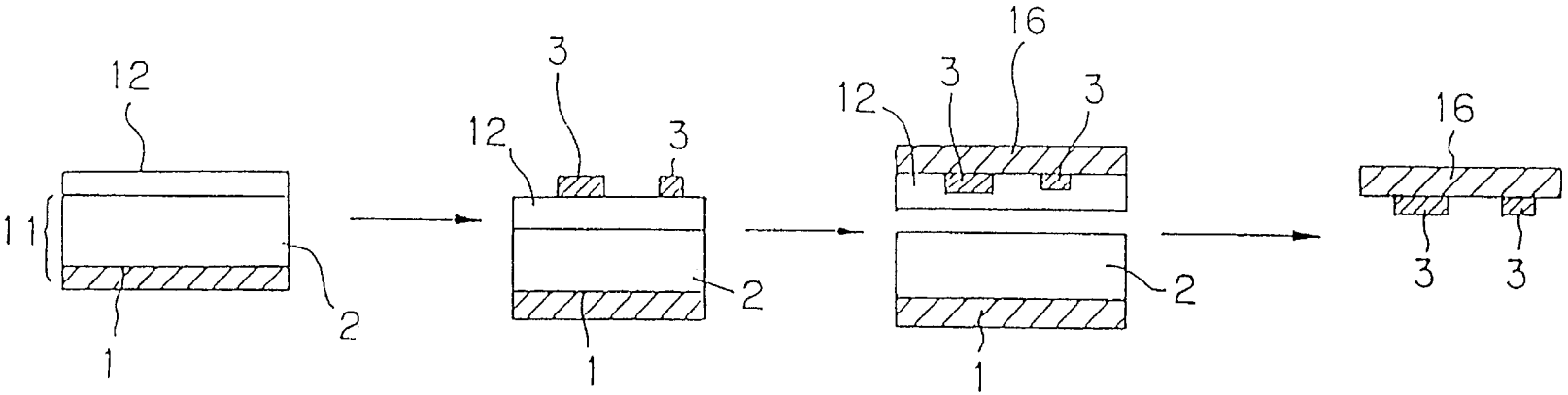
FIG. 1 is a schematic view for explanation of the method according to the present invention.

Explanation of the Symbols:

1 Support of light-sensitive element
2 Light-sensitive layer
3 Toner image

11 Light-sensitive element
12 Transfer layer
12*a* Dispersion of thermoplastic resin grains
13 Electrodeposition unit
14 Liquid developing unit set
14L Liquid developing unit
15 Suction/exhaust unit
15*a* Suction part
15*b* Exhaust part
16 Receiving material
17 Heat transfer means
17*a* Pre-heating means
17*b* Heating roller
17*c* Cooling roller
18 Corona charger
19 Exposure device
20 Device applying compound (S)
21 Transfer roll
22 Metering roll
23 Compound (S)

DETAILED DESCRIPTION OF THE INVENTION

The method for preparation of a printing plate by an electrophotographic process according to the present invention will be diagrammatically described with reference to FIG. 1 of the drawings.

As shown in FIG. 1, the method for preparing a printing plate comprises forming a peelable transfer layer 12 capable of being removed upon a chemical reaction treatment by an electrodeposition coating method using thermoplastic resin grains (AL) each containing the resin ($A_1$) and resin ($A_2$) described above on a surface of an electrophotographic light-sensitive element 11 having at least a support 1 and a light-sensitive layer 2, forming a toner image 3 by a conventional electrophotographic process on the transfer layer 12, transferring the toner image 3 together with transfer layer 12 onto a receiving material 16 similar to a support for an offset printing plate by heat transfer to prepare a printing plate precursor, and then removing the transfer layer 12 transferred onto the receiving-material 16 upon a chemical reaction treatment and leaving the toner image 3 on the receiving material 16 to prepare a printing plate.

It is important in the present invention that the thermoplastic resin grain (AL) described above containing at least two kinds of resin ($A_1$) and resin ($A_2$) having glass transition points or softening points different from each other by at least 2° C. is employed to form a transfer layer.

The transfer layer which can be used in the present invention is characterized by forming by an electrodeposition coating method using the thermoplastic resin grains (AL) each containing a combination of at least one resin ($A_1$) and at least one resin ($A_2$) which has a glass transition point or a softening point of at least 2° C. lower than a glass transition point or a softening point of the resin ($A_1$). The transfer layer has many advantages in that no deterioration of electrophotographic characteristics (such as chargeability, dark charge retention rate, and photosensitivity) occur until a toner image is formed by an electrophotographic process, thereby forming a good duplicated image, in that it has sufficient thermoplasticity for easy transfer to a receiving material in a heat transfer process, and in that it is easily removed by a chemical reaction treatment to prepare a printing plate. In addition, the transfer layer according to the present invention is excellent in releasability and preservability, and suitable for providing a printing plate having good image qualities and printing durability.

Now, the transfer layer which can be used in the present invention will be described in greater detail below.

The transfer layer of the present invention is a layer having a function of being transferred together with toner images from the releasing surface of electrophotographic light-sensitive element to a receiving material which provides a support for a printing plate thereby providing a printing plate precursor and of being removed upon a chemical reaction treatment of the printing plate precursor to prepare a printing plate. Therefore, the resins mainly constituting the transfer layer- of the present invention are those which are thermoplastic and capable of being removed upon a chemical reaction treatment. The resins mainly constituting the transfer layer including the resin ($A_1$) and resin ($A_2$) are generally referred to as a resin (A) hereinafter sometimes.

The transfer layer of the present invention is radiation-transmittive. Specifically, it is a layer capable of transmitting a radiation having a wavelength which constitutes at least one part of the spectrally sensitive region of electrophotographic light-sensitive element. The layer may be colored.

As described above, the resin ($A_1$) having a relatively high glass transition point or softening point and the resin ($A_2$) having a relatively low glass transition point or softening point are used in combination in the thermoplastic resin grain (AL) used for the formation of transfer layer. The resin ($A_1$) has a glass transition point of suitably from 10° C. to 140° C., preferably from 30° C. to 120° C., and more preferably from 35° C. to 90° C., or a softening point of suitably from 35° C. to 180° C., preferably from 38° C. to 160° C., and more preferably from 40° C. to 120° C., and on the other hand, the resin ($A_2$) has a glass transition point of suitably not more than 45° C., preferably from −40° C. to 40° C., and more preferably from −20° C. to 33° C., or a softening point of suitably not more than 60° C., preferably from 0° C. to 45° C., and more preferably from 5° C. to 35° C. The difference in the glass transition point or softening point between the resin ($A_1$) and the resin ($A_2$) used is at least 2° C., preferably at least 5° C., and more preferably in a range of from 10° C. to 50° C. The difference in the glass transition point or softening point between the resin ($A_1$) and the resin ($A_2$) means a difference between the lowest glass transition point or softening point of those of the resins ($A_1$) and the highest glass transition point or softening point of those of the resins ($A_2$) when two or more of the resins ($A_1$) and/or resins ($A_2$) are employed. According to the present invention, the thermoplastic resin grain (AL) can be composed by appropriately selecting the resin ($A_1$) and resin ($A_2$) so as to fulfill the above described conditions on the glass transition point or softening point.

The resin ($A_1$) and resin ($A_2$) are present in the resin grain (AL) in a suitable weight ratio of resin ($A_1$)/resin ($A_2$) ranging from 10/90 to 95/5. In the above described range of a weight ratio of resin ($A_1$)/resin ($A_2$), the transfer layer having excellent transferability and preservability is provided and thus, a printing plate having good image qualities and printing durability can be obtained.

When the weight ratio of resin ($A_1$)/resin ($A_2$) is less than 10/90 the effect on improvement in preservability of the transfer layer transferred on a receiving material to prepare a printing plate precursor may decrease. The preservability of the transfer layer is determined by placing the receiving materials having the transfer layer thereon, i.e., printing plate precursors one over another and allowing to stand for some time before a step of removing the transfer layer by a chemical reaction treatment, and then observing the occurrence of adhesion of the transfer layer to a rare side of the upper printing plate precursor to cause peeling off of the transfer layer from the receiving material, which results in cutting of toner image. On the other hand, when the weight ratio of resin ($A_1$)/resin ($A_2$) is more than 95/5, the excellent transferability of the transfer layer according to the present invention may be affected. A preferred weight ratio of resin ($A_1$)/resin ($A_2$) is from 30/70 to 90/10.

Two or more kinds of the resin ($A_1$) and resin ($A_2$) may be present in the state of admixture or may form a layered structure such as a core/shell structure composed of a portion mainly comprising the resin ($A_1$) and a portion mainly comprising the resin ($A_2$) in the resin grain (AL) of the present invention. In case of core/shell structure, the resin constituting the core portion is not particularly limited and may be the resin ($A_1$) or the resin ($A_2$).

A weight average molecular weight of each of the resin ($A_1$) and resin ($A_2$) is preferably from $1\times10^3$ to $5\times10^5$, more preferably from $3\times10^3$ to $8\times10^4$. The molecular weight herein defined is measured by a GPC method and calculated in terms of polystylene.

The resin grain (AL) used for the formation of transfer layer according to the present invention is composed of resins capable of being removed upon a chemical reaction treatment as described above.

The term "resin capable of being removed upon a chemical reaction treatment" means and includes a resin which is dissolved and/or swollen upon a chemical reaction treatment to remove and a resin which is rendered hydrophilic upon a chemical reaction treatment and as a result, dissolved and/or swollen to remove.

One representative example of the resin (A) capable of being removed upon a chemical reaction treatment used in the transfer layer according to the present invention is a resin which can be removed with an alkaline processing solution. Particularly useful resins of the resins capable of being removed with an alkaline processing solution include polymers comprising a polymer component containing a hydrophilic group.

Another representative example of the resin (A) capable of being removed upon the chemical reaction treatment used in the transfer layer according to the present invention is a resin which has a hydrophilic group protected by a protective group and is capable of forming the hydrophilic group upon a chemical reaction.

The chemical reaction for converting the protected hydrophilic group to a hydrophilic group includes a reaction for rendering hydrophilic with a processing solution utilizing a conventionally known reaction, for example, hydrolysis, hydrogenolysis, oxygenation, β-release, and nucleophilic substitution, and a reaction for rendering hydrophilic by a decomposition reaction induced by exposure of actinic radiation.

Particularly useful resins of the resins capable of being rendered hydrophilic upon the chemical reaction treatment includes polymers comprising a polymer component containing a functional group capable of forming a hydrophilic group.

It is preferred in the thermoplastic resin grain (AL) for the formation of transfer layer that each of the resin ($A_1$) and resin ($A_2$) is a polymer comprising at least one polymer component selected from a polymer component (a) containing a specific hydrophilic group described below and a polymer component (b) containing a functional group capable of forming a specific hydrophilic group upon a chemical reaction described below.

Polymer component (a):

a polymer component containing at least one group selected from a —$CO_2H$ group, a —CHO group, a —$SO_3H$ group, a —$SO_2H$ group, a —P(=O)(OH)$R^1$ group (wherein $R^1$ represents a —OH group, a hydrocarbon group or a —$OR^2$ group (wherein $R^2$ represents a hydrocarbon group)), a phenolic hydroxy group, a cyclic acid anhydride-containing group, a —CONH-$COR^3$ group (wherein $R^3$ represents a hydrocarbon group) and a —$CONHSO_2R^3$ group;

Polymer component (b):

a polymer component containing at least one functional group capable of forming at least one group selected from a —$CO_2H$ group, a —CHO group, a —$SO_3H$ group, a —$SO_2H$ group, a —P(=O)(OH)$R^1$ group (wherein $R^1$ has the same meaning as defined above) and a —OH group upon a chemical reaction.

The —P(=O)(OH)$R^1$ group denotes a group having the following formula:

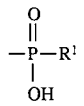

The hydrocarbon group represented by $R^1$, $R^2$ or $R^3$ preferably includes an aliphatic group having from 1 to 18 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylmethylphenyl, dichlorophenyl, methoxyphenyl, cyanophenyl, acetamidophenyl, acetylphenyl and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., a methoxy group and an ethoxy group as an alkoxy group).

To incorporate the polymer component (a) having the specific hydrophilic group into the thermoplastic resin used for the formation of transfer layer is preferred since the removal of transfer layer is easily and rapidly performed by a chemical reaction treatment. On the other hand, it is advantageous to use the thermoplastic resin contain the polymer component (b) which forms the specific hydrophilic group by a chemical reaction, because preservation of an electric insulating property of the resin per se becomes easy, degradation of electrophotographic characteristics is prevented and thus, good reproducibility of duplicated image is maintained, as well as a glass transition point of the resin can be controlled in a low temperature range.

The resin (A) containing at least one of the polymer components (a) and at least one of the polymer components (b) is preferred. Since an electric insulating property and a glass transition point of the resin (A) are appropriately controlled, electrophotographic characteristics and transferability of the transfer layer is remarkably improved. Also, the transfer layer is rapidly and completely removed to provide a printing plate without adversely affecting the hydrophilic property of the non-image areas and causing degradation of the toner image. As a result, the reproduced image transferred on receiving material has excellent reproducibility, and a transfer apparatus of small size can be utilized since the transfer is easily conducted under conditions of low temperature and low pressure. Moreover, in the resulting printing plate, cutting of toner image in highly accurate image portions such as fine lines, fine letters and dots for continuous tone areas is prevented and the residual transfer layer is not observed.

Suitable contents of polymer component (a) and/or polymer component (b) in the resin (A) are determined so as to prevent the occurrence of background stain in the non-image areas of prints because of incomplete removal of the transfer layer by a chemical reaction treatment on the one side, and degradation of transferability of the transfer layer onto a receiving material due to an excessively high glass transition point or softening point of the resin (A) and degradation of reproducibility in duplicated images because of decrease in chargeability of the electrophotographic light-sensitive material resulting from decrease in the electric insulating property of the transfer layer on the other side.

Preferred ranges of the contents of polymer component (a) and/or polymer component (b) in the resin (A) are as follows.

When the resin (A) contains only the polymer component (a) having the specific hydrophilic group, the content of polymer component (a) is preferably from 3 to 50% by weight, and more preferably from 5 to 40% by weight based on the total polymer component in the resin (A). On the other hand, when the resin (A) contains only the polymer component (b) having a functional group capable of forming the specific hydrophilic group by a chemical reaction, the content of polymer component (b) is preferably from 3 to 100% by weight, and more preferably from 5 to 70% by weight based on the total polymer component in the resin.(A).

Further, when the resin (A) contains both the polymer component (a) and the polymer component (b), the content of polymer component (a) is preferably from 0.5 to 30% by weight, more preferably from 1 to 25% by weight, and the content of polymer component (b) is preferably from 3 to 99.5% by weight, more preferably from 5 to 50% by weight, based on the total polymer component in the resin (A).

Now, each of the polymer components which can be included in the resin (A) will be described in detail below.

The polymer component (a) containing the above-described specific hydrophilic group present in the resin (A) should not be particularly limited. Of the above-described hydrophilic groups, those capable of forming a salt may be present in the form of salt in the polymer component (a). For instance, the above-described polymer component containing the specific hydrophilic group used in the resin (A) may be any of vinyl compounds each having the hydrophilic group. Such vinyl compounds are described, for example, in *Kobunshi Data Handbook* (*Kiso-hen*), edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, iraconic acid, iraconic acid half esters, iraconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the above-described hydrophilic group in the substituent thereof.

Specific examples of the polymer components (a) containing the specific hydrophilic group are set forth below, but the present invention should not be construed as being limited thereto. In the following formulae, $R^4$ represents —H or —$CH_3$; $R^5$ represents —H, —$CH_3$ or —$CH_2COOCH_3$; $R^6$ represents an alkyl group having from 1 to 4 carbon atoms; $R^7$ represents an alkyl group having from 1 to 6 carbon atoms, a benzyl group or a phenyl group; e represents an integer of 1 or 2; f represents an integer of from 1 to 3; g represents an integer of from 2 to 11; h represents an integer of from 1 to 11; and i represents an integer of from 2 to 4; and j represents an integer of from 2 to 10.

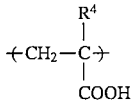
(a-1)

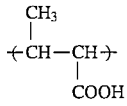
(a-2)

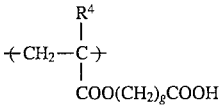
(a-3)

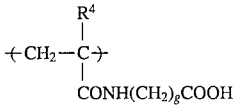
(a-4)

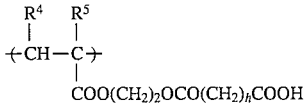
(a-5)

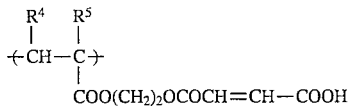
(a-6)

-continued
(a-7)
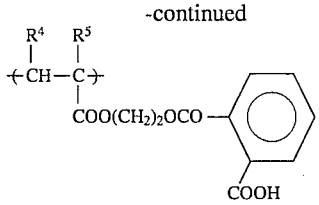
(a-8)
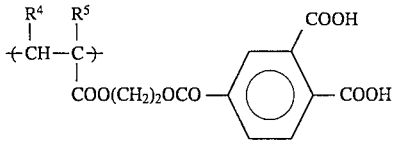
(a-9)
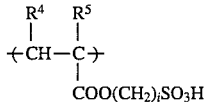
(a-10)
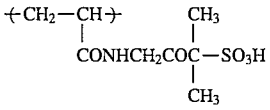
(a-11)
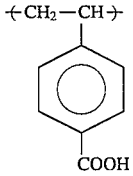
(a-12)
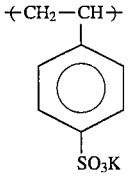
(a-13)
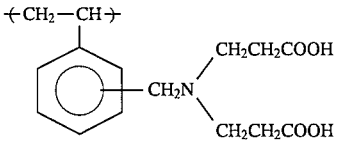
(a-14)
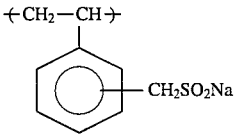
(a-15)
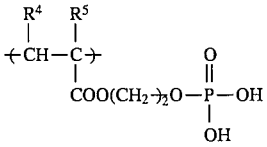
(a-16)
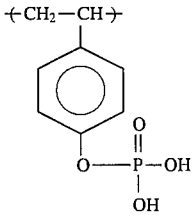
-continued
(a-17)
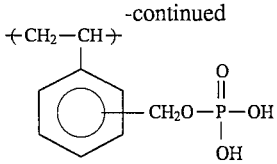
(a-18)
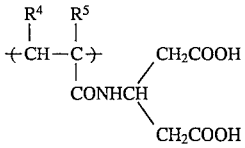
(a-19)
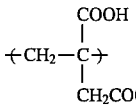
(a-20)
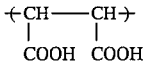
(a-21)
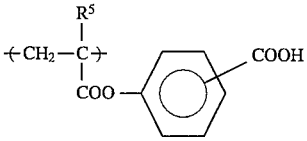
(a-22)
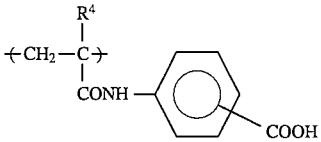
(a-23)
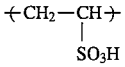
(a-24)
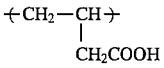
(a-25)
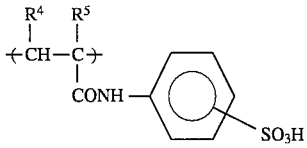
(a-26)
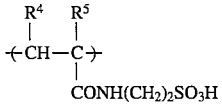
(a-27)
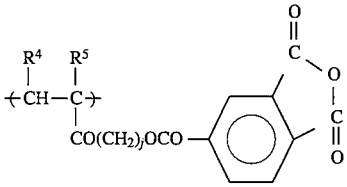
(a-28)
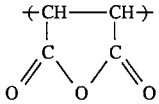
(a-29)
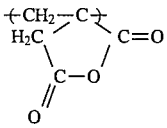

-continued
(a-30)
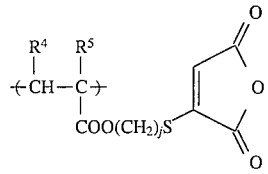
(a-31)
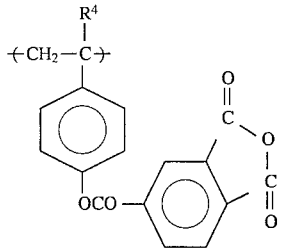
(a-32)
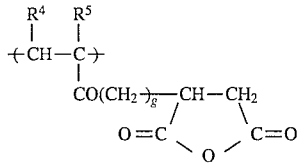
(a-33)
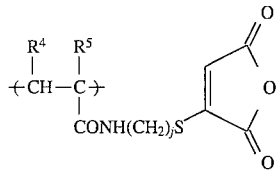
(a-34)
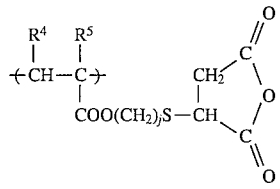
(a-35)
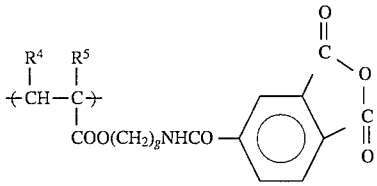
(a-36)
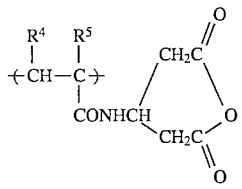
(a-37)
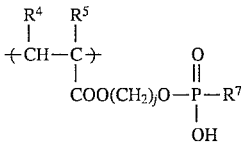
(a-38)
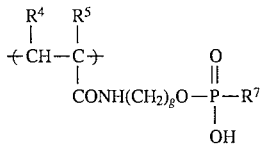
-continued
(a-39)
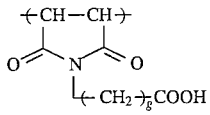
(a-40)
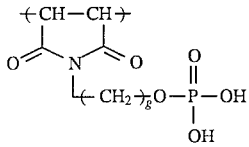
(a-41)
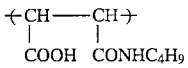
(a-42)
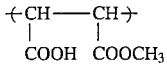
(a-43)
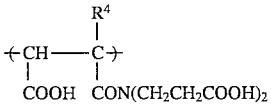
(a-44)
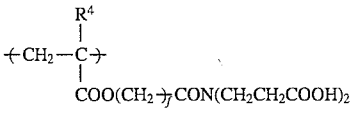
(a-45)
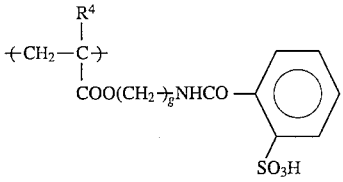
(a-46)
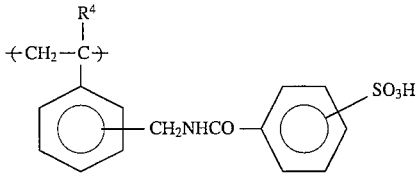
(a-47)
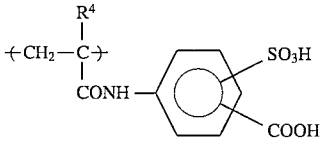
(a-48)
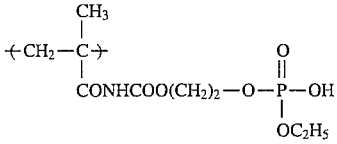
(a-49)
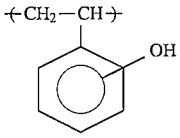
(a-50)
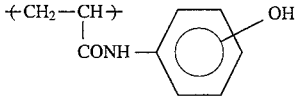

-continued

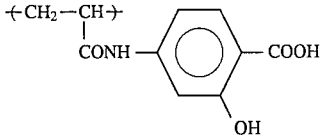
(a-51)

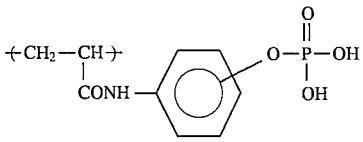
(a-52)

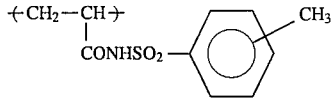
(a-53)

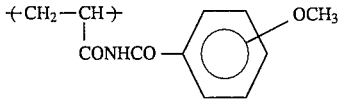
(a-54)

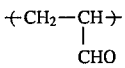
(a-55)

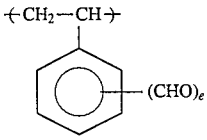
(a-56)

The polymer component (b) containing a functional group capable of forming a specific hydrophilic group upon a chemical reaction will be described below.

The number of hydrophilic groups formed from one functional group capable of forming a hydrophilic group upon the chemical reaction may be one, two or more.

Now, a functional group capable of forming at least one carboxyl group upon a chemical reaction will be described below.

According to one preferred embodiment of the present invention, a carboxy group-forming functional group is represented by the following general formula (F-I):

$$-COO-L^1 \qquad \text{(F-I)}$$

wherein $L^1$ represents

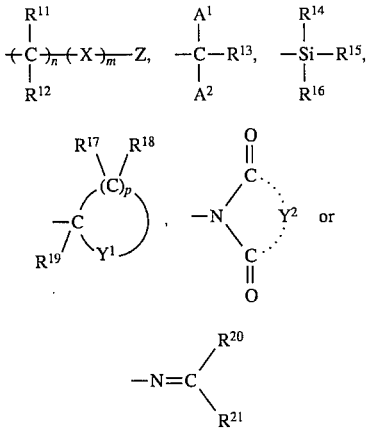

wherein $R^{11}$ and $R^{12}$, which may be the same or different, each represent a hydrogen atom or a hydrocarbon group; X represents an aromatic group; Z represents a hydrogen atom, a halogen atom, a trihalomethyl group, an alkyl group, a cyano group, a nitro group, $-SO_2-Z^1$ (wherein $Z^1$ represents a hydrocarbon group), $-COO-Z^2$ (wherein $Z^2$ represents a hydrocarbon group), $-O-Z^3$ (wherein $Z^3$ represents a hydrocarbon group), or $-CO-Z^4$ (wherein $Z^4$ represents a hydrocarbon group); n and m each represent 0, 1 or 2, provided that when both n and m are 0, Z is not a hydrogen atom; $A^1$ and $A^2$ which may be the same or different, each represent an electron attracting group having a positive Hammett's σ value; $R^{13}$ represents a hydrogen atom or a hydrocarbon group; $R^{14}$, $R^{15}$, $R^{16}$, $R^{20}$ and $R^{21}$, which may be the same or different, each represent a hydrocarbon group or $-O-Z^5$ (wherein $Z^5$ represents a hydrocarbon group); $Y^1$ represents an oxygen atom or a sulfur atom; $R^{17}$, $R^{18}$, and $R^{19}$, which may be the same or different, each represent a hydrogen atom, a hydrocarbon group or $-O-Z^7$ (wherein $Z^7$ represents a hydrocarbon group); p represents an integer of 3 or 4; $Y^2$ represents an organic residue for forming a cyclic imido group.

In more detail, $R^{11}$ and $R^{12}$, which may be the same or different, each preferably represents a hydrogen atom or a straight chain or branched chain alkyl group having from 1 to 12 carbon atoms which may be substituted (e.g., methyl, ethyl, propyl, chloromethyl, dichloromethyl, trichloromethyl, trifluoromethyl, butyl, hexyl, octyl, decyl, hydroxyethyl, or 3-chloropropyl). X preferably represents a phenyl or naphthyl group which may be substituted (e.g., phenyl, methylphenyl, chlorophenyl, dimethylphenyl, chloromethylphenyl, or naphthyl). Z preferably represents a hydrogen atom, a halogen atom (e.g., chlorine or fluorine), a trihalomethyl group (e.g., trichloromethyl or trifluoromethyl), a straight chain or branched chain alkyl group having from 1 to 12 carbon atoms which may be substituted (e.g., methyl, chloromethyl, dichloromethyl, ethyl, propyl, butyl, hexyl, tetrafluoroethyl, octyl, cyanoethyl, or chloroethyl), a cyano group, a nitro group, $-SO_2-Z^1$ (wherein $Z^1$ represents an aliphatic group (for example an alkyl group having from 1 to 12 carbon atoms which may be substituted (e.g., methyl, ethyl, propyl, butyl, chloroethyl, pentyl, or octyl) or an aralkyl group having from 7 to 12 carbon atoms which may be substituted (e.g., benzyl, phenethyl, chlorobenzyl, methoxybenzyl, chlorophenethyl, or methylphenethyl)), or an aromatic group (for example, a phenyl or naphthyl group which may be substituted (e.g., phenyl, chlorophenyl, dichlorophenyl, methylphenyl, methoxyphenyl, acetylphenyl, acetamidophenyl, methoxycarbonylphenyl, or naphthyl)), $-COO-Z^2$ (wherein $Z^2$ has the same meaning as $Z^1$ above), $-O-Z^3$ (wherein $Z^3$ has the same meaning as $Z^1$ above), or $-CO-Z^4$ (wherein $Z^4$ has the same meaning as $Z^1$ above). n and m each represent 0, 1 or 2, provided that when both n and m are 0, Z is not a hydrogen atom.

$R^{14}$, $R^{15}$, $R^{16}$, $R^{20}$ and $R^{21}$, which may be the same or different, each preferably represent an aliphatic group having 1 to 18 carbon atoms which may be substituted (wherein the aliphatic group includes an alkyl group, an alkenyl group, an aralkyl group, and an alicyclic group, and the substituent therefor includes a halogen atom, a cyano group, and $-O-Z^6$ (wherein $Z^6$ represents an alkyl group, an aralkyl group, an alicyclic group, or an aryl group)), an aromatic group having from 6 to 18 carbon atoms which may be substituted (e.g., phenyl, tolyl, chlorophenyl, methoxyphenyl, acetamidophenyl, or naphthyl), or $-O-Z^5$ (wherein $Z^5$ represents an alkyl group having from 1 to 12 carbon atoms which may be substituted, an alkenyl group having from 2 to 12 carbon atoms which may be substituted, an aralkyl group having from 7 to 12 carbon atoms which may be substituted, an alicyclic group having from 5 to 18 carbon atoms which may be substituted, or an aryl group having from 6 to 18 carbon atoms which may be substituted).

$A^1$ and $A^2$ may be the same or different, at least one of $A^1$ and $A^2$ represents an electron attracting group, with the sum of their Hammett's $\sigma_p$ values being 0.45 or more. Examples of the electron attracting group for $A^1$ or $A^2$ include an acyl group, an aroyl group, a formyl group, an alkoxycarbonyl group, a phenoxycarbonyl group, an alkylsulfonyl group, an aroylsulfonyl group, a nitro group, a cyano group, a halogen atom, a halogenated alkyl group, and a carbamoyl group.

A Hammett's $\sigma_p$ value is generally used as an index for estimating the degree of electron attracting or donating property of a substituent. The greater the positive value, the higher the electron attracting property. Hammett's $\sigma_p$ values of various substituents are described, e.g., in Naoki Inamoto, *Hammett Soku-Kozo to Han-nosei*, Maruzen (1984).

It seems that an additivity rule applies to the Hammett's $\sigma_p$ values in this system so that both of $A^1$ and $A^2$ need not be electron attracting groups. Therefore, where one-of them is an electron attracting group, the other may be any group selected without particular limitation as far as the sum of their $\sigma_p$ values is 0.45 or more.

$R^{13}$ preferably represents a hydrogen atom or a hydrocarbon group having from 1 to 8 carbon atoms which may be substituted, e.g., methyl, ethyl, propyl, butyl, pentyl, hexyl, octyl, allyl, benzyl, phenethyl, 2-hydroxyethyl, 2-methoxyethyl, 2-ethoxyethyl, 3-methoxypropyl, or 2-chloroethyl.

$Y^1$ represents an oxygen atom or a sulfur atom. $R^{17}$, $R^{18}$, and $R^{19}$, which may be the same or different, each preferably represents a hydrogen atom, a straight chain or branched chain alkyl group having from 1 to 18 carbon atoms which may be substituted (e.g., methyl, ethyl, propyl, butyl, hexyl, octyl, decyl, dodecyl, octadecyl, chloroethyl, methoxyethyl, or methoxypropyl), an alicyclic group which may be substituted (e.g., cyclopentyl or cyclohexyl), an aralkyl group having from 7 to 12 carbon atoms which may be substituted (e.g., benzyl, phenethyl, chlorobenzyl, or methoxybenzyl), an aromatic group which may be substituted (e.g., phenyl, naphthyl, chlorophenyl, tolyl, methoxyphenyl, methoxycarbonylphenyl, or dichlorophenyl), or —O—$Z^7$ (wherein $Z^7$ represents a hydrocarbon group and specifically the same hydrocarbon group as described for $R^{17}$, $R^{18}$, or $R^{19}$). p represents an integer of 3 or 4.

$Y^2$ represents an organic residue for forming a cyclic imido group, and preferably represents an organic residue represented by the following general formula (A) or (B):

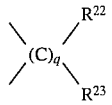

(A)

wherein $R^{22}$ and $R^{23}$, which may be the same or different, each represent a hydrogen atom, a halogen atom (e.g., chlorine or bromine), an alkyl group having from 1 to 18 carbon atoms which may be substituted (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, or 2-(ethoxymethoxy-)ethyl), an aralkyl group having from 7 to 12 carbon atoms which may be substituted (e.g., benzyl, phenethyl, 3-phenylpropyl, methylbenzyl, dimethylbenzyl, methoxybenzyl, chlorobenzyl, or bromobenzyl), an alkenyl group having from 3 to 18 carbon atoms which may be substituted (e.g., allyl, 3-methyl-2-propenyl, 2-hexenyl, 4-propyl-2-pentenyl, or 12-octadecenyl), —S—$Z^8$ (wherein $Z^8$ represents an alkyl, aralkyl or alkenyl group having the same meaning as $R^{22}$ or $R^{23}$ described above or an aryl group which may be substituted (e.g., phenyl, tolyl, chlorophenyl, bromophenyl, methoxyphenyl, ethoxyphenyl, or ethoxycarbonylphenyl)) or —NH—$Z^9$ (wherein $Z^9$ has the same meaning as $Z^8$ described above). Alternatively, $R^{22}$ and $R^{23}$ may be taken together to form a ring, such as a 5- or 6-membered monocyclic ring (e.g., cyclopentane or cyclohexane) or a 5- or 6-membered bicyclic ring (e.g., bicyclopentane, bicycloheptane, bicyclooctane, or bicyclooctene). The ring may be substituted. The substituent includes those described for $R^{22}$ or $R^{23}$. q represents an integer of 2 or 3.

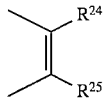

(B)

wherein $R^{24}$ and $R^{25}$, which may be the same or different, each have the same meaning as $R^{22}$ or $R^{23}$ described above. Alternatively, $R^{24}$ and $R^{25}$ may be taken together to form an aromatic ring (e.g., benzene or naphthalene).

According to another preferred embodiment of the present invention, the carboxyl group-forming functional group is a group containing an oxazolone ring represented by the following general formula (F-II):

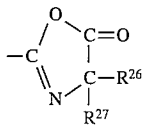

(F-II)

wherein $R^{26}$ and $R^{27}$, which may be the same or different, each represent a hydrogen atom or a hydrocarbon group, or $R^{26}$ and $R^{27}$ may be taken together to form a ring.

In the general formula (F-II), $R^{26}$ and $R^{27}$ each preferably represents a hydrogen atom, a straight chain or branched chain alkyl group having from 1 to 12 carbon atoms which may be substituted (e.g., methyl, ethyl, propyl, butyl, hexyl, 2-chloroethyl, 2-methoxyethyl, 2-methoxycarbonylethyl, or 3-hydroxypropyl), an aralkyl group having from 7 to 12 carbon atoms which may be substituted (e.g., benzyl, 4-chlorobenzyl, 4-acetamidobenzyl, phenethyl, or 4-methoxybenzyl), an alkenyl group having from 2 to 12 carbon atoms which may be substituted (e.g., vinyl, allyl, isopropenyl, butenyl, or hexenyl), a 5- to 7-membered alicyclic group which may be substituted (e.g., cyclopentyl, cyclohexyl, or chlorocyclohexyl), or an aromatic group which may be substituted (e.g., phenyl, chlorophenyl, methoxyphenyl, acetamidophenyl, methylphenyl, dichlorophenyl, nitrophenyl, naphthyl, butylphenyl, or dimethylphenyl). Alternatively, $R^{26}$ and $R^{27}$ may be taken together to form a 4- to 7-membered ring (e.g., tetramethylene, pentamethylene, or hexamethylene).

A functional group capable of forming at least one sulfo group upon a chemical reaction includes a functional group represented by the following general formula (F-III) or (F-IV):

$$—SO_2—O—L^2 \quad \text{(F-III)}$$

$$—SO_2—S—L^2 \quad \text{(F-IV)}$$

wherein $L^2$ represents

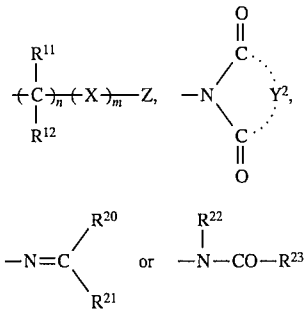

wherein $R^{11}$, $R^{12}$, X, Z, n, m, $Y^2$, $R^{20}$, $R^{21}$, $R^{22}$ and $R^{23}$ each has the same meaning as defined above.

A functional group capable of forming at least one sulfinic acid group upon a chemical reaction includes a functional group represented by the following general formula (F-V):

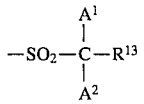

(F-V)

wherein $A^1$, $A^2$ and $R^{13}$ each has the same meaning as defined above.

A functional group capable of forming at least one $—P(=O)(OH)R^1$ group upon a chemical reaction includes a functional group represented by the following general formula (F-VIa) or (F-VIb):

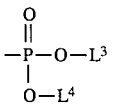

(F-VIa)

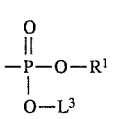

(F-VIb)

wherein $L^3$ and $L^4$ which may be the same or different, each has the same meaning as $L^1$ described above, and $R^1$ has the same meaning as defined above.

One preferred embodiment of functional groups capable of forming at least one hydroxyl group upon a chemical reaction includes a functional group represented by the following general formula (F-VII):

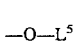

(F-VII):

wherein $L^5$ represents

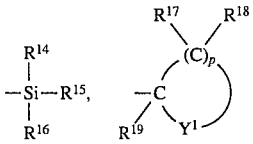

$—CO—R^{28}$ or $—CH=CH—CH_3$ wherein $R^{14}$, $R^{15}$, $R^{16}$, $R^{17}$, $R^{18}$, $R^{19}$, $Y^1$, and p each has the same meaning as defined above; and $R^{28}$ represents a hydrocarbon group, and specifically the same hydrocarbon group as described for $R^{11}$.

Another preferred embodiment of functional groups capable of forming at least one hydroxyl group upon a chemical reaction includes a functional group wherein at least two hydroxyl groups which are sterically close to each other are protected with one protective group. Such hydroxyl group-forming functional groups are represented, for example, by the following general formulae (F-VIII), (F-IX) and (F-X):

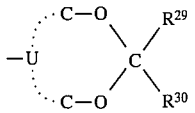

(F-VIII)

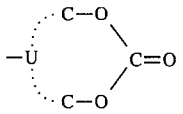

(F-IX)

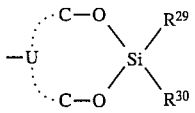

(F-X)

wherein $R^{29}$ and $R^{30}$, which may be the same or different, each represents a hydrogen atom, a hydrocarbon group, or $—O—Z^{10}$ (wherein $Z^{10}$ represents a hydrocarbon group); and U represents a carbon-to-carbon bond which may contain a hetero atom, provided that the number of atoms present between the two oxygen atoms is 5 or less.

More specifically, $R^{29}$ and $R^{30}$, which may be the same or different, each preferably represents a hydrogen atom, an alkyl group having from 1 to 12 carbon atoms which may be substituted (e.g., methyl, ethyl, propyl, butyl, hexyl, 2-methoxyethyl, or octyl), an aralkyl group having from 7 to 9 carbon atoms which may be substituted (e.g., benzyl, phenethyl, methylbenzyl, methoxybenzyl, or chlorobenzyl), an alicyclic group having from 5 to 7 carbon atoms (e.g., cyclopentyl or cyclohexyl), an aryl group which may be substituted (e.g., phenyl, chlorophenyl, methoxyphenyl, methylphenyl, or cyanophenyl), or $—OZ^{10}$ (wherein $Z^{10}$ represents a hydrocarbon group, and specifically the same hydrocarbon group as described for $R^{29}$ or $R^{30}$), and U represents a carbon-to-carbon bond which may contain a hetero atom, provided that the number of atoms present between the two oxygen atoms is 5 or less.

Specific examples of the functional groups represented by the general formulae (F-I) to (F-X) described above are set forth below, but the present invention should not be construed as being limited thereto. In the following formulae (b-1) through (b-67), the symbols used have the following meanings respectively:

$W_1$: —CO—, $—SO_2—$, or

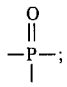

$W_2$: —CO— or $—SO_2—$;

$Q^1$: $—C_nH_{2n+1}$ (n: an integer of from 1 to 8),

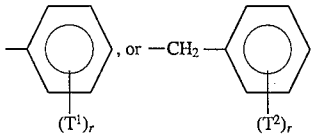

$T^1$, $T^2$: —H, $—C_nH_{2n+1}$, $—OC_nH_{2n+1}$, —CN, $—NO_2$, —Cl, —Br, $—COOC_nH_{2n+1}$, $—NHCOC_nH_{2n+1}$, or $—COC_nH_{2n+1}$;

r: an integer of from 1 to 5;

$Q^2$: —$C_nH_{2n+1}$, —$CH_2C_6H_5$, or —$C_6H_5$;

$Q^3$: —$C_mH_{2m+1}$ (m: an integer of from 1 to 4) or —$CH_2C_6H_5$;

$Q^4$: —H, —$CH_3$, or —$OCH_3$;

$Q^5$, $Q^6$: —H, —$CH_3$, —$OCH_3$, —$C_6H_5$, or —$CH_2C_6H_5$;

G: —O— or —S—; and

J: —Cl or —Br $-W_1-O-(CH_2)_2COQ^1$ (b-1)

$-W_1-O-C(CH_3)_2-CH_2COQ^1$ (b-2)

$-W_1-O(CH_2)_2COOQ^1$ (b-3)

$-W_1-O(CH_2)_2SO_2Q^1$ (b-4)

$-W_1-O(CH_2)_2CN$ (b-5)

$-W_1-O(CH_2)_2NO_2$ (b-6)

$-W_1-O-CH(Q^2)-CH_2COQ^1$ (b-7)

$-W_1-O-CH_2-CH(Q^2)-COQ^1$ (b-8)

$-W_1-O-CH(Q^2)-CH(Q^2)-COQ^1$ (b-9)

$-W_1-O-C(CH_3)_2-CH_2SO_2Q^1$ (b-10)

$-W_1-O-C(COCH_3)(Q^3)(COOQ^1)$ (b-11)

$-W_1-O-C(COOQ^1)(Q^3)(COOQ^1)$ (b-12)

$-W_1-O-C(CN)(Q^3)(CN)$ (b-13)

$-W_1-O-C(COQ^1)(Q^3)(COQ^2)$ (b-14)

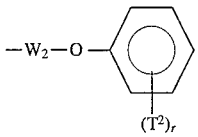
(b-15)

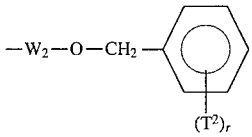
(b-16)

-continued

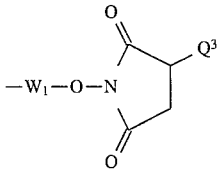
(b-17)

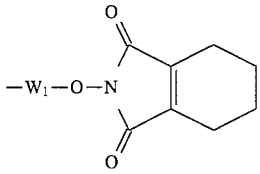
(b-18)

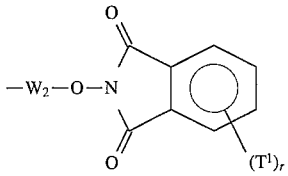
(b-19)

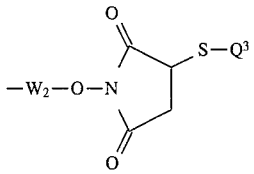
(b-20)

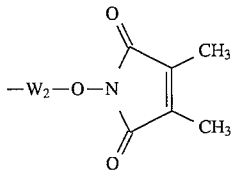
(b-21)

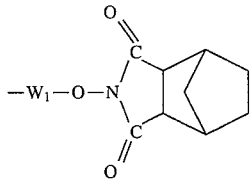
(b-22)

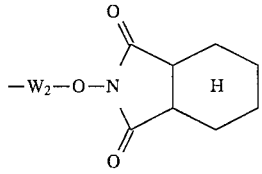
(b-23)

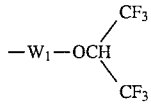
(b-24)

$-W_1-O-CH_2CF_3$ (b-25)

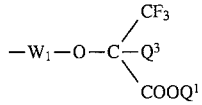
(b-26)

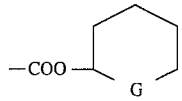
(b-27)

-continued
(b-28)
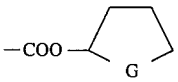
(b-29)
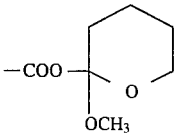
(b-29)
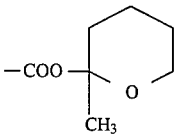
$-COOSi(C_3H_7)_3$ (b-31)
(b-32)
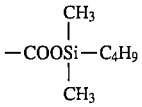
(b-33)
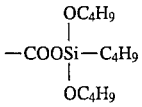
(b-34)
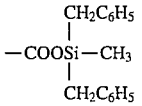
$-SO_3-CH_2COQ^1$ (b-35)
$-SO_3CH_2COOQ^1$ (b-36)
$-SO_3(CH_2)_2J$ (b-37)
(b-38)
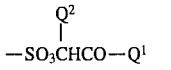
(b-39)
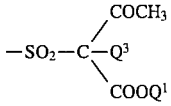
(b-40)
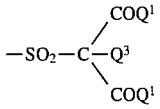
(b-41)
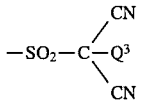
(b-42)
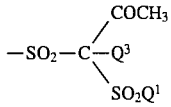
(b-43)
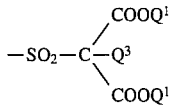
(b-44)
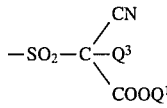
-continued
(b-45)
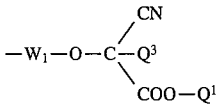
(b-46)
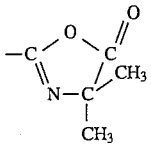
(b-47)
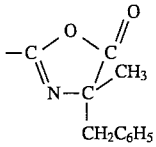
(b-48)
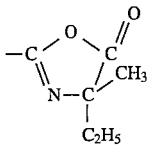
(b-49)
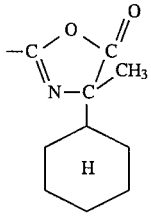
(b-50)
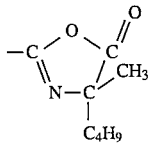
(b-51)
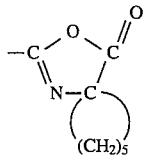
(b-52)
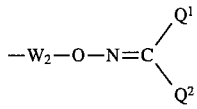
(b-53)
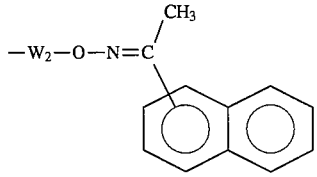
(b-54)
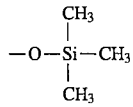
(b-55)
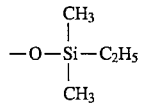

-continued (b-56)

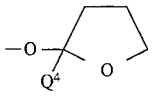

(b-57)

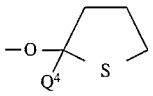

(b-58)

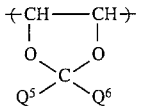

(b-59)

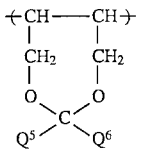

(b-60)

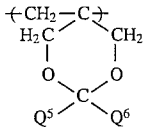

(b-61)

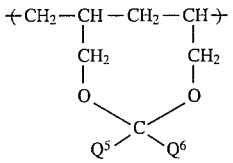

(b-62)

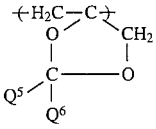

(b-63)

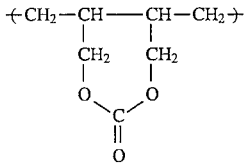

(b-64)

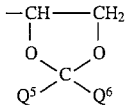

(b-65)

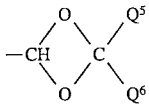

(b-66)

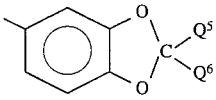

(b-67)

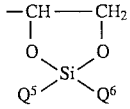

The polymer component (b) which contains the functional group capable of forming at least one hydrophilic group selected from —COOH, —CHO, —$SO_3H$, —$SO_2H$, —P(=O)(OH)$R^1$ and —OH upon a chemical reaction which can be used in the present invention is not particularly limited. Specific examples thereof include polymer components obtained by protecting the hydrophilic group in the polymer components (a) described above.

The above-described functional group capable of forming at least one hydrophilic group selected from —COOH, —CHO, —$SO_3H$, —$SO_2H$, —P(=O)(OH)$R^1$, and —OH upon a chemical reaction used in the present invention is a functional group in which such a hydrophilic group is protected with a protective group. Introduction of the protective group into a hydrophilic group by a chemical bond can easily be carried out according to conventionally known methods. For example, the reactions as described in J. F. W. McOmie, *Protective Groups in Organic Chemistry*, Plenum Press (1973), T. W. Greene, *Protective Groups in Organic Synthesis*, Wiley-Interscience (1981), Nippon Kagakukai (ed.), *Shin Jikken Kagaku Koza*, Vol. 14, "Yuki Kagobutsu no Gosei to Han-no", Maruzen (1978), and Yoshio Iwakura and Keisuke Kurita, *Han-nosei Kobunshi*, Kodansha can be employed.

In order to introduce the functional group which can be used in the present invention into a resin, a process using a so-called polymer reaction in which a polymer containing at least one hydrophilic group selected from —COOH, —CHO, —$SO_3H$, —$SO_2H$, —$PO_3H_2$, and —OH is reacted to convert its hydrophilic group to a protected hydrophilic group or a process comprising synthesizing at least one monomer containing at least one of the functional groups, for example, those represented by the general formulae (F-I) to (F-X) and then polymerizing the monomer or copolymerizing the monomer with any appropriate other copolymerizable monomer(s) is used.

The latter process (comprising preparing the desired monomer and then conducting polymerization reaction) is preferred for reasons that the amount or kind of the functional group to be incorporated into the polymer can be appropriately controlled and that incorporation of impurities can be avoided (in case of the polymer reaction process, a catalyst to be used or by-products are mixed in the polymer).

For example, a resin containing a carboxyl group-forming functional group may be prepared by converting a carboxyl group of a carboxylic acid containing a polymerizable double bond or a halide thereof to a functional group represented by the general formula (F-I) by the method as described in the literature references cited above and then subjecting the functional group-containing monomer to a polymerization reaction.

Also, a resin containing an oxazolone ring represented by the general formula (F-II) as a carboxyl group-forming functional group may be obtained by conducting a polymerization reaction of at least one monomer containing the oxazolone ring, if desired, in combination with other copolymerizable monomer(s). The monomer containing the oxazolone ring can be prepared by a dehydrating cyclization reaction of an N-acyloyl-α-amino acid containing a polymerizable unsaturated bond. More specifically, it can be prepared according to the method described in the literature references cited in Yoshio Iwakura and Keisuke Kurita, *Han-nosei Kobunshi*, Ch. 3, Kodansha.

The resin (A) may contain, in addition to the polymer components (a) and/or (b), a polymer component (c) containing a moiety having at least one of a fluorine atom and a silicon atom in order to increase the releasability of the resin (A) itself.

The moiety having a fluorine atom and/or a silicon atom contained in the resin satisfying the above described requirement on thermal property includes that incorporated into the main chain of the polymer and that contained as a substituent in the side chain of the polymer.

The polymer components (c) are preferably present as a block in the resin (A). The content of polymer component (c) is preferably from 1 to 20% by weight based on the total polymer component in the resin (A). If the content of polymer component (c) is less than 1% by weight, the effect for improving the releasability of the resin (A) is small and on the other hand, if the content is more than 20% by weight, wettability of the resin (A) with a processing solution may tend to decrease, resulting in some difficulties for complete removal of the transfer layer.

The polymer component (c) is same as a polymer component (F) containing a moiety having a fluorine atom and/or a silicon atom which may be included in a resin (P) described in detail hereinafter.

Also, embodiments of polymerization patterns of a copolymer containing polymer components (c) as a block and methods for the preparation of the copolymer are the same as those described hereinafter for a block copolymer containing the polymer components (F).

The resin (A) preferably contains other polymer component(s) in addition to the above-described specific polymer components (a) and/or (b) and, if desired, the polymer component (c) in order to maintain its electrically insulating property and thermoplasticity. As such polymer components, those which form a homopolymer having a glass transition point of not more than 130° C. are preferred. More specifically, examples of such other polymer components include those corresponding to the repeating unit represented by the following general formula (U):

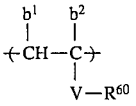

(U)

wherein V represents —COO—, —OCO—, —O—, —CO—, $—C_6H_4—$, $-(CH_2)_n COO—$ or $-(CH_2)_n OCO—$; n represents an integer of from 1 to 4; $R^{60}$ represents a hydrocarbon group having from 1 to 22 carbon atoms; and $b^1$ and $b^2$, which may be the same or different, each represents a hydrogen atom, a fluorine atom, a chlorine atom, a bromine atom, a cyano group, a trifluoromethyl group, a hydrocarbon group having from 1 to 7 carbon atoms (e.g., methyl, ethyl, propyl, butyl, pentyl, hexyl, phenyl and benzyl) or $—COOZ^{11}$ (wherein $Z^{11}$ represents a hydrocarbon group having from 1 to 7 carbon atoms).

Preferred examples of the hydrocarbon group represented by $R^{60}$ include an alkyl group having from 1 to 18 carbon atoms which may be substituted (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxybromoethyl, ethyl, 2-ethoxyethyl, and 2-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), and an aromatic group having from 6 to 12 carbon atoms which may be substituted (e.g., phenyl, tolyl, xylyl, mesityl, naphthyl, methoxyphenyl, ethoxyphenyl, fluorophenyl, methylfluorophenyl, difluorophenyl, bromophenyl, chlorophenyl, dichlorophenyl, methoxycarbonylphenyl, ethoxycarbonylphenyl, methanesulfonylphenyl, and cyanophenyl).

The content of one or more polymer components represented by the general formula (U) are preferably from 30 to 97% by weight based on the total polymer component in the resin (A).

Moreover, the resin (A) may further contain other copolymerizable polymer components than the above described specific polymer components and the polymer component represented by the general formula (U). Examples of monomers corresponding to such other polymer components include, in addition to methacrylic acid esters, acrylic acid esters and crotonic acid esters containing substituents other than those described for the general formula (U), α-olefins, vinyl or allyl esters of carboxylic acids (including, e.g., acetic acid, propionic acid, butyric acid, valeric acid, benzoic acid, naphthalenecarboxylic acid, as examples of the carboxylic acids), acrylonitrile, methacrylonitrile, vinyl ethers, itaconic acid esters (e.g., dimethyl ester, and diethyl ester), acrylamides, methacrylamides, styrenes (e.g., styrene, vinyltoluene, chlorostyrene, N,N-dimethylaminomethylstyrene, methoxycarbonylstyrene, methanesulfonyloxystyrene, and vinylnaphthalene), vinyl sulfone compounds, vinyl ketone compounds, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine). Such other polymer components may be employed in an appropriate range wherein the transferability of the resin (A) is not damaged. Specifically, it is preferred that the content of such other polymer components does not exceed 20% by weight based on the total polymer component of the resin (A).

If desired, the transfer layer may further contain other conventional resins in addition to the resin (A). It should be noted, however, that such other resins be used in a range that the easy removal of the transfer layer is not deteriorated. Specifically, the polymer components (a) and/or (b) should be present at least 5% by weight based on the total resin used for the formation of the transfer layer.

Examples of other resins which may be used in combination with the resin (A) include vinyl chloride resins, polyolefin resins, olefin-styrene copolymer resins, vinyl alkanoate resins, polyester resins, polyether resins, acrylic resins, methacrylic resins, cellulose resins, and fatty acid-modified cellulose resins. Specific examples of usable resins are described, e.g., in *Plastic Zairyo Koza Series*, Vols. 1 to 18, Nikkan Kogyo Shinbunsha (1961), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki, *Howa Polyester Jushi Handbook*, Nikkan Kogyo Shinbunsha (1989), Kobunshi Gakkai (ed.), *Kobunshi Data Handbook (Oyo-hen)*, Ch. 1, Baifukan (1986), and Yuji Harasaki, *Saishin Binder Gijutsu Binran*, Ch. 2, Sogo Gijutsu Center (1985). These thermoplastic resins may be used either individually or in combination of two or more thereof.

If desired, the transfer layer may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai*, pp. 29 to 107, Kobunshi Kankokai (1983).

The transfer layer preferably has a thickness of from 0.1 to 10 μm, and preferably from 0.5 to 7 μm in total. If the transfer layer is too thin, it is liable to result in insufficient transfer, and if the layer is too thick, troubles on the electrophotographic process tend to occur, failing to obtain a sufficient image density or resulting in degradation of image quality.

According to the present invention, the thermoplastic resin grains (AL) each containing the resin ($A_1$) and resin ($A_2$) each having the specific glass transition point described above are applied to the surface of light-sensitive element by an electrodeposition coating method and then transformed into a uniform thin film, for example, by heating, thereby the transfer layer being formed. The electrodeposition coating method used herein means a method wherein the resin grains (AL) are electrostatically adhered or electrodeposited on the surface of light-sensitive element.

The thermoplastic resin grains (AL) must have either a positive charge or a negative charge. The electroscopicity of the resin grains is appropriately determined depending on a charging property of the electrophotographic light-sensitive element to be used in combination.

An average grain diameter of the resin grains (AL) having the physical property described above is generally in a range of from 0.01 to 15 μm, preferably from 0.05 to 5 μm and more preferably from 0.1 to 1 μm. The resin grains may be employed as powder grains (in case of dry type electrodeposition), grains dispersed in a non-aqueous system (in case of wet type electrodeposition), or grains dispersed in an electrically insulating organic substance which is solid at normal temperature but becomes liquid by heating (in case of pseudo-wet type electrodeposition). The resin grains dispersed in a non-aqueous system are preferred since they can easily prepare the peelable transfer layer of uniform and small thickness.

The resin grains used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the thermoplastic resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gijutsu*, Techno System (1988).

The polymerization granulation methods include conventionally known methods using an emulsion polymerization reaction, a seed polymerization reaction or a suspension polymerization reaction each conducted in an aqueous system, or using a dispersion polymerization reaction conducted in a non-aqueous solvent system.

More specifically, grains are formed according to the methods as described, for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.*, 24, p. 34 (1974), Fumio Kitahara et al, *Bunsan Nyukakei no Kagaku*, Kogaku Tosho (1979), and Soichi Muroi (supervised), *Chobiryushi Polymer no Saisentan Gijutsu*, C.M.C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains electrically charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu.Jitsuyoka*, Ch. 1, Nippon Kogaku Joho (1985) is appropriately employed.

The production of resin grains dispersed in a non-aqueous system which are used in the wet type electrodeposition method can also be performed by any of the mechanical powdering method and polymerization granulation method as described above.

The mechanical powdering method includes a method wherein the thermoplastic resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a seed polymerization method. Specifically, fine grains are first prepared by a dispersion polymerization method in a non-aqueous system conventionally known as described, for example, in *Chobiryushi Polymer no Saisentan Gijutsu*, Ch. 2, mentioned above, *Saikin no Denshishashin Genzo System to Toner Zairyo no Kaihatsu.Jitsuyoka*, Ch. 3, mentioned above, and K. E. J. Barrett, *Dispersion Polymerization in Organic Media*, John Wiley & Sons (1975), and then using these fine grains as seeds, the desired resin grains are prepared by supplying monomer(s)corresponding to the resin (A) in the same manner as above.

The resin grains composed of a random copolymer containing the polymer components (a) and/or (b) and the polymer component (c) can be easily obtained by performing a polymerization reaction using monomers corresponding to the polymer components (a) and/or (b) together with a monomer corresponding to the polymer component (c) according to the polymerization granulation method described above.

The resin grains containing the polymer component (c) as a block can be prepared by conducting a polymerization reaction using, as a dispersion stabilizing resins, a block copolymer containing the polymer component (c) as a block, or conducting polymerization reaction using a monofunctional macromonomer having a weight average molecular weight of from $1\times10^3$ to $2\times10^4$, preferably from $3\times10^3$ to $5\times10^4$ and containing the polymer component (c) as main repeating unit together with the polymer components (a) and/or (b). Alternatively, the resin grains composed of block copolymer can be obtained by conducting a polymerization reaction using a polymer initiator (for example, azobis polymer initiator or peroxide polymer initiator) containing the polymer component (c) as main repeating unit.

As the non-aqueous solvent used for the preparation of resin grains dispersed in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of mono-disperse system with a very narrow distribution of grain diameters.

A dispersive medium used for the resin grains dispersed in a non-aqueous system is usually a non-aqueous solvent having an electric resistance of not less than $10^8$ Ω.cm and a dielectric constant of not more than 3.5, since the dispersion is employed in a method wherein the resin grains are electrodeposited utilizing a wet type electrostatic photographic developing process or electrophoresis in electric fields.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a dispersion of resin grains in non-aqueous system is that a block copolymer comprising a polymer portion which is soluble in the above-described non-aqueous solvent having an electric resistance of not less than $10^8$ Ω.cm and a dielectric constant of not more than 3.5 and a polymer portion which is insoluble in the non-aqueous solvent, is dispersed in the non-aqueous solvent by a wet type dispersion method. Specifically, the block copolymer is first synthesized in an organic solvent which dissolves the resulting block copolymer according to the synthesis method of block copolymer as described above and then dispersed in the non-aqueous solvent described above.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu.Jitsuyoka*, pp. 139 to 148, mentioned above, Denshishashin Gakkai (ed.), *Denshishashin Gijutsu no Kiso to Oyo*, pp. 497 to 505, Corona Sha (1988), and Yuji Harasaki, *Denshishashin*, Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965 are employed.

The dispersion of resin grains in a non-aqueous system (latex) which can be employed for electrodeposition usually comprises from 0.1 to 20 g of grains containing the thermoplastic resin, from 0.01 to 50 g of a dispersion stabilizing resin and if desired, from 0.0001 to 10 g of a charge control agent per one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicone oil, paraffin wax and triazine derivatives. The total amount of these additives is restricted by the electric resistance of the dispersion. Specifically, if the electric resistance of the dispersion in a state of excluding the grains therefrom becomes lower than $10^8$ Ω.cm, a sufficient amount of the thermoplastic resin grains deposited is reluctant to obtain and, hence, it is necessary to control the amounts of these additives in the range of not lowering the electric resistance than $10^8$ Ω.cm.

The thermoplastic resin grains (AL) which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshishashin Gijutsu no Kiso to Oyo*, pp. 275 to 285, mentioned above. Specifically, the grains comprising the thermoplastic resin are supplied between the electrophotographic light-sensitive element and an electrode placed in face of the light-sensitive element, and migrated by electrophoresis according to a potential gradient applied from an external power source to cause the grains to adhere to or electrodeposit on the electrophotographic light-sensitive element, thereby a film being formed.

In general, if the charge of grains is positive, an electric voltage was applied between an electroconductive support of the light-sensitive element and a development electrode of a developing device from an external power source so that the light-sensitive material is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toner development without exposure to light or after conducting a so-called print-off in which only unnecessary regions are exposed to light, as described in *Denshishashin Gijutsu no Kiso to Oyo*, pp. 46 to 79, mentioned above.

The medium for the resin grains dispersed therein which becomes liquid by heating is an electrically insulating organic compound which is solid at normal temperature and becomes liquid by heating at temperature of from 30° C. to 80° C., preferably from 40° C. to 70° C. Suitable compounds include paraffines having a solidifying point of from 30° C. to 80° C., waxes, low molecular weight polypropylene having a solidifying point of from 20° C. to 80° C. beef tallow having a solidifying point of from 20° C. to 50° C. and hardened oils having a solidifying point of from 30° C. to 80° C. They may be employed individually or as a combination of two or more thereof.

Other characteristics required are same as those for the dispersion of resin grains used in the wet type developing method.

The resin grains used in the pseudo-wet type electrodeposition according to the present invention can stably maintain their state of dispersion without the occurrence of heat adhesion of dispersed resin grains by forming a core/shell structure wherein the core portion is composed of a resin having a lower glass transition point or softening point and the shell portion is composed of a resin having a higher glass transition point or softening point which is not softened at the temperature at which the medium used becomes liquid.

The amount of thermoplastic resin grain adhered to the light-sensitive element can be appropriately controlled, for example, by an external bias voltage applied, a potential of the light-sensitive element charged and a developing time.

After the electrodeposition of grains, the developing solution is wiped off upon squeeze using a rubber roller, a gap roller or a reverse roller. Other known methods, for example, corona squeeze and air squeeze can also be employed. Then, the deposit is dried with cool air or warm air or by an infrared lamp preferably to be rendered the thermoplastic resin grains in the form of a film, thereby the transfer layer being formed.

Now, the electrophotographic light-sensitive element which can be used in the present invention will be described in detail below.

Any conventionally known electrophotographic light-sensitive element can be employed. What is important is that the surface of the light-sensitive element has the specified releasability at the time for the formation of transfer layer by an electrodeposition coating method using the resin grains (AL) so as to easily release the transfer layer provided thereon together with toner images.

More specifically, an electrophotographic light-sensitive element wherein an adhesive strength of the surface thereof measured according to JIS Z 0237-1980 "Testing methods of pressure sensitive adhesive tapes and sheets" is not more than 100 gram.force is preferably employed.

The measurement of adhesive strength is conducted according to JIS Z 0237-1980 8.3.1. 180 *Degrees Peeling Method* with the following modifications:

(i) As a test plate, an electrophotographic light-sensitive element comprising a substrate and a photoconductive layer, on the surface of which a transfer layer is to be provided is used.

(ii) As a test piece, a pressure resistive adhesive tape of 6 mm in width prepared according to JIS C 2338-1984 is used.

(iii) A peeling rate is 120 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stack portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

The adhesive strength of the surface of electrophotographic light-sensitive element is more preferably not more than 80 gram-force.

In order to obtain an electrophotographic light-sensitive element having a surface of the desired releasability on which the transfer layer is provided, there are a method of using on electrophotographic light-sensitive element which has already the surface exhibiting the desired releasability (first method), a method of applying a compound (S) exhibiting the desired releasability to a surface of electrophotographic light-sensitive element before the formation of transfer layer (second method), and a method of wet-type electrodeposition using a dispersion containing the resin grains (AL) and a compound (S') exhibiting the redesired releasability (third method). These methods may be employed in combination.

One example of the electrophotographic light-sensitive element, the surface of which has the releasability, used in the first method is an electrophotographic light-sensitive element using amorphous silicon as a photoconductive substance. Another example thereof wherein a photoconductive substance other than amorphous silicon is used is an electrophotographic light-sensitive element comprising a photoconductive layer and a separate layer (hereinafter expediently referred to as an overcoat layer sometimes), the surface of which has the releasability provided thereon, or an electrophotographic light-sensitive element in which the surface of the uppermost layer of a photoconductive layer (including a single photoconductive layer and a laminated photoconductive layer) is modified so as to exhibit the releasability.

In order to impart the releasability to the overcoat layer or the uppermost photoconductive layer, a polymer containing a silicon atom and/or a fluorine atom is used as a binder resin of the layer. It is preferred to use a small amount of a block copolymer containing a polymer segment comprising a silicon atom and/or fluorine atom-containing polymer component described in detail below (hereinafter referred to as a surface-localized type block copolymer) in combination with other binder resins. Further, such polymers containing a silicon atom and/or a fluorine atom are employed in the form of grains.

In the case of providing an overcoat layer, it is preferred to use the above-described surface-localized type block copolymer together with other binder resins of the layer for maintaining sufficient adhesion between the overcoat layer and the photoconductive layer. The surface-localized type copolymer is ordinarily used in a proportion of from 0.1 to 20 parts by weight per 100 parts by weight of the total composition of the overcoat layer.

Specific examples of the overcoat layer include a protective layer which is a surface layer provided on the light-sensitive element for protection known as one means for ensuring durability of the surface of a light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-189559, JP-A-62-75461, JP-A-62-139556, JP-A-62-139557, and JP-A-62-208055. Techniques relating to a protective layer using a fluorine type block copolymer are described, for example, in JP-A-61-116362, JP-A-61-117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in European Patent Application No. 534,479A1.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo- and/or heat-curable group-containing component are described in European Patent Application No. 534,279A1. Alternatively, a photo- and/or heat-curable resin may be used in combination with the fluorine atom and/or silicon atom-containing resin in the present invention.

The polymer comprising a polymer component containing a fluorine atom and/or a silicon atom effectively used for modifying the surface of the electrophotographic light-sensitive material according to the present invention include a resin (hereinafter referred to as resin (P) sometimes) and resin grain (hereinafter referred to as resin grain (L) sometimes).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks. More preferably, the polymer segment (β) of the block copolymer contains at least one polymer component containing at least one photo- and/or heat-curable functional group.

It is preferred that the polymer segment (β) does not contain any fluorine atom and/or silicon atom-containing polymer component.

As compared with the random copolymer, the block copolymer comprising the polymer segments (α) and (β) (surface-localized type copolymer) is more effective not only for improving the surface releasability but also for maintaining such a releasability.

More specifically, where a film is formed in the presence of a small amount of the resin (P) or resin grains (L) of copolymer containing a fluorine atom and/or a silicon atom, the resins (P) or resin grains (L) easily migrate to the surface portion of the film and are concentrated there by the end of a drying step of the film to thereby modify the film surface so as to exhibit the releasability.

Where the resin (P) is the block copolymer in which the fluorine atom and/or silicon atom-containing polymer segment (α) exists as a block, the other polymer segment (β) containing no, or if any a small proportion of, fluorine atom and/or silicon atom-containing polymer component undertakes sufficient interaction with the film-forming binder resin since it has good compatibility therewith. Thus, during the formation of the transfer layer on the electrophotographic light-sensitive element, further migration of the resin into the transfer layer is inhibited or prevented by an anchor effect to form and maintain the definite interface between the transfer layer and the electrophotographic light-sensitive element.

Further, where the segment (β) of the block copolymer contains a photo- and/or heat-curable group, crosslinking between the polymer molecules takes place during the film formation to thereby ensure retention of the releasability at the interface between the light-sensitive element and the transfer layer. Such a crosslinked structure is particularly advantageous when the light-sensitive element is repeatedly employed and when a liquid developer is used for the formation of toner image.

The above-described polymer may be used in the form of resin grains as described above. Preferred resin grains (L) are resin grains dispersible in a non-aqueous solvent. Such resin grains include a block copolymer comprising a non-aqueous solvent-insoluble polymer segment (α) which contains a fluorine atom and/or silicon atom-containing polymer component and a non-aqueous solvent-soluble polymer segment (β) which contains no, or if any not more than 20% of, fluorine atom and/or silicon atom-containing polymer component.

Where the resin grains (L) according to the present invention are used in combination with a binder resin, the insolubilized polymer segment undertakes migration of the grains to the surface portion and concentration there while the soluble polymer segment exerts an interaction with the binder resin (an anchor effect) similarly to the above-described resin (P). When the resin grains contain a photo- and/or heat-curable group, further migration of the grains to the transfer layer can be avoided.

Now, a moiety having a fluorine atom and/or a silicon atom, a polymer component (F) containing the moiety and an embodiment of polymerization patterns of a block copolymer containing the polymer component (F), and a method for the preparation of the copolymer will be described in detail below.

The polymer component (F) is a polymer component containing the moiety having a fluorine atom and/or a silicon atom.

The moiety having a fluorine atom and/or a silicon atom contained in the resin (P) or resin grains (L) includes that incorporated into the main chain of the polymer and that contained as a substituent in the side chain of the polymer.

The fluorine atom-containing moieties include monovalent or divalent organic residues, for example, $—C_hF_{2h+1}$ (wherein h represents an integer of from 1 to 18) $—(CF_2)_jCF_2H$ (wherein j represents an integer of from 1to 17), $—CFH_2$,

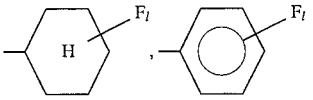

wherein l represents an integer of from 1 to 5), $—CF_2—$, —CFH—,

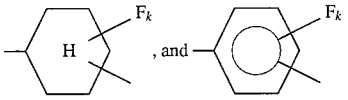

(wherein k represents an integer of from 1 to 4).

The silicon atom-containing moieties include monovalent or divalent organic residues, for example,

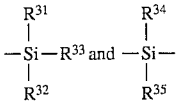

wherein $R^{31}$, $R^{32}$, $R^{33}$, $R^{34}$, $R^{35}$, which may be the same or different, each represents a hydrocarbon group which may be substituted or $—OR^{36}$ wherein $R^{36}$ represents a hydrocarbon group which may be substituted.

The hydrocarbon group represented by $R^{31}$, $R^{32}$, $R^{33}$, $R^{34}$, $R^{35}$ or $R^{36}$ include specifically an alkyl group having from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, or 2,2,2,2',2',2'-hexafluoroisopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-pentenyl, hexenyl, or 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylmethylbenzyl, or dimethoxybenzyl), an alicyclic group having from 5 to 8 carbon atoms which may be substituted (e.g., cyclohexyl, 2-cyclohexylethyl, or 2-cyclopentylethyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, or dodecyloylamidophenyl).

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding

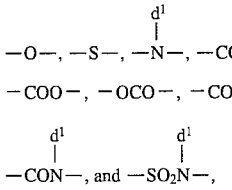

wherein $d^1$ has the same meaning as $R^{31}$ above.

Examples of the divalent aliphatic groups are shown below.

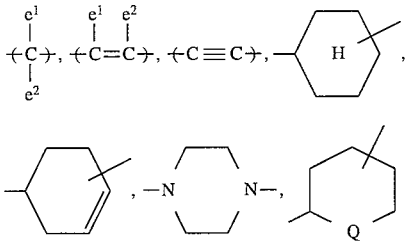

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents —O—, —S—, or

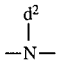

wherein $d^2$ represents an alkyl group having from 1 to 4 carbon atoms, $—CH_2Cl$, or $—CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the repeating units having the fluorine atom and/or silicon atom-containing moiety as described above are set forth below, but the present invention should not be construed as being limited thereto. In formulae (F-1) to (F-32) below, $R_f$ represents any one of the following groups of from (1) to (11); and b represents a hydrogen atom or a methyl group.

$-C_nF_{2n+1}$ (1)
$-CH_2C_nF_{2n+1}$ (2)
$-CH_2CH_2C_nF_{2n+1}$ (3)
$-CH_2(CF_2)_mCFHCF_3$ (4)
$-CH_2CH_2(CF_2)_mCFHCF_3$ (5)
$-CH_2CH_2(CF_2)_mCFHCF_2H$ (6)
$-CH_2(CF_2)_mCFHCF_2H$ (7)

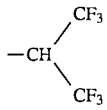
(8)

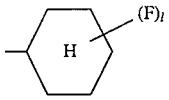
(9)

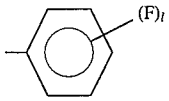
(10)

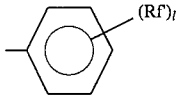
(11)

wherein $R_f'$ represents any one of the above-described groups of from (1) to (8); n represents an integer of from 1 to 18; m represents an integer of from 1 to 18; and l represents an integer of from 1 to 5.

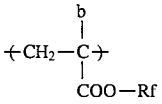
(F-1)

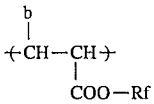
(F-2)

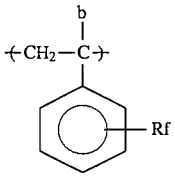
(F-3)

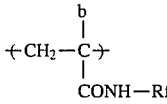
(F-4)

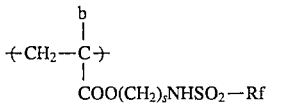
(F-5)
(s: an interger of from 1 to 12)

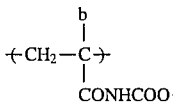
(F-6)

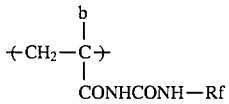
(F-7)

-continued

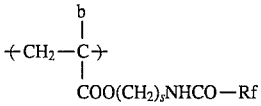
(F-8)

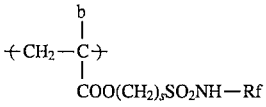
(F-9)

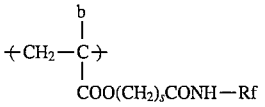
(F-10)

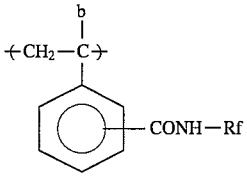
(F-11)

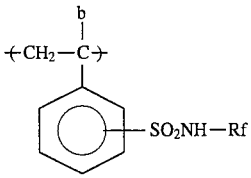
(F-12)

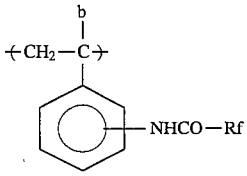
(F-13)

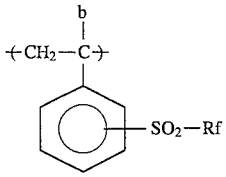
(F-14)

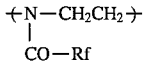
(F-15)

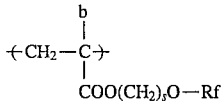
(F-16)

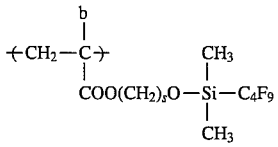
(F-17)

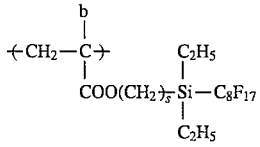
(F-18)

-continued (F-19)

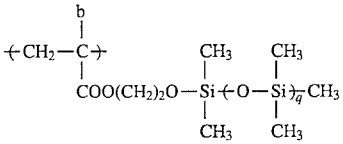

q: an integer of from 1 to 20

(F-20)

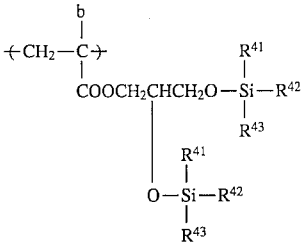

$R^{41}$, $R^{42}$, $R^{43}$: an alkyl group having from 1 to 12 carbon atoms (F-21)

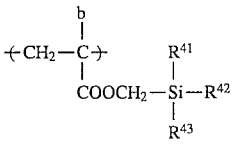

(F-22)

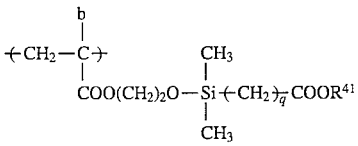

(F-23)

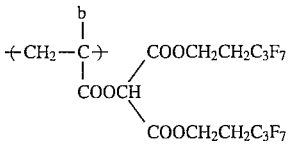

(F-24)

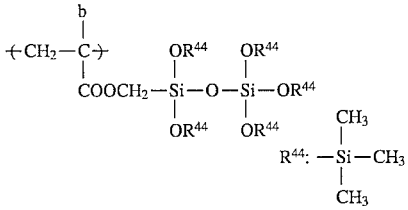

(F-25)

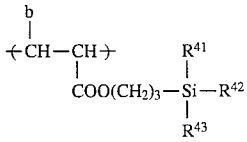

(F-26)

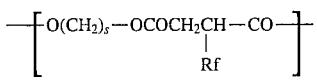

(F-27)

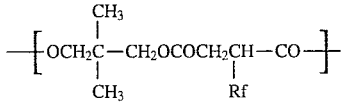

(F-28)

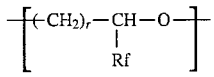

r: an integer of from 3 to 6

(F-29)

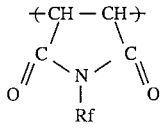

(F-30)

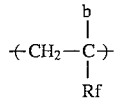

(F-31)

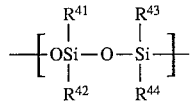

(F-32)

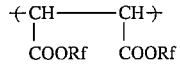

The polymer components (F) described above are preferably present as a block in the resin (P). The resin (P) may be any type of copolymer as far as it contains the fluorine atom and/or silicon atom-containing polymer components (F) as a block. The term "to be contained as a block" means that the resin (P) has a polymer segment comprising at least 50% by weight of the fluorine atom and/or silicon atom-containing polymer component based on the weight of the polymer segment. The content of polymer components (F) present in the polymer segment constituting a block is preferably 90% by weight, more preferably 100% by weight. The forms of blocks include an A-B type block, an A-B-A type block, a B-A-B type block, a graft type block, and a starlike type block as schematically illustrated below.

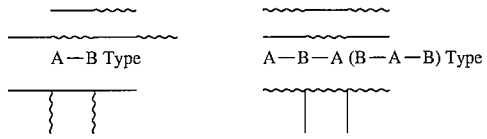

Graft Type (The number of grafts is arbitrary)

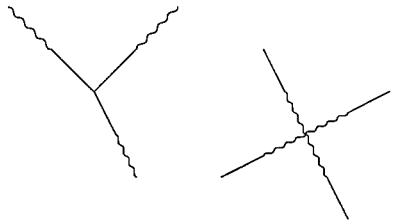

Starlike Type (The number of branches is arbitrary)

——: Segment α (containing fluorine atom and/or silicon atom)

〰: Segment β (containing no or little fluorine atom and/or silicon atom)

These various types of block copolymers of the resins (P) can be synthesized in accordance with conventionally known polymerization methods. Useful methods are described, e.g., in W. J. Burlant and A. S. Hoffman, *Block and Graft Polymers*, Reuhold (1986), R. J. Cevesa, *Block and Graft Copolymers*, Butterworths (1962), D. C. Allport and W. H. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985), For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization*, Elsevier (New York) (1987), Yoshio Okamoto, *Kobunshi*, Vol. 38, P. 912 (1989), Mitsuo Sawamoto, *Kobunshi*, Vol. 38, p. 1018 (1989), Tadashi Narita, *Kobunshi*, Vol. 37, p. 252 (1988), B. C. Anderson, et al., *Macromolecules*, Vol. 14, p. 1601 (1981), and S. Aoshima and T. Higashimura, *Macromolecules*, Vol. 22, p. 1009 (1989).

Ion polymerization reactions using a hydrogen iodide/iodine system are described, for example, in T. Higashimura, et al., *Macromol. Chem., Macromol. Symp.*, Vol. 13/14, p. 457 (1988), and Toshinobu Higashimura and Mitsuo Sawamoto, *Kobunshi Ronbunshu*, Vol. 46, p. 189 (1989).

Group transfer polymerization reactions are described, for example, in D. Y. Sogah, et al., *Macromolecules*, Vol. 20, p. 1473 (1987), O. W. Webster and D. Y. Sogah, *Kobunshi*, Vol. 36, p. 808 (1987), M. T. Reetg, et al., *Angew. Chem. Int. Ed. Engl.*, Vol. 25, p. 9108 (1986), and JP-A-63-97609.

Living polymerization reactions using a metalloporphyrin complex are described, for example, in T. Yasuda, T. Aida, and S. Inoue, *Macromolecules*, Vol. 17, p. 2217 (1984), M. Kuroki, T. Aida, and S. Inoue, *J. Am. Chem. Soc.*, Vol. 109, p. 4737 (1987), M. Kuroki, et al., *Macromolecules*, Vol. 21, p. 3115 (1988), and M. Kuroki and I. Inoue, *Yuki Gosei Kagaku*, Vol. 47, p. 1017 (1989).

Ring-opening polymerization reactions of cyclic compounds are described, for example, in S. Kobayashi and T. Saegusa, *Ring Opening Polymerization*, Applied Science Publishers Ltd. (1984), W. Seeliger, et al., *Angew. Chem. Int. Ed. Engl.*, Vol. 5, p. 875 (1966), S. Kobayashi, et al., *Poly. Bull.*, Vol. 13, p. 447 (1985), and Y. Chujo, et al., *Macromolecules*, Vol. 22, p. 1074 (1989).

Photo living polymerization reactions using a dithiocarbamate compound or a xanthate compound, as an initiator are described, for example, in Takayuki Otsu, *Kobunshi*, Vol. 37, p. 248 (1988), Shun-ichi Himori and Koichi Otsu, *Polymer Rep. Jap.*, Vol. 37, p. 3508 (1988), JP-A-64-111, JP-A-64-26619, and M. Niwa, *Macromolecules, Vol.* 189, p. 2187 (1988).

Radical polymerization reactions using a polymer containing an azo group or a peroxide group as an initiator to synthesize block copolymers are described, for example, in Akira Ueda, et al., *Kobunshi Ronbunshu*, Vol. 33, p. 931 (1976), Akira Ueda, *Osaka Shiritsu Kogyo Kenkyusho Hokoku*, Vol. 84 (1989), I. Nuyken, et al., *Macromol. Chem., Rapid. Commun.*, Vol. 9, p. 671 (1988), and Ryohei Oda, *Kagaku to Kogyo*, Vol. 61, p. 43 (1987).

Syntheses of graft type block copolymers are described in the above-cited literature references and, in addition, Fumio Ide, *Graft Jugo to Sono Oyo*, Kobunshi Kankokai (1977), and Kobunshi Gakkai (ed.), *Polymer Alloy*, Tokyo Kagaku Dojin (1981). For example, known grafting techniques including a method of grafting of a polymer chain by a polymerization initiator, an actinic ray (e.g., radiant ray, electron beam), or a mechanochemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.*, Vol. 13, p. 2447 (1969), W. H. Buck, *Rubber Chemistry and Technology*, Vol. 50, p. 109 (1976), Tsuyoshi Endo and Tsutomu Uezawa, *Nippon Secchaku Kyokaishi*, Vol. 24, p. 323 (1988), and Tsuyoshi Endo, ibid., Vol. 25, p. 409 (1989).

The methods of grafting using a macromonomer are described, for example, in P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Poly. Sci.*, Vol. 285, p. 95 (1984), R. Asami and M. Takari, *Macromol. Chem. Suppl.*, Vol. 12, p. 163 (1985), P. Rempp, et al., *Macromol. Chem. Suppl.*, Vol. 8, p. 3 (1985), Katsusuke Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, p. 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Takashiro Azuma and Takashi Tsuda, *Kino Zairyo*, Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei*, Ch. 4, C.M.C. (1991), and Y. Yamashita, et al., *Polym. Bull.*, Vol. 5, p. 361 (1981).

Syntheses of starlike block copolymers are described, for example, in M. T. Reetz, *Angew. Chem. Int. Ed. Engl.*, Vol. 27, p. 1373 (1988), M. Sgwarc, *Carbanions, Living Polymers and Electron Transfer Processes*, Wiley (New York) (1968), B. Gordon, et al., *Polym. Bull.*, Vol. 11, p. 349 (1984), R. B. Bates, et al., *J. Org. Chem.*, Vol. 44, p. 3800 (1979), Y. Sogah, *A.C.S. Polym. Rapr.*, Vol. 1988, No. 2, p. 3, J. W. Mays, *Polym. Bull.*, Vol. 23, p. 247 (1990), I. M. Khan et al., *Macromolecules*, Vol. 21, p. 2684 (1988), A. Morikawa, *Macromolecules*, Vol. 24, p. 3469 (1991), Akira Ueda and Toru Nagai, Kobunshi, Vol. 39, p. 202 (1990), and T. Otsu, *Polymer Bull.*, Vol. 11, p. 135 (1984).

While reference can be made to known techniques described in the literatures cited above, the method for synthesizing the block copolymers of the resins (P) according to the present invention is not limited to these methods.

Of the resins (P) and resin grains (L) each containing silicon atom and/or fluorine atom used in the uppermost layer of the electrophotographic light-sensitive element according to the present invention, the so-called surface-localized type copolymers will be described in detail below.

The content of the silicon atom and/or fluorine atom-containing polymer component (F) in the segment ($\alpha$) is at least 50% by weight, preferably at least 70% by weight, and more preferably at least 80% by weight. The content of the fluorine atom and/or silicon atom-containing polymer component (F) in the segment ($\beta$) bonded to the segment ($\alpha$) is not more than 20% by weight, and preferably 0% by weight.

A weight ratio of segment ($\alpha$) to segment ($\beta$) ranges usually from 1/99 to 95/5, and preferably from 5/95 to 90/10. If the weight ratio is out of this range, the migration effect and anchor effect of the resin (P) or resin grain (L) at the surface region of light-sensitive element are decreased.

The resin (P) preferably has a weight average molecular weight of from $5\times10^3$ to $1\times10^6$ and more preferably from $1\times10^4$ to $5\times10^5$. The segment ($\alpha$) in the resin (P) preferably has a weight average molecular weight of at least $1\times10^3$.

The resin grain (L) preferably has an average grain diameter of from 0.001 to 1 μm, and more preferably from 0.05 to 0.5 μm.

A preferred embodiment of the resin grain (L) according to the present invention will be described below. As described above, the resin grain (L) preferably comprises the fluorine atom and/or silicon atom-containing polymer segment ($\alpha$) insoluble in a non-aqueous solvent and the polymer segment ($\beta$) which is soluble in a non-aqueous solvent and contains substantially no fluorine atom and/or silicon atom.

The polymer segment (α) constituting the insoluble portion of the resin grain may have a crosslinked structure.

A preferred method for synthesizing the resin grain (L) includes a dispersion polymerization method in a non-aqueous solvent system described below.

The non-aqueous solvents which can be used in the preparation of non-aqueous solvent-dispersed resin grains include any organic solvents having a boiling point of not more than 200° C., either individually or in combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

Dispersion polymerization in such a non-aqueous solvent system easily results in the production of monodispersed resin grains having an average grain diameter of not greater than 1 μm with a very narrow size distribution.

More specifically, a monomer corresponding to the polymer component constituting the segment (α) (hereinafter referred to as a monomer (a)) and a monomer corresponding to the polymer component constituting the segment (β) (hereinafter referred to as a monomer (b)) are polymerized by heating in a non-aqueous solvent capable of dissolving a monomer (a) but incapable of dissolving the resulting polymer in the presence of a polymerization initiator, for example, a peroxide (e.g., benzoyl peroxide or lauroyl peroxide), an azobis compound (e.g., azobisisobutyronitrile or azobisisovaleronitrile), or an organometallic compound (e.g., butyl lithium). Alternatively, a monomer (a) and a polymer comprising the segment (β) (hereinafter referred to as a polymer (Pβ)) are polymerized in the same manner as described above.

The inside of the resin grain (L) according to the present invention may have a crosslinked structure. The formation of crosslinked structure can be conducted by any of conventionally known techniques. For example, (i) a method wherein a polymer containing the polymer segment (α) is crosslinked in the presence of a crosslinking agent or a curing agent; (ii) a method wherein at least the monomer (a) corresponding to the polymer segment (α) is polymerized in the presence of a polyfunctional monomer or oligomer containing at least two polymerizable functional groups to form a network structure over molecules; or (iii) a method wherein the polymer segment (α) and a polymer containing a reactive group-containing polymer component are subjected to a polymerization reaction or a polymer reaction to cause crosslinking may be employed.

The crosslinking agents to be used in the method (i) include those commonly employed as described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kiso-hen*), Baifukan (1986).

Specific examples of suitable crosslinking agents include organosilane compounds (such as those known as silane coupling agents, e.g., vinyltrimethoxysilane, vinyltributoxysilane, γ-glycidoxypropyltrimethoxysilane, γ-mercaptopropyltriethoxysilane, and γ-aminopropyltriethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltristearoyl titanate), aluminum coupling compounds (e.g., aluminum burylate, aluminum acetylacetate, aluminum oxide octate, and aluminum trisacetylacetate), polyepoxy-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples of the polymerizable functional groups which are contained in the polyfunctional monomer or oligomer (the monomer will sometimes be referred to as a polyfunctional monomer (d)) having two or more polymerizable functional groups used in the method (ii) above include $CH_2{=}CH{-}CH_2{-}$, $CH_2{=}CH{-}CO{-}O{-}$, $CH_2{=}CH{-}$, $CH_2{=}C(CH_3){-}CO{-}O{-}$, $CH(CH_3){=}CH{-}CO{-}O{-}$, $CH_2{=}CH{-}CONH{-}$, $CH_2$50 $C(CH_3){-}CONH{-}$, $CH(CH_3){=}CH{-}CONH{-}$, $CH_2{=}CH{-}O{-}CO{-}$, $CH_2{=}C(CH_3){-}O{-}CO{-}$, $CH_2{=}CH{-}CH_2{-}O{-}CO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O$, and $CH_2{=}CH{-}S{-}$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers or allyl ethers of polyhydric alcohols (e.g., ethylene glycol, diethylene glycol, triethylene glycol, polyethylene glycol 200, 400 or 600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and iraconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl-containing carboxylic acids.

The monomer or oligomer containing two or more polymerizable functional groups is used in an amount of not more than 10 mol %, and preferably not more than 5 mol %, based on the total amount of monomer (a) and other monomers copolymerizable with monomer (a) to form the resin.

Where crosslinking between polymer molecules is conducted by the formation of chemical bonds upon the reaction of reactive groups in the polymers according to the method (iii), the reaction may be effected in the same manner as usual reactions of organic low-molecular weight compounds.

From the standpoint of obtaining mono-dispersed resin grains having a narrow size distribution and easily obtaining fine resin grains having a diameter of 0.5 μm or smaller, the method (ii) using a polyfunctional monomer is preferred for the formation of network structure. Specifically, a monomer (a), a monomer (b) and/or a polymer (Pβ) and, in addition, a polyfunctional monomer (d) are subjected to polymerization granulation reaction to obtain resin grains. Where the above-described polymer (Pβ) comprising the segment (β) is used, it is preferable to use a polymer (Pβ) which has a polymerizable double bond group copolymerizable with the monomer (a) in the side chain or at one terminal of the main chain of the polymer (Pβ').

The polymerizable double bond group is not particularly limited as far as it is copolymerizable with the monomer (a). Specific examples thereof include $$CH_2{=}\overset{\overset{\displaystyle Q}{|}}{C}{-}COO{-},$$

$$C(CH_3)H{=}CH{-}COO{-},$$

$$CH_2{=}C(CH_2COOH){-}COO{-},$$

$$CH_2{=}\overset{\overset{\displaystyle Q}{|}}{C}{-}CONH{-},$$

$$CH_2{=}\overset{\overset{\displaystyle Q}{|}}{C}{-}CONHCOO{-},$$

$$CH_2{=}\overset{\overset{\displaystyle Q}{|}}{C}{-}CONHCONH{-},$$

$$C(CH_3)H{=}CH{-}CONH{-},$$

$$CH_2{=}CHCO{-},$$

$$CH_2{=}CH(CH_2)_g{-}OCO{-},$$

$$CH_2{=}CHO{-}, \text{ and}$$

$$CH_2{=}CH{-}C_6H_4{-},$$

wherein Q represents —H or —$CH_3$, and g represents 0 or an integer of from 1 to 3.

The polymerizable double bond group may be bonded to the polymer chain either directly or via a divalent organic residue. Specific examples of these polymers include those described, for example, in JP-A-61-43757, JP-A-1-257969, JP-A-2-74956, JP-A-1-282566, JP-A-2-173667, JP-A-3-15862, and JP-A-4-70669.

In the preparation of resin grains, the total amount of the polymerizable compounds used is from about 5 to about 80 parts by weight, preferably from 10 to 50 parts by weight, per 100 parts by weight of the non-aqueous solvent. The polymerization initiator is usually used in an amount of from 0.1 to 5% by weight based on the total amount of the polymerizable compounds. The polymerization is carried out at a temperature of from about 30° to about 180° C., and preferably from 40° to 120° C. The reaction time is preferably from 1 to 15 hours.

Now, an embodiment in which the resin (P) contains a photo- and/or heat-curable group or the resin (P) is used in combination with a photo- and/or heat-curable resin will be described below.

The polymer components containing at least one photo- and/or heat-curable group, which may be incorporated into the resin (P), include those described in the above-cited literature references. More specifically, the polymer components containing the above-described polymerizable functional group(s) can be used.

The content of the polymer component containing at least one photo- and/or heat-curable group ranges preferably from 1 to 95 parts by weight, more preferably from 10 to 70 parts by weight, based on 100 parts by weight of the polymer segment (β) in the block copolymer (P). Also, the polymer component is preferably contained in the range of from 5 to 40 parts by weight per 100 parts by weight of the total polymer components in the resin (P).

If the content is too small, curing of the photoconductive layer after film formation does not proceed sufficiently, sometimes resulting in insufficient maintenance of the interface between the photoconductive layer and the transfer layer formed thereon, and thus giving adverse influences on the peeling off of the transfer layer. If the content is too large, the electrophotographic characteristics of the photoconductive layer may be deteriorated sometimes, resulting in reduction in reproducibility of original in duplicated image and occurrence of background fog in non-image areas.

The photo- and/or heat-curable group-containing the resin (P) is preferably used in an amount of not more than 40% by weight based on the total binder resin. If the proportion of the resin (P) is too high, the electrophotographic characteristics of the light-sensitive element tend to be deteriorated.

The fluorine atom and/or silicon atom-containing resin may also be used in combination with a photo- and/or heat-curable resin (D) in the present invention.

Any of conventionally known curable resins may be used as the photo- and/or heat-curable resin (D). For example, resins containing the curable group as described with respect to the block copolymer (P) may be used.

Further, conventionally known binder resins for an electrophotographic light-sensitive layer are employed. These resins will be described in detail as binder resins used in the photoconductive layer hereinafter.

As described above, while the uppermost layer of light-sensitive element, for example, the overcoat layer or the photoconductive layer contains the silicon atom and/or fluorine atom-containing resin and, if desired, other binder resins, it is preferred that the layer further contains a small amount of photo- and/or heat-curable resin (D) and/or a crosslinking agent for further improving film curability.

The amount of photo- and/or heat-curable resin (D) and/or crosslinking agent to be added is from 0.01 to 20% by weight, and preferably from 0.1 to 15% by weight, based on the total amount of the whole resin. If the amount is less than 0.01% by weight, the effect of improving film curability decreases. If it exceeds 20% by weight, the electrophotographic characteristics may be adversely affected.

A combined use of a crosslinking agent is preferable. Any of ordinarily employed crosslinking agents may be utilized. Suitable crosslinking agents are described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kiso-hen*), Baifukan (1986).

Specific examples of suitable crosslinking agents include those described hereinbefore. In addition, monomers containing a polyfunctional polymerizable group (e.g., vinyl methacrylate, acryl methacrylate, ethylene glycol diacrylate, polyethylene glycol diacrylate, divinyl succinate, divinyl adipate, diacryl succinate, 2-methylvinyl methacrylate, trimethylolpropane trimethacrylate, divinylbenzene, and pentaerythritol polyacrylate) may also be used as the crosslinking agent.

As described above, the uppermost layer of the photoconductive layer (a layer which will be in contact with the transfer layer) is preferably cured after film formation. It is preferred that the binder resin, the surface-localized type copolymer (P), the curable resin (D), and the crosslinking agent to be used in the photoconductive layer are so selected and combined that their functional groups easily undergo chemical bonding to each other.

Combinations of functional groups which easily undergo a polymer reaction are well known. Specific examples of such combinations are shown in Table A below, wherein a functional group selected from Group A can be combined with a functional group selected from Group B. However, the present invention should not be construed as being limited thereto.

TABLE A

| Group A | Group B |
|---|---|
| —COOH, —$PO_3H_2$, —OH, —SH, —$NH_2$, —NHR, —$SO_2H$ | 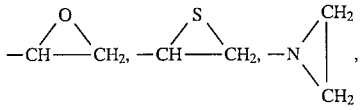 —COCl, —$SO_2Cl$, a cyclic acid anhydride group, —N=C=O, —N=C=S, 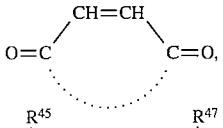 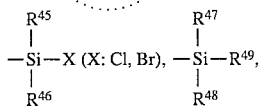 a blocked isocyanate group, |

TABLE A-continued

| Group A | Group B |
|---|---|
| | 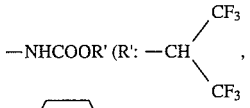 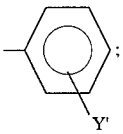 (Y': —$CH_3$, —Cl, —$OCH_3$), 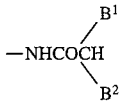 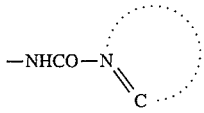 (e.g., an imidazole ring) |

In Table A, $R^{45}$ and $R^{46}$ each represents an alkyl group; $R^{47}$, $R^{48}$, and $R^{49}$ each represents an alkyl group or an alkoxy group, provided that at least one of them is an alkoxy group; R represents a hydrocarbon group; $B^1$ and $B^2$ each represents an electron attracting group, e.g., —CN, —$CF_3$, —$COR^{50}$, —$COOR^{50}$, $SO_2OR^{50}$ ($R^{50}$ represents a hydrocarbon group, e.g., —$C_nH_{2n+1}$ (n: an integer of from 1 to 4), —$CH_2C_6H_5$, or —$C_6H_5$).

If desired, a reaction accelerator may be added to the binder resin for accelerating the crosslinking reaction in the light-sensitive layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4 4'-tetracarboxylic acid dianhydride, and trimellitic anhydride).

The reaction accelerators which may be used for the crosslinking reaction involving polymerization include polymerization initiators, such as peroxides and azobis compounds.

After a coating composition for the light-sensitive layer is coated, the binder resin is preferably cured by light and/or heat. Heat curing can be carried out by drying under severer conditions than those for the production of a conventional light-sensitive element. For example, elevating the drying temperature and/or increasing the drying time may be utilized. After drying the solvent of the coating composition, the film is preferably subjected to a further heat treatment, for example, at 60° to 150° C. for 5 to 120 minutes. The conditions of the heat treatment may be made milder by using the above-described reaction accelerator in combination.

Curing of the resin containing a photocurable functional group can be carried out by incorporating a step of irradiation of actinic ray into the production line. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

Now, the second method for obtaining an electrophotographic light-sensitive element having a surface of the desired releasability will be described in detail below. According to the method, a compound (S) exhibiting the desired releasability is applied to a surface of a conventional electrophotographic light-sensitive element to cause the compound (S) to adhere to or adsorb on the surface before the formation of transfer layer, whereby the surface of light-sensitive element is provided with the desired releasability.

The compound (S) is a compound containing a fluorine atom and/or a silicon atom. The compound (S) containing a moiety having a fluorine and/or silicon atom is not particularly limited in its structure as far as it can improve releasability of the surface of electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since they adsorb on the surface of electrophotographic light-sensitive element to impart good releasability.

The fluorine and/or silicon atom-containing moieties include those described with respect to the resin (P) suitable for use in the electrophotographic light-sensitive element above.

Specific examples of the compound (S) containing a fluorine and/or silicon atom which can be used in the present invention include fluorine and/or silicon-containing organic compounds described, for example, in Tokiyuki Yoshida, et al. (ed.), *Shin-ban Kaimenkasseizai Handbook*, Kogaku Tosho (1987), Takao Karikome, *Saishin Kaimenkasseizai Oyo Gijutsu*, C.M.C. (1990), Kunio Ito (ed.), *Silicone Handbook*, Nikkan Kogyo Shinbunsha (1990), Takao Karikome, *Tokushukino Kaimenkasseizai*, C.M.C. (1986), and A. M. Schwartz, et al., *Surface Active Agents and Detertents*, Vol. II.

Further, the compound (S) according to the present invention can be synthesized by utilizing synthesis methods as described, for example, in Nobuo Ishikawa, *Fussokagobutsu no Gosei to Kino*, C.M.C. (1987), Jiro Hirano et al. (ed.), *Ganfussoyukikagobutsu-Sono Gosei to Oyo*, Gijutsu Joho Kyokai (1991), and Mitsuo Ishikawa, *Yukikeiso Senryaku Shiryo*, Chapter 3, Science Forum (1991).

Specific examples of polymer components having the fluorine atom and/or silicon atom-containing moiety used in the oligomers or polymers of compound (S) include the polymer components (F) described with respect to the resin (P) above.

Of the olygomers or polymers of compounds (S), so-called block copolymers are preferred as described above. Specifically, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The content of the polymer components present in the polymer segment constituting a block is preferably 90% by weight, more preferably 100% by weight. The forms of blocks include an A-B type block, an A-B-A type block, a B-A-B type block, a graft type block, and a starlike type block as schematically illustrated with respect to the resin (P) above. These block copolymers can be synthesized according to the methods described with respect to the resin (P) above.

By the application of compound (S) onto the surface of electrophotographic light-sensitive element, the surface is modified to have the desired releasability. The term "application of compound (S) onto the surface of electrophotographic light-sensitive element" means that the compound is supplied on the surface of electrophotographic light-sensitive element to form a state wherein the compound (S) is adsorbed or adhered thereon.

In order to apply the compound (S) to the surface of electrophotographic light-sensitive element, conventionally known various methods can be employed. For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki, *Coating Hoshiki*, Maki Shoten (1979), and Hiroshi Fukada, *Hot-melt Secchaku no Jissai* Kobunshi Kankokai (1979) can be used.

A method wherein cloth, paper or felt impregnated with the compound (S) is brought into close contact with the surface of light-sensitive element, a method of pressing a curable resin impregnated with the compound (S), a method wherein the light-sensitive element is wetted with a non-aqueous solvent containing the compound (S) dissolved therein, and then dried to remove the solvent, and a method of migrating the compound (S) dispersed in a non-aqueous solvent to cause the compound (S) to adhere to the surface of light-sensitive element by electrophoresis according to the wet-type electrodeposition method as described above can also be employed.

Further, the compound (S) can be applied on the surface of light-sensitive element by utilizing a non-aqueous solvent containing the compound (S) according to an ink jet method, followed by drying. The ink jet method can be performed with reference to the descriptions in Shin Ohno (ed.), *Non-impact Printing*, C.M.C. (1986). More specifically, a Sweet process or Hartz process of a continuous jet type, a Winston process of an intermittent jet type, a pulse jet process of an ink on-demand type, a bubble jet process, and a mist process of an ink mist type are illustrated. In any system, the compound (S) itself or diluted with a solvent is filled in an ink tank or ink head cartridge in place of an ink to use. The solution of compound (S) used ordinarily has a viscosity of from 1 to 10 cp and a surface tension of from 30 to 60 dyne/cm, and may contain a surface active agent, or may be heated, if desired. Although a diameter of ink droplet is in a range of from 30 to 100 μm due to a diameter of an orifice of head in a conventional ink jet printer in order to reproduce fine letters, droplets of a larger diameter can also be used in the present invention. In such a case, an amount of jet of the compound (S) becomes large and thus a time necessary for the application can be shortened. Further, to use multiple nozzles is very effective to shorten the time for application.

When silicone rubber is used as the compound (S), it is preferred that silicone rubber is provided on a metal axis to cover and the resulting silicone rubber roller is directly pressed on the surface of electrophotographic light-sensitive element. In such a case, a nip pressure is ordinarily in a range of from 0.5 to 10 Kgf/cm$^2$ and a time for contact is ordinarily in a range of from 1 second to 30 minutes. Also, the light-sensitive element and/or silicone rubber roller may be heated up to a temperature of 150° C. According to this method, it is believed that a part of low molecular weight components contained in silicone rubber is moved from the silicone rubber roller onto the surface of light-sensitive element during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controlled using a heat medium, if desired.

The application of compound (S) is preferably performed by a means which is easily incorporated into an electrophotographic apparatus used in the present invention.

An amount of the compound (S) applied to the surface of electrophotographic light-sensitive element is adjusted in a range wherein the electrophotographic characteristics of light-sensitive element do not adversely affected in substance. Ordinarily, a thickness of the coating is sufficiently 1 μm or less. By the formation of weak boundary layer as defined in Bikerman, *The Science of Adhesive Joints*, Academic Press (1961), the releasability-imparting effect of the present invention can be obtained. Specifically, when an adhesive strength of the surface of electrophotographic light-sensitive element to which the compound (S) has been applied is measured according to JIS Z 0237-1980 "Testing methods of pressure sensitive adhesive tapes and sheets" described above, the resulting adhesive strength is preferably not more than 100 gram.force.

In accordance with the method described above, the surface of electrophotographic light-sensitive element is provided with the desired releasability by the application of compound (S), and the light-sensitive element can be repeatedly employed as far as the releasability is maintained. Specifically, the application of compound (S) is not always necessarily whenever a series of steps comprising the formation of transfer layer, formation of toner image, and transfer of the toner image together with the transfer layer onto a receiving material is repeated.

The third method for obtaining an electrophotographic light-sensitive element having a surface of the desired releasability comprises conducting a wet-type electrodeposition method using a dispersion of resin grains (AL) for forming a transfer layer, to which a compound (S') exhibiting the desired releasability is added. According to the method, the dispersion for electrodeposition containing the compound (S') is subjected to electrodeposition on a conventionally known electrophotographic light-sensitive element, thereby providing the releasability on the surface of light-sensitive element as well as the formation of transfer layer.

More specifically, the dispersion for electrodeposition used comprises an electrically insulating organic solvent having a dielectric constant of not more than 3.5, the resin grains (AL) dispersed therein and the compound (S') exhibiting the desired releasability.

The compound (S') present in the dispersion for electrodeposition is able to adhere to or adsorb on the surface of light-sensitive element before the electrodeposition of resin grains (AL) on the surface of the light-sensitive element by electrophoresis and as a result, the light-sensitive element having the surface of desired releasability is obtained before the formation of transfer layer.

The compounds (S') used are same as the compound (S) described in the second method above in substance. Of the compound (S'), those soluble at least 0.05 g per one liter of an electrically insulating organic solvent used in the dispersion for electrodeposition at 25° C. are preferred, and those soluble 0.1 g or more per one liter of the solvent are more preferred.

The amount of compound (S') added to the dispersion for electrodeposition may by varied depending on the compound (S') and the electrically insulating organic solvent to be used. A suitable amount of the compound (S') is determined taking the effect to be obtained and adverse affects on electrophoresis of resin grains (e.g., decrease in electric resistance or increase in viscosity of the dispersion) into consideration. A preferred range of the compound (S) added is ordinarily from 0.05 to 20 g pen one liter of the electrically insulating organic solvent used.

The construction and material used for the electrophotographic light-sensitive element according to the present invention are not particularly limited and any of those conventionally known can be employed.

Suitable examples of electrophotographic light-sensitive element used are described, for example, in R. M. Schaffert, *Electrophotography*, Forcal Press, London (1980), S. W. Ing, M. D. Tabak and W. E. Haas, *Electrophotography Fourth International Conference*, SPSE (1983), Isao Shinohara, Hidetoshi Tsuchida and Hideaki Kusakawa (ed.), *Kirokuzairyo to Kankoseijushi*, Gakkai Shuppan Center (1979), Hiroshi Kokado, *Kagaku to Kogyo*, Vol. 39, No. 3, p. 161 (1986), *Saikin no Kododen Zairyo to Kankotai no Kaihatsu.Jitsuyoka*, Nippon Kagaku Joho Shuppanbu (1986), Denshishashin Gakkai (ed.), *Denshishashin no Kiso to Oyo*, Corona (1986), and Denshishashin Gakkai (ed.), *Denshishashinyo Yukikankotai no Genjo Symposium* (preprint), (1985).

A photoconductive layer for the electrophotographic light-sensitive element which can be used includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known for example, amorphous silicon, zinc oxide, titanium oxide, zinc sulfide, cadmium sulfide, selenium, selenium-tellurium, and lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; (ii) a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and (iii) a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described structure.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e. g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styrylanthracene derivatives described, e.g., in JP-A-56-46234, (l) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43- 19193, (s) condensed resins, such as pyrene-formaldehyde resin, bromopyrene-formaldehyde resin, and ethylcarbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer include those conventionally known as described, e.g., in *Denshishashin*, Vol. 12, p. 9 (1973) and *Yuki Gosei Kagaku*, Vol. 24, No. 11, p. 1010 (1966). Specific examples of suitable sensitizing dyes include pyrylium dyes described, e.g., in U.S. Pat. Nos. 3,141,770 and 4,283,475, JP-A-48-25658, and JP-A-62-71965; triarylmethane dyes described, e.g., in *Applied Optics Supplement*, Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer include various conventionally known charge generating agents, either organic or inorganic, such as selenium, selenium-tellurium, cadmium sulfide, zinc oxide, and organic pigments, for example, (1) azo pigments (including monoazo, bisazo, and trisazo pigments) described, e.g., in U.S. Pat, Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542.

These charge generating agents may be used either individually or in combination of two or more thereof.

The charge transporting agents used in the photoconductive layer include those described for the organic photoconductive compounds above.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

Binder resins other than the specific resins described hereinbefore (hereinafter referred to as binder resin (B) sometimes) which can be used in the light-sensitive element according to the present invention include those for conventionally known electrophotographic light-sensitive elements. A weight average molecular weight of the binder resin is preferably from $5\times10^3$ to $1\times10^6$, and more preferably from $2\times10^4$ to $5\times10^5$. A glass transition point of the binder resin is preferably from −40° to 200° C., and more preferably from −10° to 140° C.

Conventional binder resins for electrophotographic light-sensitive elements which may be used in the present invention are described, e.g., in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kioku Zairyoyo Binder no Jissai Gijutsu*, Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu.Jitsuyoka*, Nippon Kagaku Joho (1986), Denshishashin Gakkai (ed.), *Denshishashin Gijutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

More specifically, reference can be made to Tsuyoshi Endo, *Netsukokasei Kobunshi no Seimitsuka*, C.M.C. (1986), Yuji Harasaki, *Saishin Binder Gijutsu Binran*, Ch. II-1, Sogo Gijutsu Center (1985), Takayuki Otsu, *Acryl Jushi no Gosei.Sekkei to Shinyoto Kaihatsu*, Chubu Kei-ei Kaihatsu Center Shuppanbu (1985), and Eizo Omori, *Kinosei Acryl-Kei Jushi*, Techno System (1985).

Further, the electrostatic characteristics of the photoconductive layer are improved by using, as a binder resin (B) for photoconductive substance, a resin having a relatively low molecular weight (e.g., a weight average molecular weight of from $10^3$ to $10^4$) and containing an acidic group such as a carboxy group, a sulfo group or a phosphono group. For instance, JP-A-63-217354 discloses a resin having polymer components containing an acidic group at random in the polymer main chain, JP-A-64-70761 discloses a resin having an acidic group bonded at one terminal of the polymer main chain, JP-A-2-67563, JP-A-2-236561, JP-A-2-238458, JP-A-2-236562 and JP-A-2-247656 disclose a resin of graft type copolymer having an acidic group bonded at one terminal of the polymer main chain or a resin of graft type copolymer containing acidic groups in the graft portion, and JP-A-3-181948 discloses an AB block copolymer containing acidic groups as a block.

Moreover, in order to obtain a satisfactorily high mechanical strength of the photoconductive layer which may be insufficient by only using the low molecular weight resin, a medium to high molecular weight resin is preferably used together with the low molecular weight resin. For instance, JP-A-2-68561 discloses a thermosetting resin capable of forming crosslinked structures between polymers, JP-A-2-68562 discloses a resin partially having crosslinked structures, and JP-A-2-69759 discloses a resin of graft type copolymer having an acidic group bonded at one terminal of the polymer main chain. Also, in order to maintain the relatively stable performance even when ambient conditions are widely fluctuated, a specific medium to high molecular weight resin is employed in combination. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Moreover, JP-A-3-206464 and JP-A-3-223762 discloses a medium to high molecular weight resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Also, excellent electrostatic characteristics can be maintained even when ambient conditions are fluctuated or when a scanning exposure system using a semiconductor laser beam is utilized for the image exposure.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds*. Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, No. 216, pp. 117–118 (1982).

The light-sensitive element of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu.Jitsuyoka*, Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

According to the present invention, to an electrophotographic light-sensitive element having a surface of the releasability is applied by an electrodeposition coating method the resin grains (AL) each containing at least two resins having glass transition points different from each other as described above to form a transfer layer and then, a toner image is formed on the transfer layer through a conventional electrophotographic process.

Specifically, each step of the electrophotographic process, i.e., charging, light exposure, development and fixing is performed in a conventionally known manner. The electrophotographic process and the formation of transfer layer may be conducted in the same apparatus or in different apparatus.

In order to form the toner image by an electrophotographic process according to the present invention, any methods and apparatus conventionally known can be employed.

The developers which can be used in the present invention include conventionally known developers for electrostatic photography, either dry type or liquid type. For example, specific examples of the developer are described in *Denshishashin Gijutsu no Kiso to Oyo*, supra, pp. 497–505, Koichi Nakamura (ed.), *Toner Zairyo no Kaihatsu.Jitsuyoka*, Ch. 3, Nippon Kagaku Joho (1985), Gen Machida, *Kirokuyo Zairyo to Kankosei Jushi*, pp. 107–127 (1983), and Denshishashin Gakkai (ed.), *Imaging*, Nos. 2–5, "Denshishashin no Genzo.Teichaku.Taiden.Tensha", Gakkai Shuppan Center.

Dry developers practically used include one-component magnetic toners, two-component toners, one-component non-magnetic toners, and capsule toners. Any of these dry developers may be employed in the present invention.

The typical liquid developer is basically composed of an electrically insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic pigment or dye) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density may be insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

Particularly, a combination of a scanning exposure system using a laser beam based on digital information and a development system using a liquid developer is an advantageous process in order to form highly accurate images.

One specific example of the methods for preparing toner image is illustrated below. An electrophotographic light-sensitive material is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo*, p. 212 et seq., Corona Sha (1988). A corotron or scotron system is usually used for the charging process. In a preferred charging process, the charging conditions may be controlled by a feedback system of the information on charged potential from a detector connected to the light-sensitive material thereby to control the surface potential within a predetermined range.

Thereafter, the charged light-sensitive material is exposed to light by scanning with a laser beam in accordance with the system described, for example, in ibidem, p. 254 et seq.

Toner development is then conducted using a liquid developer. The light-sensitive material charged and exposed is removed from the flat bed and developed according to the direct wet type developing method as described, for example, in ibidem, p. 275 et seq. The exposure mode is determined in accord with the toner image development mode. Specifically, in case of reversal development, a negative image is irradiated with a laser beam, and a toner having the same charge polarity as that of the charged light-sensitive material is electrodeposited on the exposed area with a bias voltage applied. For the details, reference can be made to ibidem, p. 157 et seq.

After the toner development, the light-sensitive material is squeezed to remove the excess developer as described in ibidem, p. 283 and dried. Preferably, the light-sensitive material may be rinsed with a carrier liquid alone used in the liquid developer before squeezing.

The heat-transfer of the toner image together with the transfer layer onto a receiving material can be performed using known methods and apparatus. The heat-transfer of transfer layer onto a receiving material may be conducted in the same apparatus wherein the transfer layer-forming step and electrophotographic step are carried out, or in a different apparatus from ones used for these steps.

For example, the transfer layer is easily heat-transferred together with toner image onto a receiving material by passing the light-sensitive material bearing toner image thereon and the transfer layer brought into contact with each other between a pair of metal rollers covered with rubber each containing therein a heating means which are driven with a predetermined nip pressure applied. The surface temperature of rollers is preferably in a range of from 30° to 150° C., and more preferably from 40° to 120° C., the nip pressure between rollers is preferably in a range of from 0.2 to 20 kgf/cm$^2$, and more preferably from 0.5 to 10 kgf/cm$^2$, and the transportation speed is preferably in a range of from 0.1 to 300 mm/sec, and more preferably from 50 to 200 mm/sec. As a matter of course, these conditions should be optimized according to the physical properties of the transfer layer and light-sensitive element of the light-sensitive material and the receiving material each employed.

The temperature of roller surface is preferably maintained within a predetermined range by means of a surface temperature detective means and a temperature controller. A pre-heating means and a cooling means for the light-sensitive material may be provided in front of and at the rear of the heating roller portion, respectively. Also, as a means for pressing two rollers, a pair of springs provided at both ends of the shaft of at least one roller or an air cylinder using compressed air may be employed.

The receiving material used in the present invention is any of material which provide a hydrophilic surface suitable for lithographic printing. Supports conventionally used for offset printing plates (lithographic printing plates) can be preferably employed. Specific examples of support include a substrate having a hydrophilic surface, for example, a plastic sheet, paper having been rendered durable to printing, an aluminum plate, a zinc plate, a bimetal plate, e.g., a copper-aluminum plate, a copper-stainless steel plate, or a chromium-copper plate, a trimetal plate, e.g., a chromium-copper-aluminum plate, a chromium-lead-iron plate, or a chromium-copper-stainless steel plate. The support preferably has a thickness of from 0.1 to 3 mm, and particularly from 0.1 to 1 mm.

A support with an aluminum surface is preferably subjected to a surface treatment, for example, surface graining, immersion in an aqueous solution of sodium silicate, potassium fluorozirconate or a phosphate, or anodizing. Also, an aluminum plate subjected to surface graining and then immersion in a sodium silicate aqueous solution as described in U.S. Pat. No. 2,714,066, or an aluminum plate subjected to anodizing and then immersion in an alkali silicate aqueous solution as described in JP-B-47-5125 is preferably employed.

Anodizing of an aluminum surface can be carried out by electrolysis of an electrolytic solution comprising at least one aqueous or non-aqueous solution of an inorganic acid (e.g., phosphoric acid, chromic acid, sulfuric acid or boric acid) or an organic acid (e.g., oxalic acid or sulfamic acid) or a salt thereof to oxidize the aluminum surface as an anode.

Silicate electrodeposition as described in U.S. Pat. No. 3,658,662 or a treatment with polyvinylsulfonic acid described in West German Patent Application (OLS) 1,621,478 is also effective.

The surface treatment is conducted not only for rendering the surface of a support hydrophilic, but also for improving adhesion of the support to the transferred toner image.

Further, in order to control an adhesion property between the support and the transfer layer having provided thereon the toner image, a surface layer may be provided on the surface of the support.

A plastic sheet or paper as the support should have a hydrophilic surface layer, as a matter of course, since its areas other than those corresponding to the toner images must be hydrophilic. Specifically, a receiving material having the same performance as a known direct writing type lithographic printing plate precursor or an image-receptive layer thereof may be employed.

Now, a step of subjecting the receiving material having the transfer layer thereon (printing plate precursor) with a chemical reaction treatment to remove the transfer layer, thereby providing a printing plate will be described below. In order to remove the transfer layer, an appropriate means can be selected in consideration of a chemical reaction treatment upon which a resin used in the transfer layer is removed. For instance, treatment with a processing solution, treatment with irradiation of actinic ray or a combination thereof can be employed for removal of the transfer layer.

In order to effect the removal by a chemical reaction with a processing solution, an aqueous solution which is adjusted to the prescribed pH is used. Known pH control agents can be employed to adjust the pH of solution. While the pH of the processing solution used may be any of acidic, neutral and alkaline region, the processing solution is preferably employed in an alkaline region having a pH of 8 or higher taking account of an anticorrosive property and a property of dissolving the transfer layer. The alkaline processing solution can be prepared by using any of conventionally known organic or inorganic compounds, such as carbonates, sodium hydroxide, potassium hydroxide, potassium silicate, sodium silicate, and organic amine compounds, either individually or in combination thereof.

The processing solution may contain a hydrophilic compound which contains a substituent having a Pearson's nucleophilic constant n (refer to R. G. Pearson and H. Sobel, *J. Amer. Chem. Soc.*, Vol. 90, p. 319 (1968)) of not less than 5.5 and has a solubility of at least 1 part by weight per 100 parts by weight of distilled water, in order to accelerate the reaction for rendering hydrophilic.

Suitable examples of such hydrophilic compounds include hydrazines, hydroxylamines, sulfites (e.g., ammonium sulfite, sodium sulfite, potassium sulfite or zinc sulfite), thiosulfates, and mercapto compounds, hydrazide compounds, sulfinic acid compounds and primary or secondary amine compounds each containing at least one polar group selected from a hydroxyl group, a carboxyl group, a sulfo group, a phosphono group and an amino group in the molecule thereof.

Specific examples of the polar group-containing mercapto compounds include 2-mercaptoethanol, 2-mercaptoethylamine, N-methyl-2-mercaptoethylamine, N-(2-hydroxyethyl)-2-mercaptoethylamine, thioglycolic acid, thiomalic acid, thiosalicylic acid, mercaptobenzenecarboxylic acid, 2-mercaptotoluensulfonic acid, 2-mercaptoethylphosphonic acid, mercaptobenzenesulfonic acid, 2-mercaptopropionylaminoacetic acid, 2-mercapto-1-aminoacetic acid, 1-mercaptopropionylaminoacetic acid, 1,2-dimercaptopropionylaminoacetic acid, 2,3-dihydroxypropylmercaptan, and 2-methyl-2-mercapto-1-aminoacetic acid. Specific examples of the polar group-containing sulfinic acid compounds include 2-hydroxyethylsulfinic acid, 3-hydroxypropanesulfinic acid, 4-hydroxybutanejsulfinic acid, carboxybenzenesulfinic acid, and dicarboxybenzenesulfinic acid. Specific examples of the polar group-containing hydrazide compounds include 2-hydrazinoethanolsulfonic acid, 4-hydrazinobutanesulfonic acid, hydrazinobenzenesulfonic acid, hydrazinobenzenesulfonic acid, hydrazinobenzoic acid, and hydrazinobenzenecarboxylic acid. Specific examples of the polar group-containing primary or secondary amine compounds include N-(2-hydroxyethyl)amine, N,N-di(2-hydroxyethyl)amine, N,N-di(2-hydroxyethyl)ethylenediamine, tri-(2-hydroxyethyl)ethylenediamine, N-(2,3-dihydroxypropyl)amine, N,N-di(2,3-dihydroxypropyl)amine, 2-aminopropionic acid, aminobenzoic acid, aminopyridine, aminobenzenedicarboxylic acid, 2-hydroxyethylmorpholine, 2-carboxyethylmorpholine, and 3-carboxypiperazine.

The amount of the nucleophilic compound present in the processing solution is preferably from 0.05 to 10 mol/l, and more preferably from 0.1 to 5 mol/l. The pH of the processing solution is preferably not less than 8.

The solution may contain other compounds in addition to the pH control agent and nucleophilic compound described above. For example, a water-soluble organic solvent may be used in a range of from about 1 to about 50 parts by weight per 100 parts by weight of water. Suitable examples of the water-soluble organic solvent include alcohols (e.g., methanol, ethanol, propanol, propargyl alcohol, benzyl alcohol, and phenethyl alcohol), ketones (e.g., acetone, methyl ethyl ketone, cyclohexanone and acetophenone), ethers (e.g., dioxane, trioxane, tetrahydrofuran, ethylene glycol dimethyl ether, propylene glycol diethyl ether, ethylene glycol monomethyl ether, propylene glycol monomethyl ether, and tetrahydropyran), amides (e.g., dimethylformamide, pyrrolidone, N-methylpyrrolidone, and dimethylacetamide), esters (e.g., methyl acetate, ethyl acetate, and ethyl formate), sulforan and tetramethylurea. These organic solvents may be used either individually or in combination of two or more thereof.

The processing solution may contain a surface active agent in an amount ranging from about 0.1 to about 20 parts by weight per 100 parts by weight of the processing solution. Suitable examples of the surface active agent include conventionally known anionic, cationic or nonionic surface active agents, such as the compounds as described, for example, in Hiroshi Horiguchi, *Shin Kaimen Kasseizai*, Sankyo Shuppan (1975) and Ryohei Oda and Kazuhiro Teramura, *Kaimen Kasseizai no Gosei to Sono Oyo*, Maki Shoten (1980). Moreover, conventionally known antiseptic compounds and antimoldy compounds are employed in appropriate amounts in order to improve the antiseptic property and antimoldy property of the processing solution during preservation.

With respect to the conditions of the treatment, a temperature of from about 15° to about 60° C., and an immersion time of from about 10 seconds to about 5 minutes are preferred.

The treatment with the processing solution may be combined with a physical operation, for example, application of ultrasonic wave or mechanical movement (such as rubbing with a brush).

Actinic ray which can be used for decomposition to render the transfer layer hydrophilic upon the irradiation treatment includes any of visible light, ultraviolet light, far ultraviolet light, electron beam, X-ray, $\gamma$-ray, and $\alpha$-ray, with ultraviolet light being preferred. More preferably rays having a wavelength range of from 310 to 500 nm are used. As a light source, a high-pressure or ultrahigh-pressure mercury lamp is ordinarily utilized. Usually, the irradiation treatment can be sufficiently carried out from a distance of from 5 to 50 cm for a period of from 10 seconds to 10 minutes. The thus irradiated transfer layer is then soaked in an aqueous solution whereby the transfer layer is easily removed.

The method for preparation of a printing plate by an electrophotographic process according to the present invention will be described as well as a plate making apparatus useful for carrying out the method with reference to the accompanying drawings, hereinbelow.

Figure 2:
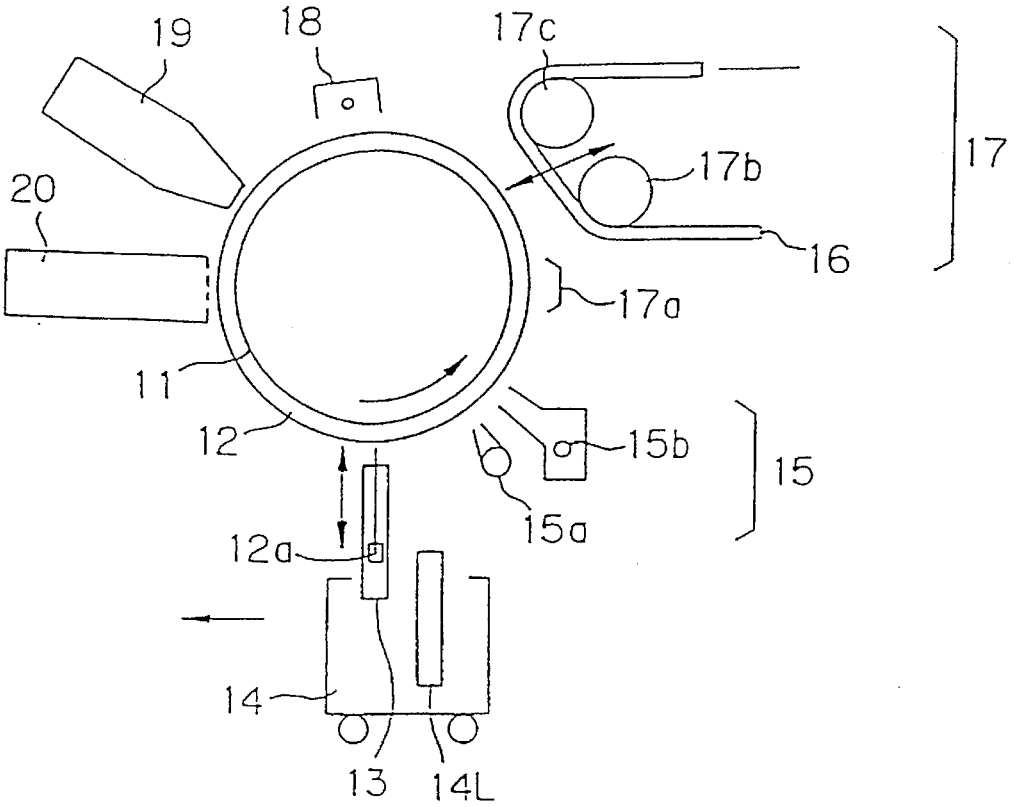
FIG. 2 is a schematic view of an electrophotographic plate making apparatus suitable for conducting the method of the present invention.

FIG. 2 is a schematic view of an electrophotographic plate making apparatus suitable for carrying out the method of the present invention. In the apparatus, the formation of transfer layer, electrophotographic process and heat transfer of transfer layer can be performed.

As described above, when an electrophotographic light-sensitive element 11 whose surface has been modified to have the desired releasability, a transfer layer 12 is formed on the light-sensitive element 11. On the other hand, when the surface of light-sensitive element 11 has insufficient releasability, a means for applying the compound (S) is provided before the formation of transfer layer 12 (in case of the second method), or the compound (S') is incorporated into a dispersion for electrodeposition containing the resin grains (AL) according to the present invention (in case of the third method), thereby the desired releasability being imparted to the surface of light-sensitive element 11. In case of the second method, the compound (S) is supplied using a device applying compound (S) 10 which utilizes any one of the embodiments described above onto the surface of light-sensitive element 11. The device applying compound (S) may be stationary or movable.

A dispersion 12*a* of thermoplastic resin grains (AL) is supplied to an electrodeposition unit 13 provided in a movable liquid developing unit set 14. The electrodeposition unit is first brought near the surface of the light-sensitive element 11 and is kept stationary with a gap of 1 mm between a development electrode of the electrodeposition unit 13 and the light-sensitive element. The light-sensitive element 11 is rotated while supplying the dispersion 12*a* of thermoplastic resin grains into the gap and applying an electric voltage across the gap from an external power source (not shown), whereby the resin grains (AL) are deposited over the entire image-forming areas of the surface of the light-sensitive element 11.

A medium of the dispersion 12*a* of thermoplastic resin grains adhered to the surface of the light-sensitive element 11 is removed by a squeezing device built in the electrodeposition unit 13, and the light-sensitive element is dried by passing under the suction/exhaust unit 15. Then the thermoplastic resin grains (AL) are fused by the pre-heating means 17*a* and thus a transfer layer 12 in the form of thermoplastic resin film is obtained.

Thereafter the transfer layer is cooled to a predetermined temperature, if desired, from an outside of the light-sensitive element or from an inside of the drum of the light-sensitive element by a cooling device which is similar to the suction/exhaust unit 15, although not shown.

After moving away the electrodeposition unit 13, the liquid developing unit set 14 is posited. The unit set 14 is provided with a liquid developing unit 14L containing a liquid developer. The developing unit may be equipped, if desired, with a pre-bathing means, a rinsing means and/or a squeeze means in order to prevent stains of the non-image portions. As the pre-bathing solution and the rinse solution, a carrier liquid for the liquid developer is generally used.

The light-sensitive element 11 bearing thereon the transfer layer 12 of the thermoplastic resin is then subjected to the electrophotographic process. Specifically, when the light-sensitive element 11 is uniformly charged to, for instance, a positive polarity by a corona charger 18 and then is exposed imagewise by an exposure device (e.g., a semi-conductor laser) 19 on the basis of image information, the potential is lowered in the exposed regions and thus, a contrast in the potential is formed between the exposed areas and the unexposed areas. The liquid developing unit 14L containing a liquid developer having a positive electrostatic charge of the liquid developing unit set 14 is brought near the surface of the light-sensitive element 11 and is kept stationary with a gap of 1 mm therebetween.

The light-sensitive material is first pre-bathed by a pre-bathing means equipped in the developing unit set, and then the liquid developer is supplied on the surface of the light-sensitive material while applying a developing bias voltage between the light-sensitive material and a development electrode by a bias voltage source and wiring (not shown). The bias voltage is applied so that it is slightly lower than the surface potential of the unexposed areas, while the development electrode is charged to positive and the light-sensitive material is charged to negative. When the bias voltage applied is too low, a sufficient density of the toner image cannot be obtained.

The liquid developer is subsequently washed off by a rinsing means of the liquid developing unit set 14 and the rinse solution adhering to the surface of the light-sensitive material is removed by a squeeze means. Then, the light-sensitive material is dried by passing under the suction/exhaust unit 15. Meanwhile a heat transfer means 17 is kept away from the surface of the light-sensitive material.

The toner image 3 thus formed on the transfer layer 12 provided on the light-sensitive element 11 is then heat-transferred onto a receiving material 16 using a heat transfer means 17. Specifically, the transfer layer 12 bearing the toner image 3 is pre-heated by a pre-heating means 17*a* and is pressed against a rubber roller 17*b* having therein a heater with a temperature control means with the receiving material 16 intervening therebetween. The transfer layer and the receiving material are then cooled by passing under a cooling roller 17*c*, thereby heat-transferring the toner image 3 to the receiving material 16 together with the transfer layer 12. Thus a cycle of steps is terminated.

The heat transfer means 17 for heating-transferring the transfer layer 12 to the receiving material 16-comprises the pre-heating means 17*a*, the heating roller 17*b* which is in the form of a metal roller having therein a heater and is covered with rubber, and the cooling roller 17*c*. As the pre-heating means 17*a*, a non-contact type heater such as an infrared line heater, a flash heater or the like is used, and the transfer layer is pre-heated in a range below a temperature of the surface of the light-sensitive material achieved with heating by the heating roller 17*b*. The surface temperature of light-sensitive material heated by the heating roller 17*b* is preferably in a range of from 30°, to 150° C., and more preferably from 40° to 120° C.

The cooling roller 17*c* comprises a metal roller which has a good thermal conductivity such as aluminum, copper or the like and is covered with silicone rubber. It is preferred that the cooling roller 17*c* is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller 17*c* is maintained within a predetermined range.

A nip pressure of the rollers is preferably in a range of from 0.2 to 20 kgf/cm$^2$ and more preferably from 0.5 to 10 kgf/cm$^2$. Although not shown, the rollers may be pressed by springs provided on opposite ends of the roller shaft or by an air cylinder using compressed air.

A speed of the transportation is suitably in a range of from 0.1 to 300 mm/sec and preferably in a range of from 50 to 200 mm/sec. The speed of transportation may differ between the electrophotographic process and the heat transfer step.

By stopping the apparatus in the state where the transfer layer has been formed, the next operation can start with the electrophotographic process. Further the transfer layer acts to protect the light-sensitive layer and prevent the properties of the light-sensitive layer from deteriorating due to environmental influence.

It is needless to say that the above-described conditions should be optimized depending on the physical properties of the transfer layer, the light-sensitive element (i.e., the light-sensitive layer and the support) and the receiving material. Especially it is important to determine the conditions of pre-heating, roller heating and cooling in the heat transfer step taking into account the factors such as glass transition point, softening temperature, flowability, tackiness, film properties and film thickness of the transfer layer. Specifically, the conditions should be set so that the tackiness of the transfer layer increases and the transfer layer is closely adhered to the receiving material when the transfer layer softened to a certain extent by the pre-heating means passes the heating roller, and so that the temperature of the transfer layer is decreased to reduce the flowability and the tackiness after the transfer layer subsequently passes the cooling roller and thus the transfer layer is peeled as a film from the surface of the light-sensitive element together with the toner thereon.

Thereafter the transfer layer on the receiving material is subjected to a chemical reaction treatment to remove the transfer layer by dissolution or swell and release thereby obtaining an offset printing plate.

In the method for preparation of a printing plate by an electrophotographic process according to the present invention, transferability of the transfer layer bearing toner image onto a receiving material is excellent and thus, good image qualities are maintained. The method can provide a printing plate excellent in image qualities, and continuously produce such printing plates in a stable manner for a long period of time. The method is also suitable for a scanning exposure system using a laser beam.

A printing plate precursor having the transfer layer transferred thereon according to the present invention is excellent in storage stability when the precursors are placed one over another and allowed to stand before removing the transfer layer.

Further, according to the present invention, the transfer layer is easily prepared on a light-sensitive element on demand in an apparatus and the light-sensitive element is repeatedly usable, thereby reducing a running cost.

The present invention is illustrated in greater detail with reference to the following examples, but the present invention is not to be construed as being limited thereto.

Synthesis Examples of Resin Grain (AL) for Transfer Layer:

SYNTHESIS EXAMPLE 1 OF RESIN GRAIN (AL)

(AL-1)

A mixed solution of 20 g of Dispersion Stabilizing Resin (Q-1) having the structure shown below, 30 g of methyl methacrylate, 55 g of methyl acrylate, 15 g of acrylic acid, 1.3 g of methyl 3-mercaptopropionate and 542 g of Isopar H was heated to a temperature of 60° C. under nitrogen gas stream while stirring. To the solution was added 0.8 g of 2,2'-azobis(isovaleronitile) (abbreviated as AIVN) as a polymerization initiator, followed by reacting for 2 hours. Twenty minutes after the addition of the polymerization initiator, the reaction mixture became white turbid, and the reaction temperature rose to 88° C. Then, 0.5 g of the above-described initiator was added to the reaction mixture, the reaction was carried out for 2 hours, and 0.3 g of the initiator was further added thereto, followed by reacting for 3 hours. After cooling, the reaction mixture was passed through a nylon cloth of 200 mesh to obtain a white dispersion which was a latex of good monodispersity with a polymerization ratio of 99% and an average grain diameter of 0.18 μm.

Dispersion Stabilizing Resin (Q-1)

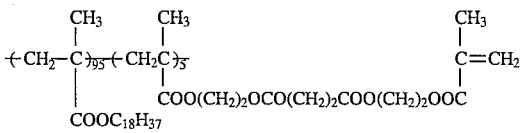

Mw (weight average molecular weight) $5\times10^4$

A mixed solution of 650 g of the above-described resin grain dispersion (as seed) and 10 g of Dispersion Stabilizing Resin (Q-1) was heated to a temperature of 60° C. under nitrogen gas stream with stirring. To the mixture was added dropwise a mixture of 85 g of benzyl methacrylate, 15 g of acrylic acid, 1.0 g of 3-mercaptopropionic acid, 0.8 g of AIVN and 200 g of Isopar H over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.25 μm.

In order to investigate that the resin grain thus-obtained was composed of the two kind of resins, the state of resin grain was observed using a scanning electron microscope.

Specifically, the dispersion of Resin Grain (AL-1) was applied to a polyethylene terephthalate film so that the resin grains were present in a dispersive state on the film, followed by heating at a temperature of 50° C. or 80° C. for 5 minutes to prepare a sample. Each sample was observed using a scanning electron microscope (JSL-T330 Type manufactured by JEOL Co., Ltd.) of 20,000 magnifications. As a result, the resin grains were observed with the sample heated at 50° C. On the contrary, with the sample heated at 80° C. the resin grains had been melted by heating and were not observed.

The state of resin grain was observed in the same manner as described above with respect to resin grains formed from respective two kind of resins (copolymers) constituting Resin Grain (AL-1), i.e., Comparative Resin Grains (1) and (2) described below and a mixture of Comparative Resin Grains (1) and (2) in a weight ratio of 1:1. As a result, it was found that with Comparative Resin Grain (1), the resin grains were not observed in the sample heated at 50° C., although the resin grains were observed in the sample before heating. On the other hand, with Comparative Resin Grain (2), the resin grains were not observed in the sample heated at 80° C. Further, with the mixture of two kind of resin grains, disappearance of the resin grains was observed in the sample heated at 50° C. in comparison with the sample before heating.

From these results it was confirmed that Resin Grain (AL-1) described above was not a mixture of two kind of resin grains but contained two kind of resins therein, and had a core/shell structure wherein the resin having a relatively high Tg formed shell portion and the resin having a relatively low Tg formed core portion.

Preparation of Comparative Resin Grain (1)

A mixed solution of 10 g of Dispersion Stabilizing Resin (Q-1) described above, 15 g of methyl methacrylate, 27.5 g of methyl acrylate, 7.5 g of acrylic acid, 0.65 g of methyl 3-mercaptopriopionate and 329 g of Isopar H was heated to a temperature of 60° C. under nitrogen gas stream while stirring. To the solution was added 0.4 g of AIVN as a polymerization initiator, followed by reacting for 2 hours. Twenty minutes after the addition of the polymerization initiator, the reaction mixture became white turbid, and the reaction temperature rose to 88° C. Then, 0.2 g of AIVN was added to the reaction mixture, the reaction were carried out for 2 hours, and 0.3 g of AIVN was added thereto, followed by reacting for 3 hours. After cooling, the reaction mixture was passed through a nylon cloth of 200 mesh to obtain a white dispersion which was a latex of good monodispersity with a polymerization ratio of 99% and an average grain diameter of 0.25 μm.

A part of the above-described dispersion was centrifuged, and the resin grains precipitated were collected and dried under a reduced pressure. A Tg of the resin grain thus-obtained was 38° C.

Preparation of Comparative Resin Grain (2)

The same procedure as in Preparation of Comparative Resin Grain (1) described above was repeated except for using a mixed solution of 10 g of Dispersion Stabilizing Resin (Q-1) described above, 42.5 g of benzyl methacrylate, 7.5 g of acrylic acid, 0.6 g of 3-mercaptopropionic acid and 326 g of Isopar H. The white dispersion thus-obtained was a latex of good monodispersity with a polymerization ratio of 98% and an average grain diameter of 0.24 μm. A Tg of the resin grain was 65° C.

SYNTHESIS EXAMPLE 2 OF RESIN GRAIN (AL)

(AL-2)

(1) Synthesis of Dispersion Stabilizing Resin (Q-2)

A mixed solution of 99.5 g of dodecyl methacrylate, 0.5 g of divinylbenzene and 200 g of toluene was heated to a temperature of 80° C. under nitrogen gas stream while stirring. To the solution was added 2 g of 2,2'-azobis(isobutyronitrile) (abbreviated as AIBN), followed by reacting for 3 hours, then further was added 0.5 g of AIBN, the reaction was carried out for 4 hours. The solid content of the resulting copolymer was 33.3% by weight, and an Mw thereof was $4\times10^4$.

(2) Synthesis of Resin Grain

A mixed solution of 18 g (solid basis) of Dispersion Stabilizing Resin (Q-2) described above, 72 g of vinyl acetate, 8 g of crotonic acid, 20 g of vinyl propionate and 382 g of Isopar H was heated to a temperature of 80° C. under nitrogen gas stream while stirring. To the solution was added 1.6 g of AIVN, followed by reacting for 1.5 hours, then was added 0.8 g of AIVN, followed by reacting for 2 hours. Further, 0.5 g of AIVN was added to the reaction mixture, the reaction were carried out for 3 hours. The temperature was raised to 100° C. and stirred for 2 hours to remove the unreacted monomers by distillation. After cooling, the reaction mixture was passed through a nylon cloth of 200 mesh to obtain a white dispersion which was a latex of good monodispersity with a polymerization ratio of 87% and an average grain diameter of 0.17 μm.

A mixture of 480 g of the above-described resin grain dispersion (as seed) and 20 g of Dispersion Stabilizing Resin (Q-2) was heated to a temperature of 60° C. under nitrogen gas stream with stirring. To the mixture was added dropwise a mixture of 50 g of methyl methacrylate, 35 g of 2-butoxyethyl methacrylate, 15 g of acrylic acid, 2.6 g of methyl 3-mercaptopropionate, 0.8 g of AIVN and 200 g of Isopar H over a period of 2 hours, followed by reacting for one hour. Then 0.8 g of AIVN was added to the reaction mixture, the temperature thereof was raised to 75° C. and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.23 μm.

SYNTHESIS EXAMPLE 3 OF RESIN GRAIN (AL)

(AL-3)

A mixed solution of 25 g of Dispersion Stabilizing Resin (Q-3) having the structure shown below and 546 g of Isopar H was heated to a temperature of 60° C. under nitrogen gas stream while stirring. To the solution was added dropwise a mixture of 50 g of benzyl methacrylate, 8 g of acrylic acid, 42 g of Monomer (b-1) having the structure shown below, 1.8 g of 2-mercaptoethanol, 1.0 of AIVN and 200 g of Isopar H over a period of one hour, followed by further reacting for one hour. To the mixture was added 0.8 g of AIVN, followed by reacting for 2 hours, then 0.5 g of AIVN was added to the reaction mixture, the temperature thereof was raised to 80° C., and the reaction was conducted for 2 hours. Further, 0.5 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.17 μm.

Dispersion Stabilizing Resin (Q-3)

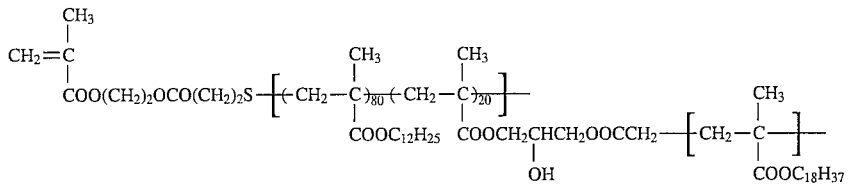

-continued

Mw: $6\times10^4$ (Mw of graft portion: $1.5\times10^4$)

Monomer (b-1)

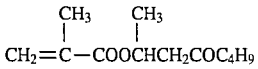

A mixture of the whole amount of the above-described resin grain dispersion (as seed) and 15 g of Dispersion Stabilizing Resin (Q-3) was heated to a temperature of 60° C. under nitrogen gas stream with stirring. To the mixture was added dropwise a mixture of 52 g of methyl methacrylate, 35 g of methyl acrylate, 13 g of acrylic acid, 2 g of 3-mercaptopropionic acid, 0.8 g of AIVN and 546 g of Isopar H over a period of 2 hours, followed by further reacting for 2 hours. Then 0.8 g of AIBN as a polymerization initiator was added to the reaction mixture, the temperature thereof was raised to 80° C., and the reaction was conducted for 2 hours. Further, 0.6 g of AIBN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.24 μm.

SYNTHESIS EXAMPLE 4 OF RESIN GRAIN (AL)

(AL-4)

A mixed solution of 25 g of Dispersion Stabilizing Resin (Q-4) having the structure shown below, 300 g of Isopar H and 100 g of ethyl acetate was heated to a temperature of 60° C. under nitrogen gas stream while stirring. To the solution was added dropwise a mixture of 8 g of 2-hydroxyethyl methacrylate, 65 g of phenethyl methacrylate, 27 g of Monomer (b-2) having the structure shown below, 1.5 g of thioglycolic acid, 0.6 g of AIVN and 199.5 g of Isopar H and 66.5 g of ethyl acetate over a period of one hour, followed by reacting for one hour. To the reaction mixture was added 0.3 g of AIVN, followed by reacting for 2 hours. Then, 0.3 g of AIVN was added thereto and the reaction was continued for 3 hours. The ethyl acetate was distilled off under a reduced pressure of 30 mm Hg and Isopar H was added thereto in an amount same as that distilled off. After cooling, the reaction mixture was passed through a nylon cloth of 200 mesh to obtain a white dispersion which was a latex of good monodispersity with a polymerization ratio of 93% and an average grain diameter of 0.20 μm.

Dispersion Stabilizing Resin (Q-4)

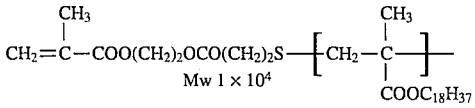

-continued

Monomer (b-2)

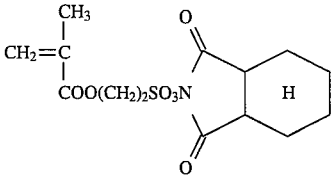

A mixture of 372 g of the above-described resin grain dispersion (as seed) and 16 g of Dispersion Stabilizing Resin (Q-1) was heated to a temperature of 75° C. under nitrogen gas stream with stirring. To the mixture was added dropwise a mixture of 70 g of vinyl acetate, 25 g of Monomer (b-3) having the structure shown below, 5 g of crotonic acid, 0.9 g of AIVN and 400 g of Isopar H over a period of 2 hours, followed by further reacting for 2 hours. Then 0.8 g of AIVN was added to the reaction mixture, the temperature thereof was raised to 85° C., and the reaction was conducted for 2 hours. Further, 0.6 g of AIBN as a polymerization initiator was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.26 μm.

Monomer (b-3)

SYNTHESIS EXAMPLES 5 TO 11 OF RESIN GRAIN (AL)

(AL-5) TO (AL-11)

Each of the resin grains (AL-5) to (AL-11) was synthesized in the same manner as in Synthesis Example 1 of Resin Grain (AL) except for using each of the monomers shown in Table B below in place of the monomers employed in Synthesis Example 1 of Resin Grain (AL). A polymerization ratio of each of the resin grains was in a range of from 95 to 99% and an average grain diameter thereof was in a range of from 0.20 to 0.30 μm with good monodispersity.

TABLE B

| Synthesis Example of Resin Grain (AL) | Resin Grain (AL) | Monomers for Seed Grain | Weight Ratio | Monomers for Shell Portion | Weight Ratio |
|---|---|---|---|---|---|
| 5 | AL-5 | Methyl methacrylate | 54 | Methyl methacrylate | 47 |
| | | Ethyl acrylate | 30 | 2-Propoxyethyl methacrylate | 40 |
| | | 2-Sulfoethyl methacrylate | 16 | Acrylic acid | 13 |
| 6 | AL-6 | Methyl methacrylate | 37 | Vinyl acetate | 80 |
| | | Methyl acrylate | 45 | Acrolein | 20 |
| | | 2-Carboxyethyl acrylate | 18 | | |

TABLE B-continued

| Synthesis Example of Resin Grain (AL) | Resin Grain (AL) | Monomers for Seed Grain | Weight Ratio | Monomers for Shell Portion | Weight Ratio |
|---|---|---|---|---|---|
| 7 | AL-7 | Benzyl methacrylate | 86 | Methyl methacrylate | 52 |
| | | Acrylic acid | 14 | 2-(2-Butoxyethoxy)ethyl methacrylate | 30 |
| | | | | 3-Sulfopropyl acrylate | 18 |
| 8 | AL-8 | Vinyl acetate | 65 | Methyl methacrylate | 40 |
| | | Vinyl butyrate | 25 | Methyl acrylate | 30 |
| | | 2-Vinyl acetic acid | 10 | Monomer (b-1) | 30 |
| 9 | AL-9 | Methyl methacrylate | 52 | 3-Phenylpropyl methacrylate | 84 |
| | | 2,3-Diacetyloxypropyl methacrylate | 35 | Acrylic acid | 16 |
| | | Acrylic acid | 13 | | |
| 10 | AL-10 | Methyl methacrylate | 50 | 2-Phenoxyethyl methacrylate | 80 |
| | | 2-Butoxycarbonylethyl methacrylate | 30 | 2-Carboxyethyl methacrylate | 20 |
| | | 2-Phosphonoethyl methacrylate | 20 | | |
| 11 | AL-11 | Ethyl methacrylate | 80 | Methyl methacrylate | 64 |
| | | | | 2-Methoxyethyl acrylate | 25 |
| | | | 20 | Acrylic acid | 11 |

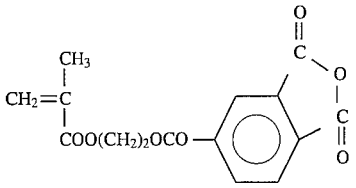

SYNTHESIS EXAMPLES 12 TO 21 OF RESIN GRAIN (AL)

(AL-12) TO (AL-21)

Each of the resin grains (AL-12) to (AL-21) was synthesized in the same manner as in Synthesis Example 3 of Resin Grain (AL) except for using each of the monomers shown in Table C below in place of Monomer (b1) employed in Synthesis Example 3 of Resin Grains (AL). A polymerization ratio of each of the resin grains was in a range of from 95 to 99% and an average grain diameter thereof was in a range of from 0.18 to 0.28 μm with good monodispersity.

TABLE C

| Synthesis Example of Resin Grain (AL) | Resin Grain (AL) | Monomer (b) |
|---|---|---|
| 12 | AL-12 | (b-4) 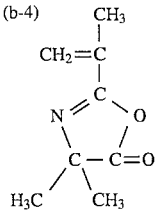 |
| 13 | AL-13 | (b-5) 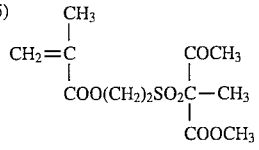 |

TABLE C-continued

| Synthesis Example of Resin Grain (AL) | Resin Grain (AL) | Monomer (b) |
|---|---|---|
| 14 | AL-14 | (b-6) 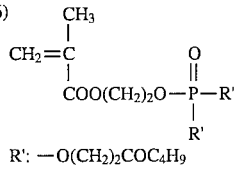 R': $-O(CH_2)_2COC_4H_9$ |
| 15 | AL-15 | (b-7) 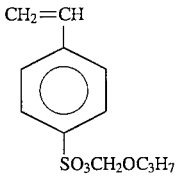 |
| 16 | AL-16 | (b-8) 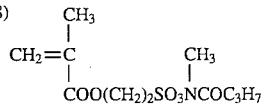 |
| 17 | AL-17 | (b-9) 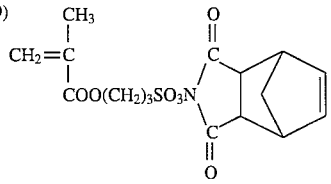 |

TABLE C-continued

| Synthesis Example of Resin Grain (AL) | Resin Grain (AL) | Monomer (b) |
|---|---|---|
| 18 | AL-18 | (b-10) $CH_2{=}C(CH_3)COOCH_2CH(OSi(CH_3)_3)CH_2OSi(CH_3)_3$ |
| 19 | AL-19 | (b-11) $CH_2{=}C(CH_3)COO(CH_2)_2CO(CH_2)_2OCH_3$ |
| 20 | AL-20 | (b-12) $CH_2{=}C(CH_3)COO(CH_2)_2CO(CH_2)_2Br$ |
| 21 | AL-21 | (b-13) 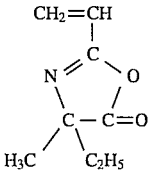 |

SYNTHESIS EXAMPLE 22 OF RESIN GRAIN (AL)

(AL-22).

A mixed solution of 15 g of Dispersion Stabilizing Resin (Q-4), 48 g of methyl methacrylate, 40 g of 2,3-dipropionyloxypropy methacrylate, 12 g of acrylic acid, 2.0 g of methyl 3-mercaptopropionate and 549 g of Isopar H was heated to a temperature of 60° C. under nitrogen gas stream while stirring. To the solution was added 0.8 g of AIVN as a polymerization initiator, followed by reacting for 2 hours. Twenty minutes after the addition of the polymerization initiator, the reaction mixture became white turbid, and the reaction temperature rose to 88° C. Then, 0.5 g of AIVN was added to the reaction mixture, the reaction was carried out for 2 hours, and 0.3 g of AIVN was further added thereto, followed by reacting for 3 hours. After cooling, the reaction mixture was passed through a nylon cloth of 200 mesh to obtain a white dispersion which was a latex of good monodispersity with a polymerization ratio of 98% and an average grain diameter of 0.18 μm.

A mixture of 260 g of the above-described resin grain dispersion (as seed), 14 g of Dispersion Stabilizing Resin (Q-1) described above, 10 g of Macromonomer (m-1) having the structure shown below and 553 g of Isopar H was heated to a temperature of 55° C. under nitrogen gas stream while stirring. To the solution was added dropwise a mixture of 75 g of benzyl methacrylate, 10 g of acrylic acid, 15 g of Monomer (b-11), 2 g of 3-mercatoporopionic acid, 1.0 g of 2,2'-azobis(2-cyclopropylpropionitrile) (abbreviated as ACPP) and 200 g of Isopar H over a period of one hour, followed by reacting for 1 hour with stirring. To the reaction mixture was added 0.8 g of ACPP, followed by reacting for 2 hours. Further, 0.5 g of AIBN was added thereto and the reaction temperature was adjusted to 80° C., and the reaction was continued for 3 hours. After cooling the reaction mixture was passed through a nylon cloth of 200 mesh to obtain a white dispersion which was a latex of good monodispersity with a polymerization ratio of 97% and an average grain diameter of 0.24 μm.

Macromonomer (m-1)

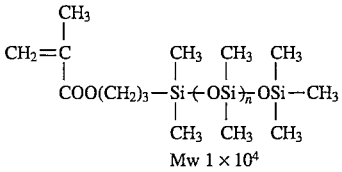

Mw $1\times10^4$

SYNTHESIS EXAMPLES 23 TO 28 OF RESIN GRAIN (AL)

(AL-23) TO (AL-28)

Each of the resin grains (AL-23) to (AL-28) was synthesized in the same manner as in Synthesis Example 22 of Resin Grain (AL) except for using each of the macromonomers (Mw thereof being in a range of from $8\times10^3$ to $1\times10^4$) shown in Table D below in place of Macromonomer (m-1) employed in Synthesis Example 22 of Resin Grain (AL). A polymerization ratio of each of the resin grains was in a range of from 98 to 99% and an average grain diameter thereof was in a range of from 0.20 to 0.25 μm with good monodispersity.

TABLE D

| Synthesis Example of Resin Grain (AL) | Resin Grain (AL) | Macromonomer |
|---|---|---|
| 23 | AL-23 | 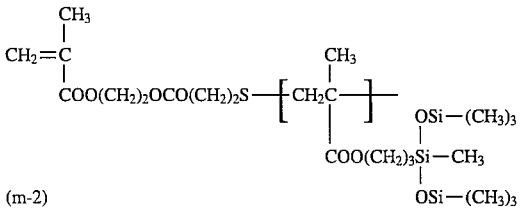 (m-2) |

TABLE D-continued

| Synthesis Example of Resin Grain (AL) | Resin Grain (AL) | Macromonomer |
|---|---|---|
| 24 | AL-24 | 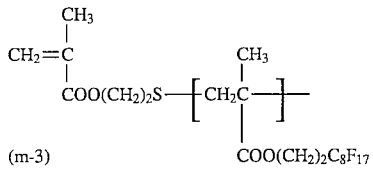 (m-3) |
| 25 | AL-25 | 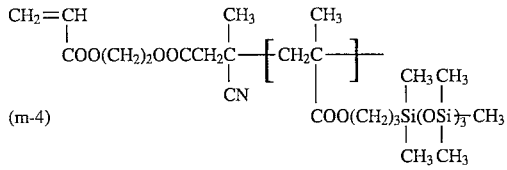 (m-4) |
| 26 | AL-26 | 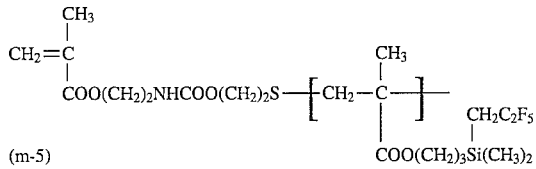 (m-5) |
| 27 | AL-27 | 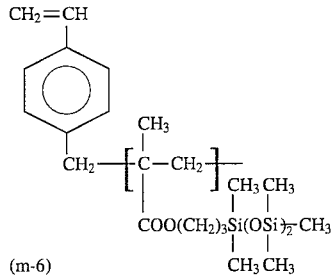 (m-6) |
| 28 | AL-28 | 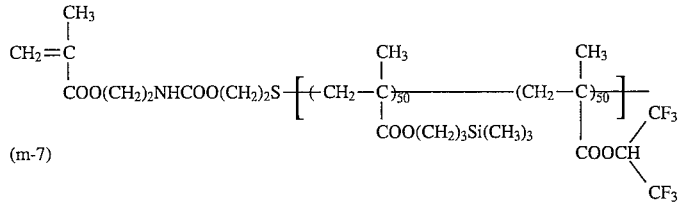 (m-7) |

SYNTHESIS EXAMPLE 29 OF RESIN GRAIN (AL)

(AL-29)

A mixture of 20 g of Resin (A-1) having the structure shown below and 30 g of Resin (A-2) having the structure shown below was dissolved by heating at 40° C. in 100 g of tetrahydrofuran, then the solvent was distilled off and the resulting product was dried under a reduced pressure. The solid thus-obtained was pulverized by a trioblender (manufactured by Trio-sience Co., Ltd.). A mixture of 20 g of the resulting coarse powder, 5 g of Dispersion Stabilizing Resin (Q-5) having the structure shown below and 80 g of Isopar G was dispersed using a Dyno-mill to obtain a dispersion which was a latex having an average grain diameter of 0.45 μm.

Resin (A-1)

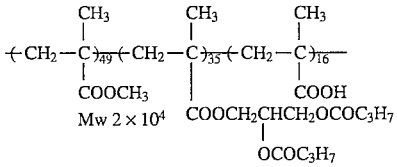

Resin (A-2)

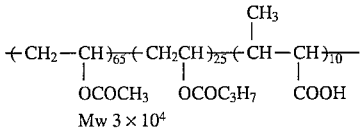

-continued

Dispersion Stabilizing Resin (Q-5)

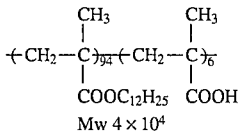

Mw $4\times10^4$

SYNTHESIS EXAMPLES OF RESIN (P):

SYNTHESIS EXAMPLE 1 OF RESIN (P):

(P-1)

A mixed solution of 80 g of methyl methacrylate, 20 g of a dimethylsiloxane macromonomer (FM-0725 manufactured by Chisso Corp.; Mw: $1\times10^4$), and 200 g of toluene was heated to a temperature of 75° C. under nitrogen gas stream. To the solution was added 1.0 g of AIBN, followed by reacting for 4 hours. To the mixture was further added 0.7 g of AIBN, and the reaction was continued for 4 hours. An Mw of the resulting copolymer was $5.8\times10^4$.

Resin (P-1)

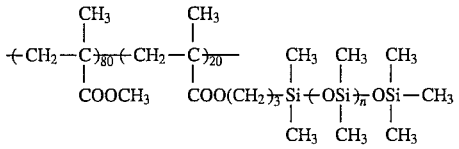

SYNTHESIS EXAMPLES 2 TO 9 OF RESIN (P):

(P-2) TO (P-9)

Each of copolymers was synthesized in the same manner as in Synthesis Example 1 of Resin (P), except for replacing methyl methacrylate and the macromonomer (FM-0725) with each monomer corresponding to the polymer component shown in Table E below. An Mw of each of the resulting polymers was in a range of from $4.5\times10^4$ to $6\times10^4$.

TABLE E

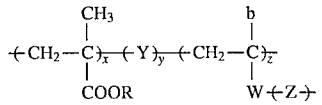

| Synthesis Example of Resin (P) | Resin (P) | −R | −Y− | −b | −W− | −Z− | x/y/z (weight ratio) |
|---|---|---|---|---|---|---|---|
| 2 | P-2 | $-C_2H_5$ | $-CH_2-C(CH_3)(COOCH_2CH(O)CH_2)-$ | $-CH_3$ | $-COO(CH_2)_2S$ | $-CH_2-C(CH_3)(COO(CH_2)_2C_8F_{17})-$ | 65/15/20 |
| 3 | P-3 | $-CH_3$ | $-CH_2-CH(COOCH_3)-$ | $-H$ | $COO(CH_2)_2OCO-*$ <br> $*-(CH_2)_2S-$ | $-CH_2-C(CH_3)(COOCH_2CF_2CFHCF_3)-$ | 60/10/30 |
| 4 | P-4 | $-CH_3$ | $-CH_2-C(CH_3)(COOCH_2CH(OH)CH_2OH)-$ | $-CH_3$ | $COOCH_2CH(OH)CH_2-*$ <br> $*-OOC(CH_2)_2S-$ | $-CH_2-C(CH_3)(COO(CH_2)_3Si(CH_3)_2-O-Si(CH_3)_2-CH_3)-$ | 65/10/25 |
| 5 | P-5 | $-C_3H_7$ | $-CH_2-C(CH_3)(COO(CH_2)_2NHCOOCH(CF_3)_2)-$ | $-CF_3$ | $COOCH_2CH(OH)CH_2-*$ <br> $*-OOC(CH_2)_2S-$ | $-CH_2-C(CH_3)(COO(CH_2)_2Si(CH_3)_2-(OSi(CH_3)_2)_3-O-Si(CH_3)_2-CH_3)-$ | 65/15/20 |
| 6 | P-6 | $-CH_3$ | $-CH_2-C(CH_3)(COO(CH_2)_3Si(OC_2H_5)_3)-$ | $-CH_3$ | $COOCH_2CH(OH)CH_2-*$ <br> $*-OOC(CH_2)_2S-$ | $-CH_2-C(CH_3)(COO(CH_2)_3Si(OSi(CH_3)_3)_2-O-Si(CH_3)_3)-$ | 50/20/30 |

TABLE E-continued $$\left(CH_2-\underset{\underset{COOR}{|}}{\overset{\overset{CH_3}{|}}{C}}\right)_x\left(Y\right)_y\left(CH_2-\underset{\underset{W\left(Z\right)}{|}}{\overset{\overset{b}{|}}{C}}\right)_z$$

| Synthesis Example of Resin (P) | Resin (P) | −R | −Y− | −b | −W− | −Z− | x/y/z (weight ratio) |
|---|---|---|---|---|---|---|---|
| 7 | P-7 | $-C_2H_5$ | 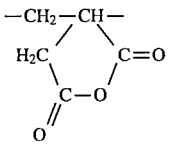 | −H | $-CONH(CH_2)_2S-$ | 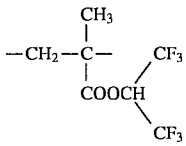 | 57/8/35 |
| 8 | P-8 | $-CH_3$ | $-CH_2-\underset{\underset{CONH(CH_2)_6OH}{\mid}}{CH}-$ | −H | $\underset{\underset{COO(CH_2)_2OCO-*}{\mid}}{}$ <br> $*-CH_2S-$ | $-CH_2-\underset{\underset{CONHC_{17}F_{35}}{\mid}}{CH}-$ | 70/15/15 |
| 9 | P-9 | $-C_2H_5$ | $-CH_2-\underset{\underset{COO(CH_2)_2NHCO\overset{\overset{COCH_3}{\mid}}{CH}-COCH_3}{\mid}}{\overset{\overset{CH_3}{\mid}}{C}}-$ | $-CH_3$ | $\underset{\underset{COO(CH_2)_2OCO-*}{\mid}}{}$ <br> $*-CH_2S-$ | $-CH_2-\underset{\underset{COO(CH_2)_3SO_2NHC_{12}F_{25}}{\mid}}{\overset{\overset{CH_3}{\mid}}{C}}-$ | 60/20/20 |

SYNTHESIS EXAMPLE 10 OF RESIN (P)

(P-10)

A mixed solution of 60 g of 2,2,3,4,4,4-hexafluorobutyl methacrylate, 40 g of a methyl methacrylate macromonomer (AA-6 manufactured by Toagosei Chemical Industry Co., Ltd.; Mw: $1\times10^4$), and 200 g of benzotrifluoride was heated to a temperature of 75° C. under nitrogen gas stream. To the solution was added 1.0 g of AIBN, followed by reacting for 4 hours. To the mixture was further added 0.5 g of AIBN, and the reaction was continued for 4 hours. An Mw of the copolymer thus-obtained was $6.5\times10^4$.

Resin (P-10)

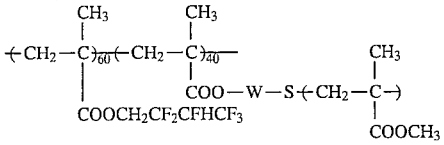

—W—: an organic residue (unknown)

SYNTHESIS EXAMPLES 11 TO 15 OF RESIN (P)

(P-11) TO (P-15)

Each of copolymers was synthesized in the same manner as in Synthesis Example 10 of Resin (P), except for replacing the monomer and the macromonomer used in Synthesis Example 10 of Resin (P) with each monomer corresponding to the polymer component and each macromonomer corresponding to the polymer component both shown in Table F below. An Mw of each of the resulting copolymers was in a range of from $4.5\times10^4$ to $6.5\times10^4$.

TABLE F

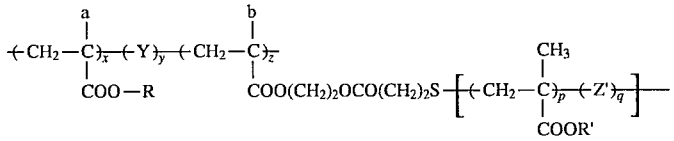

| Synthesis Example of Resin (P) | Resin (P) | −a | −R | −Y− | −b | −R' | −Z'− | x/y/z (weight ratio) | p/q (weight ratio) |
|---|---|---|---|---|---|---|---|---|---|
| 11 | P-11 | $-CH_3$ | $+(CH_2)_2C_nF_{2n+1}$ n = 8~10 | — | $-CH_3$ | $-CH_3$ | $-CH_2-C(CH_3)(COOCH_2CH(O)CH_2)-$ | 70/0/30 | 70/30 |
| 12 | P-12 | $-CH_3$ | $+(CH_2)_2CF_2CFHCF_3$ | — | $-H$ | $-CH_3$ | $-CH_2-C(CH_3)(COO(CH_2)_3Si(CH_3)(OCH_3)_2)-$ | 60/0/40 | 70/30 |
| 13 | P-13 | $-CH_3$ | $-CH_2CF_2CF_2H$ | $-CH_2-C(CH_3)(COO(CH_2)_2Si(CH_3)(CH_3)OSi(CH_3)(CH_3)OSi(CH_3)(CH_3)-CH_3)-$ | $-CH_3$ | $-C_3H_7$ | $-CH_2-C(CH_3)(COOCH_2CH=CH_2)-$ | 40/30/30 | 90/10 |
| 14 | P-14 | $-H$ | $-CH_2CF_2CFHCF_3$ | $-CH_2-C(CH_3)(COO(CH_2)_3Si(CF_3)(CF_3)-C_2H_5)-$ | $-CH_3$ | $-C_2H_5$ | $-CH_2-C(CH_3)(COO(CH_2)_2OH)-$ | 30/45/25 | 60/40 |
| 15 | P-15 | $-CH_3$ | $+(CH_2)_3Si(CH_3)(CH_3)(OSi(CH_3)(CH_3))_3Si(CH_3)(CH_3)-CH_3$ | — | $-CH_3$ | $-C_2H_5$ | $-CH_2-CH(COOH)-$ | 80/0/20 | 90/10 |

SYNTHESIS EXAMPLE 16 OF RESIN (P)

(P-16)

A mixed solution of 67 g of methyl methacrylate, 22 g of methyl acrylate, 1 g of methacrylic acid, and 200 g of toluene was heated to a temperature of 80° C. under nitrogen gas stream. To the solution was added 10 g of Polymer Azobis Initiator (PI-1) having the structure shown below, followed by reacting for 8 hours. After completion of the reaction, the reaction mixture was poured into 1.5 l of methanol, and the precipitate thus-deposited was collected and dried to obtain 75 g of a copolymer having an Mw of $3\times10^4$.

Polymer Initiator (PI-1)

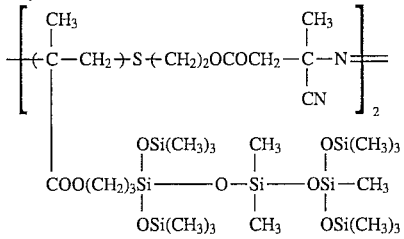

Polymer (P-16)

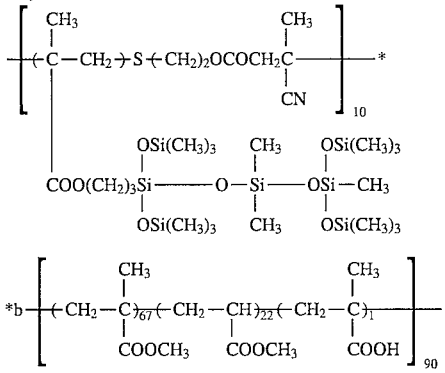

—b—: a bond between blocks (hereinafter the same)

SYNTHESIS EXAMPLE 17 OF RESIN (P)

(P-17)

A mixed solution of 70 g of methyl methacrylate and 200 g of tetrahydrofuran was thoroughly degassed under nitrogen gas stream and cooled to −20° C. To the solution was added 0.8 g of 1,1-diphenylbutyl lithium, followed by reacting for 12 hours. To the reaction mixture was then added a mixed solution of 30 g of Monomer (M-1) shown below and 60 g of tetrahydrofuran which had been thoroughly degassed under nitrogen gas stream, followed by reacting for 8 hours.

After rendering the mixture to 0° C., 10 ml of methanol was added thereto to conduct a reaction for 30 minutes to stop the polymerization. The resulting polymer solution was heated to a temperature of 30° C. with stirring, and 3 ml of a 30% ethanol solution of hydrogen chloride was added thereto, followed by stirring for 1 hour. The reaction mixture was distilled under reduced pressure to remove the solvent until the volume was reduced to half and the residue was reprecipitated in 1 l of petroleum ether. The precipitate was collected and dried under reduced pressure to obtain 76 g of a polymer having an Mw of $6.8\times10^4$.

Monomer (M-1)

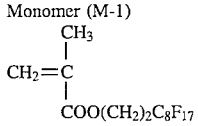

Resin (P-17)

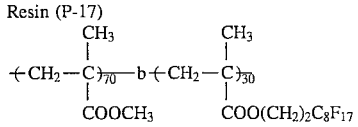

SYNTHESIS EXAMPLE 18 OF RESIN (P)

(P-18)

A mixed solution of 52.5 g of methyl methacrylate, 22.5 g of methyl acrylate, 0.5 g of methylaluminum tetraphenylporphynate, and 200 g of methylene chloride was heated to a temperature of 30° C. under nitrogen gas stream. The solution was irradiated with light from a xenon lamp of 300 W at a distance of 25 cm through a glass filter for 20 hours. To the mixture was added 25 g of Monomer (M-2) shown below, and the resulting mixture was further irradiated with light under the same conditions as above for 12 hours. To the reaction mixture was added 3 g of methanol, followed by stirring for 30 minutes to stop the reaction. The reaction mixture was reprecipitated in 1.5 l of methanol, and the precipitate was collected and dried to obtain 78 g of a polymer having an Mw of $7\times10^4$.

Monomer (M-2)

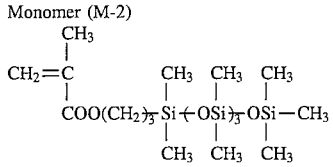

Resin (P-18)

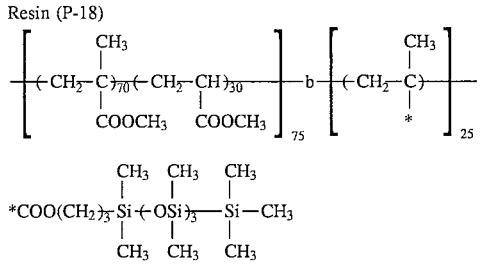

SYNTHESIS EXAMPLE 19 OF RESIN (P)

(P-19)

A mixture of 50 g of ethyl methacrylate, 10 g of glycidyl methacrylate, and 4.8 g of benzyl N,N-diethyldithiocarbamate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. The reaction mixture was dissolved in 100 g of tetrahydrofuran, and 40 g of Monomer (M-3) shown below was added thereto. After displacing the atmosphere with nitrogen, the mixture was again irradiated with light for 10 hours. The reaction mixture obtained was reprecipitated in 1 l of methanol, and the precipitate was collected and dried to obtain 73 g of a polymer having an Mw of 4.8×104.

Monomer (M-3)

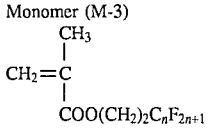

(n: an integer of from 8 to 10)

Resin (P-19)

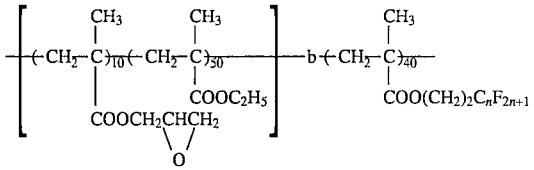

(n: an integer of from 8 to 10)

SYNTHESIS EXAMPLE 20 OF RESIN (P)

(P-20)

A mixture of 50 g of methyl methacrylate, 25 g of ethyl methacrylate, and 1.0 g of benzyl isopropylxanthate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. To the mixture was added 25 g of Monomer (M-1) described above. After displacing the atmosphere with nitrogen, the mixture was again irradiated with light for 10 hours. The reaction mixture obtained was reprecipitated in 2 l of methanol, and the precipitate was collected and dried to obtain 63 g of a polymer having an Mw of $6\times10^4$.

Resin (P-20)

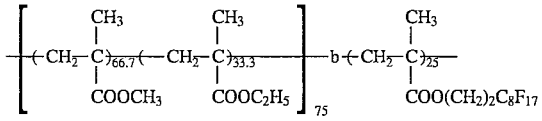

SYNTHESIS EXAMPLES 21 TO 27 OF RESIN (P)

(P-21) TO (P-27)

Each of copolymers shown in Table G below was prepared in the same manner as in Synthesis Example 19 of Resin (P). An Mw of each of the resulting polymers was in a range of from $3.5\times10^4$ to $6\times10^4$.

TABLE G

| Synthesis Example of Resin (P) | Resin (P) | A–B Type Block Copolymer (weight ratio) |
|---|---|---|
| 21 | P-21 | 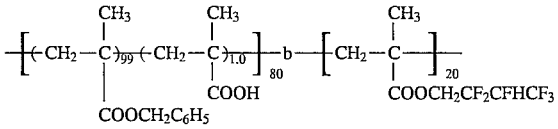 |
| 22 | P-22 | 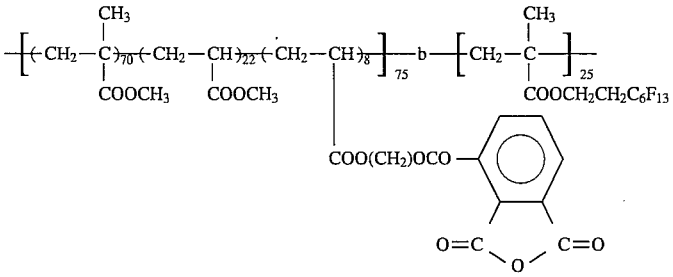 |
| 23 | P-23 | 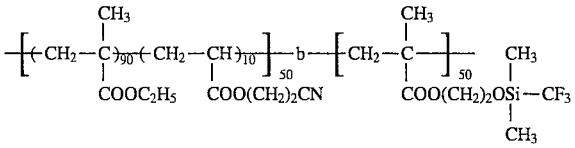 |
| 24 | P-24 | 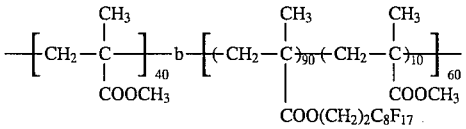 |

TABLE G-continued

| Synthesis Example of Resin (P) | Resin (P) | A–B Type Block Copolymer (weight ratio) |
|---|---|---|
| 25 | P-25 | 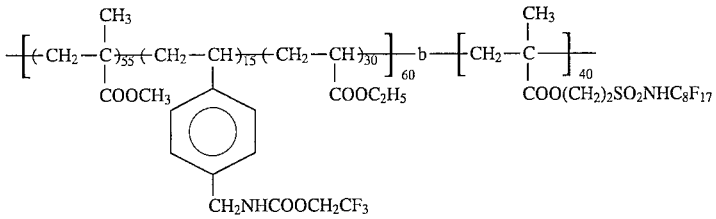 |
| 26 | P-26 | 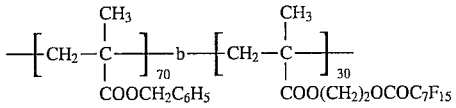 |
| 27 | P-27 | 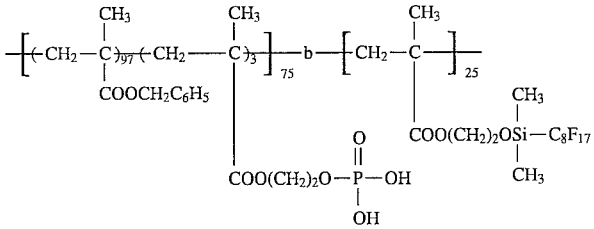 |

SYNTHESIS EXAMPLE 28 OF RESIN (P)

(P-28)

A copolymer having an Mw of $4.5\times10^4$ was prepared in the same manner as in Synthesis Example 19 of Resin (P), except for replacing benzyl N,N-diethyldithiocarbamate with 18 g of Initiator (I-1) having the structure shown below.

Initiator (I-1)

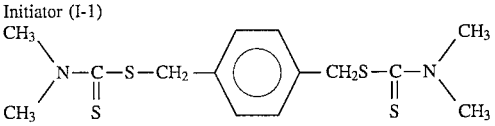

Resin (P-28)

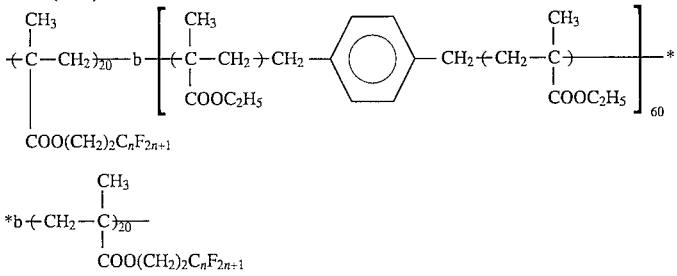

(n: an integer of from 8 to 10)

SYNTHESIS EXAMPLE 29 OF RESIN (P)

(P-29)

A copolymer having an Mw of $2.5\times10^4$ was prepared in the same manner as in Synthesis Example 20 of Resin (P), except for replacing benzyl isopropylxanthate with 0.8 g of Initiator (I-2) having the structure shown below.

Initiator (I-2)

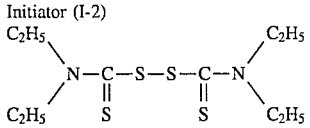

Resin (P-29)

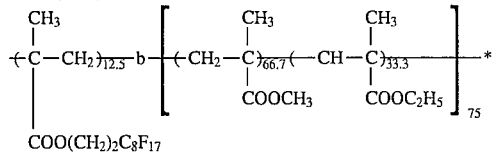

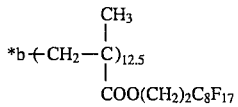

SYNTHESIS EXAMPLE 30 OF RESIN (P)

(P-30)

A mixed solution of 68 g of methyl methacrylate, 22 g of methyl acrylate, 10 g of glycidyl methacrylate, 17.5 g of Initiator (I-3) having the structure shown below, and 150 g of tetrahydrofuran was heated to a temperature of 50° C. under nitrogen gas stream. The solution was irradiated with light from a high-pressure mercury lamp of 400 W at a distance of 10 cm through a glass filter for 10 hours to conduct photopolymerization. The reaction mixture obtained was reprecipitated in 1 l of methanol, and the precipitate was collected and dried to obtain 72 g of a polymer having an Mw of $4.0\times10^4$.

A mixed solution of 70 g of the resulting polymer, 30 g of Monomer (M-2) described above, and 100 g of tetrahydrofuran was heated to a temperature of 50° C. under nitrogen gas stream and irradiated with light under the same conditions as above for 13 hours. The reaction mixture was reprecipitated in 1.5 l of methanol, and the precipitate was collected and dried to obtain 78 g of a copolymer having an Mw of $6\times10^4$.

Initiator (I-3)

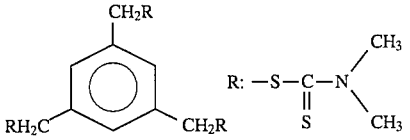

Resin (P-30)

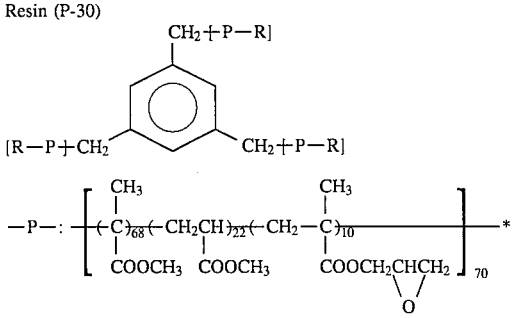

-continued

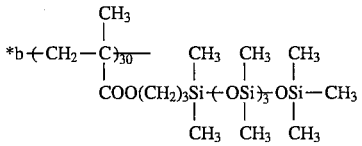

SYNTHESIS EXAMPLES 31 TO 38 OF RESIN (P)

(P-31) TO (P-38)

In the same manner as in Synthesis Example 30 of Resin (P), except for replacing 17.5 g of Initiator (I-3) with 0.031 mol of each of the initiators shown in Table H below, each of the copolymers shown in Table H was obtained. A yield thereof was in a range of from 70 to 80 g and an Mw thereof was in a range of from $4\times10^4$ to $6\times10^4$.

TABLE H
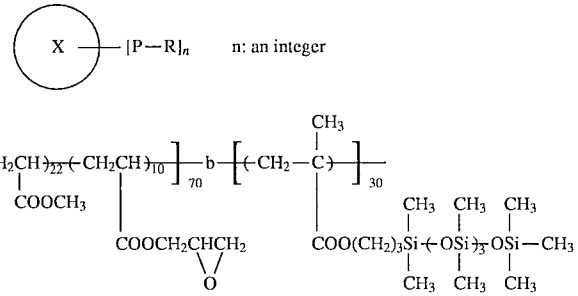
| Synthesis Example of Resin (P) | Resin (P) | Initiator (I) | —R | 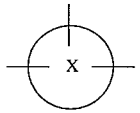 |
|---|---|---|---|---|
| 31 | P-31 | 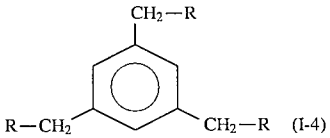 (I-4) | 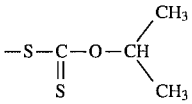 | 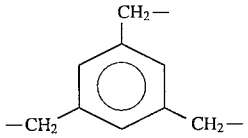 |
| 32 | P-32 | 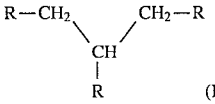 (I-5) | 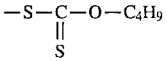 | 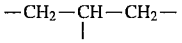 |
| 33 | P-33 | 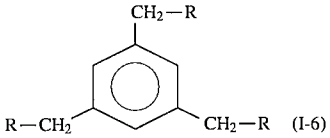 (I-6) | 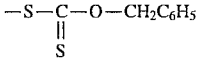 | 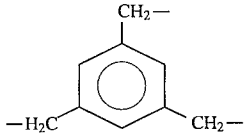 |
| 34 | P-34 | 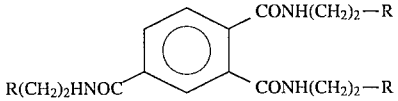 (I-7) | 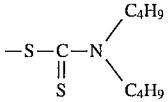 | 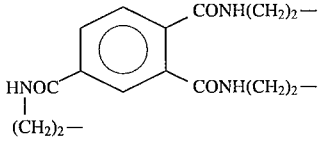 |

TABLE H-continued
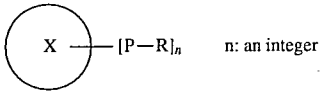
n: an integer
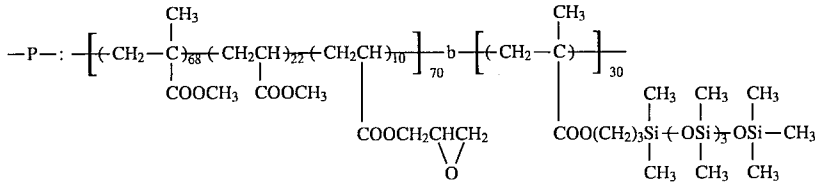
| Synthesis Example of Resin (P) | Resin (P) | Initiator (I) | —R | 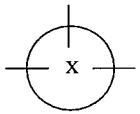 |
|---|---|---|---|---|
| 35 | P-35 | 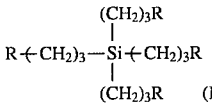 (I-8) | 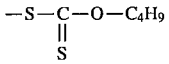 | 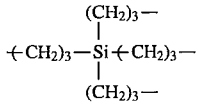 |
| 36 | P-36 | 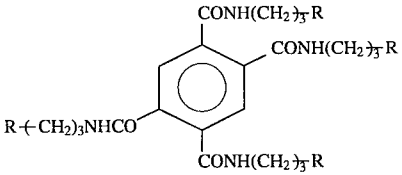 (I-9) | 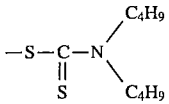 | 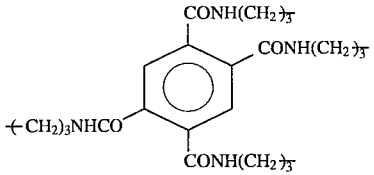 |
| 37 | P-37 | 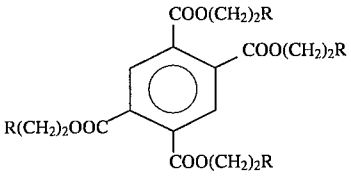 (I-10) | 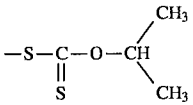 | 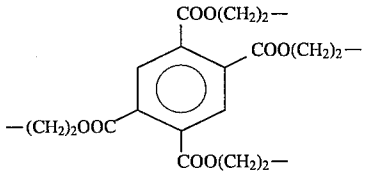 |

TABLE H-continued
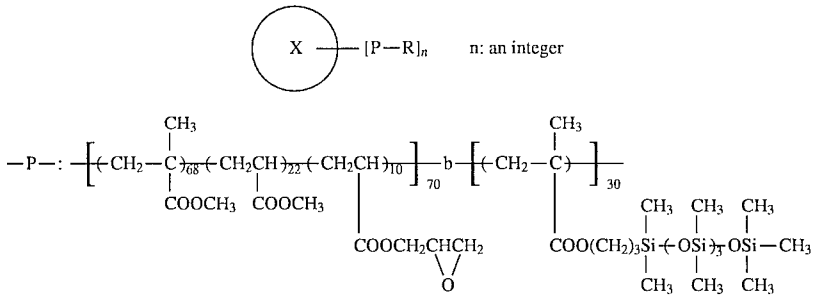
| Synthesis Example of Resin (P) | Resin (P) | Initiator (I) | —R | X |
|---|---|---|---|---|
| 38 | P-38 | 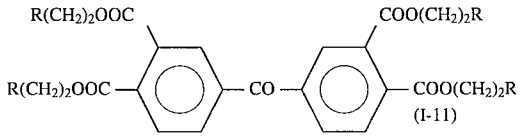 (I-11) | 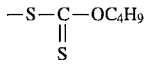 | 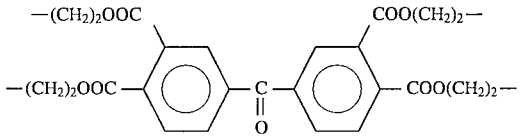 |

Synthesis Examples of Resin Grain (L)

SYNTHESIS EXAMPLE 1 OF RESIN GRAIN (L)

(L-1)

A mixed solution of 40 g of Monomer (LM-1) having the structure shown below, 2 g of ethylene glycol dimethacrylate, 4.0 g of Dispersion Stabilizing Resin (LP-1) having the structure shown below, and 180 g of methyl ethyl ketone was heated to a temperature of 60° C. with stirring under nitrogen gas stream. To the solution was added 0.3 g of AIVN, followed by reacting for 3 hours. To the reaction mixture was further added 0.1 g of AIVN, and the reaction was continued for 4 hours. After cooling, the reaction mixture was passed through a nylon cloth of 200 mesh to obtain a white dispersion. The average grain diameter of the latex was 0.25 μm (the grain diameter was measured by CAPA-500 manufactured by Horiba, Ltd., herein the same).

Monomer (LM-1)

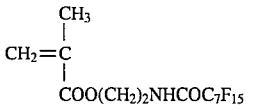

Dispersion Stabilizing Resin (LP-1)

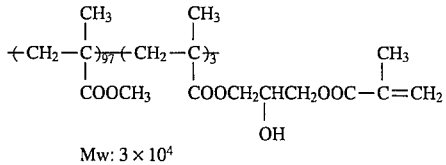

Mw: $3\times10^4$

SYNTHESIS EXAMPLE 2 OF RESIN GRAIN (L)

(L-2)

A mixed solution of 5 g of a monofunctional macromonomer comprising a butyl acrylate unit (AB-6 manufactured by Toagosei Chemical Industry Co., Ltd.) as a dispersion stabilizing resin and 140 g of methyl ethyl ketone was heated to a temperature of 60° C. under nitrogen gas stream while stirring. To the solution was added dropwise a mixed solution of 40 g of Monomer (LM-2) having the structure shown below, 1.5 g of ethylene glycol diacrylate, 0.2 g of AIVN, and 40 g of methyl ethyl ketone over a period of one hour. After the addition, the reaction was continued for 2 hours. To the reaction mixture was further added 0.1 g of AIVN, followed by reacting for 3 hours to obtain a white dispersion. After cooling, the dispersion was passed through a nylon cloth of 200 mesh. The average grain diameter of the dispersed resin grains was 0.35 μm.

Monomer (LM-2)

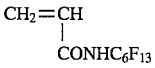

SYNTHESIS EXAMPLES 3 TO 11 OF RESIN GRAIN (L)

(L-3) TO (L-11)

Each of resin grains was synthesized in the same manner as in Synthesis Example 1 of Resin Grain (L), except for replacing Monomer (LM-1), ethylene glycol dimethacrylate and methyl ethyl ketone with each of the compounds shown in Table I below, respectively. An average grain diameter of each of the resulting resin grains was in a range of from 0.15 to 0.30 μm.

TABLE I

| Synthesis Example of Resin Grain (L) | Resin Grain (L) | Monomer (LM) | Polyfunctional Monomer for Crosslinking | Amount | Reaction Solvent |
|---|---|---|---|---|---|
| 3 | L-3 | (LM-3) 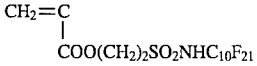 | Ethylene glycol dimethyacrylate | 2.5 g | Methyl ethyl ketone |
| 4 | L-4 | (LM-4) 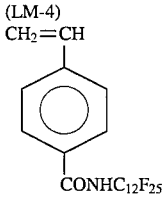 | Divinylbenzene | 3 g | Methyl ethyl ketone |
| 5 | L-5 | (LM-5)  | — | | Methyl ethyl ketone |
| 6 | L-6 | (LM-6) 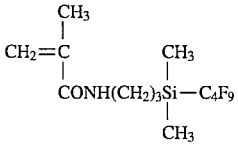 | Diethylene glycol diacrylate | 5 g | n-Hexane |

TABLE I-continued

| Synthesis Example of Resin Grain (L) | Resin Grain (L) | Monomer (LM) | Polyfunctional Monomer for Crosslinking | Amount | Reaction Solvent |
|---|---|---|---|---|---|
| 7 | L-7 | (LM-7) 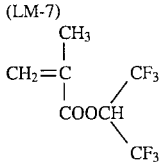 | Ethylene glycol dimethyacrylate | 3.5 g | n-Hexane |
| 8 | L-8 | (LM-8) $CH_2{=}CH$ \| $COO(CH_2)_2CONHC_8F_{17}$ | Trimethylolpropane trimethacrylate | 2.5 g | Methyl ethyl ketone |
| 9 | L-9 | (LM-9) $CH_2{=}CH$ \| $CONH(CH_2)_3Si[OSi(CH_3)_3]_3$ | Trivinylbenzene | 3.3 g | Ethyl acetate/ n-Hexane (4/1 by weight) |
| 10 | L-10 | (LM-10) $CH_2{=}C(CH_3)$ \| $COO(CH_2)_2NHCONH(CH_2)_3Si[OSi(CH_3)_3]_3$ | Divinyl glutaconate | 4 g | Ethyl acetate/ n-Hexane (2/1 by weight) |
| 11 | L-11 | (LM-11) $CH_2{=}C(CH_3)$ \| $CONHCOOCH_2CF_2CFHCF_3$ | Propylene glycol diacrylate | 3 g | Methyl ethyl ketone |

SYNTHESIS EXAMPLES 12 TO 17 OF RESIN GRAIN (L)

(L-12) TO (L-17)

Each of resin grains was synthesized in the same manner as in Synthesis Example 2 of Resin Grain (L), except for replacing 5 g of the monofunctional macromonomer AB-6 (dispersion stabilizing resin) with each of Resins (LP) shown in Table J below. An average grain diameter of each of the resulting resin grains was in a range of from 0.10 to 0.25 μm.

TABLE J

| Synthesis Example of Resin Grain (L) | Resin Grain (L) | Dispersion Stabilizing Resin (LP) | A-mount |
|---|---|---|---|
| 12 | L-12 | 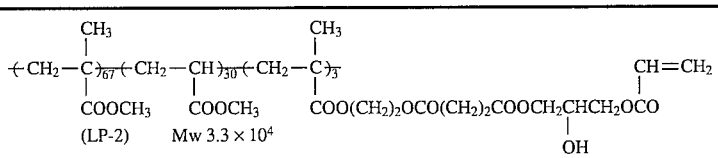 (LP-2) Mw $3.3\times10^4$ | 4 g |
| 13 | L-13 | 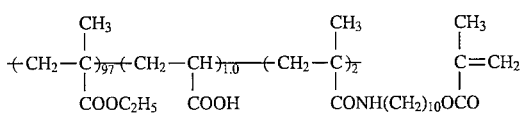 (LP-3) Mw $2.5\times10^4$ | 2 g |

TABLE J-continued

| Synthesis Example of Resin Grain (L) | Resin Grain (L) | Dispersion Stabilizing Resin (LP) | A-mount |
|---|---|---|---|
| 14 | L-14 | 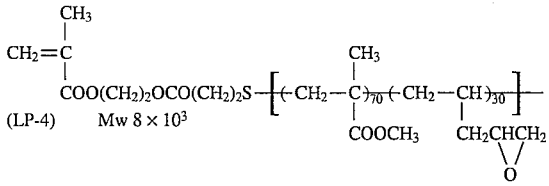 (LP-4) Mw $8\times10^3$ | 6 g |
| 15 | L-15 | 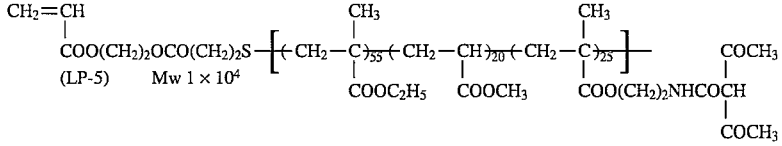 (LP-5) Mw $1\times10^4$ | 6 g |
| 16 | L-16 | 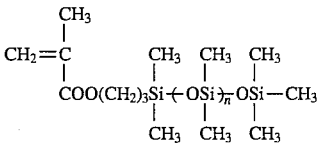 (LP-6) Mw $1\times10^4$ | 4 g |
| 17 | L-17 | 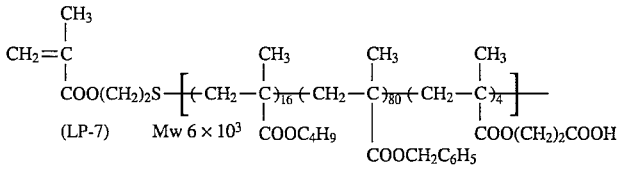 (LP-7) Mw $6\times10^3$ | 5 g |

SYNTHESIS EXAMPLES 18 TO 23 OF RESIN GRAIN (L)

(L-18) TO (L-23)

Each of resin grains was synthesized in the same manner as in Synthesis Example 2 of Resin Grain (L), except for replacing 40 g of Monomer (LM-2) with each of the monomers shown in Table K below and replacing 5 g of the monofunctional macromonomer AB-6 (dispersion stabilizing resin) with 6 g of Dispersion Stabilizing Resin (LP-8) having the structure shown below. An average grain diameter of each of the resulting resin grains was in a range of from 0.05 to 0.20 μm.

Dispersion Stabilizing Resin (LP-8)

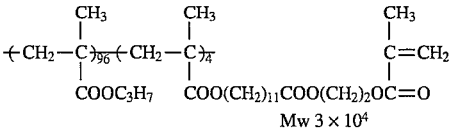

Mw $3\times10^4$

TABLE K

| Synthesis Example Resin Grain (L) | Resin Grain (L) | Monomer (LM) | Amount | Other Monomer | Amount |
|---|---|---|---|---|---|
| 18 | L-18 | (LM-12) 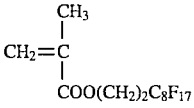 | 30 g | $CH_2=CH$ \| $CONHCH_2OCH_3$ | 10 g |
| 19 | L-19 | (LM-13) 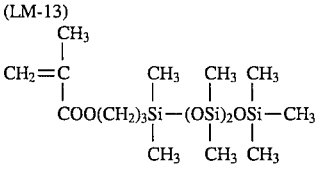 | 25 g | Glycidyl methacrylate | 15 g |

TABLE K-continued

| Synthesis Example Resin Grain (L) | Resin Grain (L) | Monomer (LM) | Amount | Other Monomer | Amount |
|---|---|---|---|---|---|
| 20 | L-20 | (LM-14) $CH_2{=}CH$ \| $COOCH_2CF_2CF_2H$ | 20 g | Acrylonitrile | 20 g |
| 21 | L-21 | (LM-15) 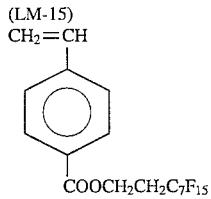 | 25 g | 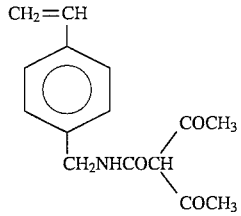 | 15 g |
| 22 | L-22 | (LM-16) $CH_2{=}C(CH_3)COO(CH_2)_2OSi(CH_3)_2{-}C_6F_{13}$ | 20 g | Methyl methacrylate | 20 g |
| 23 | L-23 | (LM-17) $CH_3{-}CH{=}CH{-}COOCH_2CF_2CFHCF_3$ | 20 g | Vinyl acetate | 20 g |

EXAMPLE 1

A mixture of 2 g of X-form metal-free phthalocyanine (manufactured by Dainippon Ink and Chemicals, Inc.), 8 g of Binder Resin (B-1) having the structure shown below, 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were added 2.0 g of Resin (P-2), 0.03 g of phthalic anhydride, and 0.002 g of o-chlorophenol, followed by further dispersing for 2 minutes. The glass beads were separated by filtration to prepare a dispersion for a light-sensitive layer.

Binder Resin (B-1)

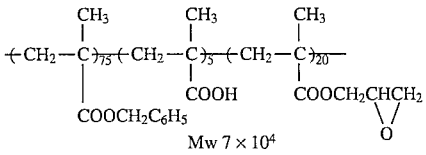

Mw $7\times10^4$

Compound (A)

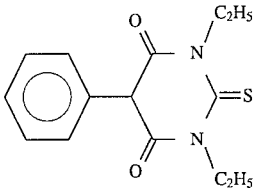

The resulting dispersion was coated on base paper for a paper master having a thickness of 0.2 mm, which had been subjected to electrically conductive treatment and solvent-resistant treatment, by a wire bar, set to touch, and heated in a circulating oven at 110° C. for 20 seconds, and then further heated at 140° C. for 1 hour to form a light-sensitive layer having a thickness of 8 μm. The adhesion strength of the surface of the resulting electrophotographic light-sensitive element measured according to JIS Z 0237-1980 "Testing methods of pressure sensitive adhesive tapes and sheets" was 3 gram-force (gf).

The electrophotographic light-sensitive element was installed in an apparatus as shown in FIG. 2, and a transfer layer was formed thereon. Specifically, on the surface of light-sensitive element installed on a drum, surface temperature of which was adjusted at 60° C. and which was rotated at a circumferential speed of 10 mm/sec, Dispersion of Resin Grain (L-1) containing positively charged resin grains shown below was supplied using a slit electrodeposition device, while putting the light-sensitive element to earth and applying an electric voltage of 150 V to an electrode of the slit electrodeposition device, whereby the resin grains were electrodeposited and fixed. A thickness of the resulting transfer layer was 2.5 μm.

| Dispersion of Resin Grain (L-1) | |
|---|---|
| Resin Grain (AL-1) | 8 g (solid basis) |
| Positive-Charge Control Agent (CD-1) (octadecyl vinyl ether/N-hexadecyl maleic monoamide copolymer (1/1 ratio by mole)) | 0.02 g |
| Isopar G | up to make 1.0 liter |

The electrophotographic light-sensitive material thus-obtained was subjected to formation of toner image, heat transfer onto a receiving material, preparation of a printing plate and printing in the following manner.

The light-sensitive material was charged to +450 V with a corona discharge in dark and exposed to light of a gallium-aluminum-arsenic semiconductor laser (output: 5 mW; oscillation wavelength: 780 nm) at an irradiation dose (on the surface of the light-sensitive material) of 30 erg/cm$^2$, a pitch of 25 μm, and a scanning speed of 300 cm/sec based on digital image data of an original read by a color scanner and memorized in a hard disc.

Thereafter, the light-sensitive material was subjected to reversal development using Liquid Developer (LD-1) prepared in the manner as described below, while applying a bias voltage of +400 V to 8 development electrode to thereby electrodeposit toner particles on the exposed areas. The light-sensitive material was then rinsed in a bath of Isopar H alone to remove stains on the non-image areas.

Preparation of Liquid Developer (LD-1)

1) Preparation of Toner Particles:

A mixed solution of 70 g of methyl methacrylate, 30 g of methyl acrylate, 20 g of a dispersion polymer having the structure shown below, and 680 g of Isopar H was heated to 65° C. under nitrogen gas stream with stirring. To the solution was added 1.2 g of 2,2'-azobis(isovaleronitrile) (AIVN), followed by allowing the mixture to react for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under a reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95%, and the resulting dispersion had an average grain diameter of resin grain of 0.25 μm (grain diameter being measured by CAPA-500 manufactured by Horiba, Ltd.) and good monodispersity.

Dispersion Polymer

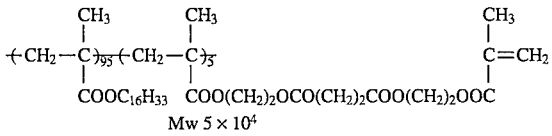

2) Preparation of Colored Particles:

Ten grams of a tetradecyl methacrylate/methacrylic acid (95/5 ratio by weight) copolymer, 10 g of nigrosine, and 30 g of Isopar G were put in a paint shaker (manufactured by Toyo Seiki Seisakusho Co.) together with glass beads and dispersed for 4 hours to prepare a fine dispersion of nigrosine.

3) Preparation of Liquid Developer:

A mixture of 45 g of the above-prepared toner particle dispersion, 25 g of the above-prepared nigrosine dispersion, 0.6 g of a hexadecene/maleic acid monooctadecylamide (1/1 ratio by mole) copolymer, and 15 g of branched octadecyl alcohol (FOC-1800 manufactured by Nissan Chemical Industries, Ltd.) was diluted with 1 l of Isopar G to prepare a liquid developer for electrophotography.

The light-sensitive material was then subjected to fixing by means of a heat roll whereby the toner image thus-formed was fixed.

An aluminum substrate used for the production of FUJI PS-Plate FPD (manufactured by Fuji Photo Film Co., Ltd.) and the thus-developed light-sensitive material were superposed each other, and they were passed at a speed of 100 mm/sec through between a pair of rubber rollers, surface temperature of which was controlled to maintain constantly at 90° C., under a nip pressure of 4 kgf/cm$^2$.

After cooling the both materials while being in contact with each other to room temperature, the aluminum substrate was stripped from the light-sensitive element. The image formed on the aluminum substrate was visually evaluated for fog and image quality. As a result it was found that the whole toner image on the light-sensitive material according to the present invention was heat-transferred together with the transfer layer onto the aluminum substrate to provide a clear image without background stain on the aluminum substrate which showed substantially no degradation in image quality as compared with the original.

It is believed that the excellent transferability of the transfer layer is due to migration of the fluorine atom-containing copolymer in the photoconductive layer to its surface portion during the formation of the photoconductive layer and due to chemical bonding between the binder resin (B) and the resin (P) by the action of the crosslinking agent to form a cured film. Thus, a definite interface having a good release property was formed between the photoconductive layer surface and the transfer layer.

For comparison, an electrophotographic light-sensitive element was prepared in the same manner as described above except for eliminating 2.0 g of Resin (P-2). The adhesive strength of the surface thereof was 380 gf. Using the electrophotographic light-sensitive element for comparison, the formation of transfer layer, electrophotographic process and heat-transfer of transfer layer were conducted in the same manner as described above. It was formed, however, that the light-sensitive element did not exhibit releasability at all.

Then, the resulting plate of aluminum substrate having thereon the transfer layer (i.e., printing plate precursor) was subjected to an oil-desensitizing treatment (i.e., removal of transfer layer) to prepare a printing plate and its printing performance was evaluated. Specifically, the printing plate precursor was immersed in Oil-Desensitizing Solution (E-1) having the composition shown below at 25° C. for 30 seconds to remove the transfer layer, thoroughly washed with water, and gummed to obtain an offset printing plate.

| Oil-Desensitizing Solution (E-1) | |
|---|---|
| Mercaptoethanesulfonic acid | 10 g |
| Neosoap (manufactured by Matsumoto Yushi K.K.) | 8 g |
| N,N-Dimethylacetamide | 20 g |
| Distilled water | to make 1.0 l |
| Sodium hydroxide | to adjust to pH 12.5 |

The printing plate thus prepared was observed visually using an optical microscope of 200 magnifications. It was found that the non-image areas had no residual transfer layer, and the image areas suffered no defects in high definition regions (i.e., cutting of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with clear images free from background stains were obtained irrespective of the kind of color inks.

Moreover, when the printing plate according to the present invention was exchanged for an ordinary PS plate and printing was continued under ordinary conditions, no trouble arose. It was thus confirmed that the printing plate according to the present invention can share a printing machine with other offset printing plates such as PS plates.

For comparison, the same procedures as described above were repeated except for using light-sensitive materials having transfer layers as shown in the following Comparative Examples 1 to 3, respectively.

COMPARATIVE EXAMPLE 1

A transfer layer having a thickness of 2.5 μm was formed on the light-sensitive element in the same manner as in Example 1 except for using Comparative Resin Grain (1) described above in place of Resin Grain (AL-1) in Dispersion of Resin Grain (L-1) employed in Example 1. Then, the formation of printing plate and printing were conducted in the same manner as in Example 1.

COMPARATIVE EXAMPLE 2

A transfer layer having a thickness of 2.5 μm was formed on the light-sensitive element in the same manner as in Example 1 except for using Comparative Resin Grain (2) described above in place of Resin Grain (AL-1) in Dispersion of Resin Grain (L-1) employed in Example 1. Then, the formation of printing plate and printing were conducted in the same manner as in Example 1.

COMPARATIVE EXAMPLE 3

A transfer layer having a thickness of 2.5 μm was formed on the light-sensitive element-in the same manner as in Example 1 except for using a mixture of Comparative Resin Grains (1) and (2) in a weight ratio of 1:1 described above in place of Resin Grain (AL-1) in Dispersion of Resin Grain (L-1) employed in Example 1. Then, the formation of printing plate and printing were conducted in the same manner as in Example 1.

With both Comparative Example 1 using the transfer layer composed of Comparative Resin Grain (1) and Comparative Example 2 using the transfer layer composed of Comparative Resin Grain (2), each of which resin grains is made of one of the two resins forming Resin Grain (AL-1) for forming the transfer layer in Example 1 according to the present invention, the transfer layer was not sufficiently transferred and the residue of transfer layer was observed on the light-sensitive element and as a result, severe loss of toner image occurred on printing plate.

In case of Comparative Example 3 using the transfer layer composed of the mixture of Comparative Resin Grain (1) and Comparative Resin Grain (2) in a weight ratio of 1:1, transfer of the transfer layer was still incomplete, although its transferability was better than those of Comparative Examples 1 and 2.

Then, using the light-sensitive material of Comparative Example 3 which exhibited relatively good releasability, conditions under which the transfer layer formed from the mixture of two kinds of resin grains was completely transferred were determined. As a result, it was confirmed that the complete transfer of transfer layer was performed for the first time when a thickness of transfer layer was increased at least 5 μm and a transfer speed was reduced such as at a speed of 10 mm/sec.

From these results, it can be seen that only the transfer layer formed by electrodeposition of resin grains containing at least two kinds of resins having different glass transition points or softening points from each other according to the present invention was transferred at a high speed under mild conditions even though it was a thin layer.

As described above, the offset printing plate according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

EXAMPLES 2 TO 15

A printing plate was prepared in the same manner as in Example 1 except for using 8 g (solid basis) in total of each of the resin grains shown in Table L below to form a transfer layer having a thickness of 2.5 μm in place of Resin Grain (AL-1) employed in Example 1.

Using each of the printing plates thus obtained, offset printing was conducted in the same manner as in Example 1. More than 60,000 prints with clear images free from background stains similar to those in Example 1 were obtained.

TABLE L

| Example | Resin Grain (AL) |
|---|---|
| 2 | AL-2 |
| 3 | AL-3 |
| 4 | AL-4 |
| 5 | AL-5 |
| 6 | AL-9 |
| 7 | AL-11 |
| 8 | AL-12 |
| 9 | AL-13 |
| 10 | AL-14 |
| 11 | Al-18 |
| 12 | Al-16 |
| 13 | Al-22/AL-10 (9/1 by weight ratio) |
| 14 | AL-29 |
| 15 | AL-23 |

EXAMPLE 16

An amorphous silicon electrophotographic light-sensitive element (manufactured by Kyocera Corp.) was immersed in a solution containing 1 g of Compound (S-1) for imparting releasability shown below dissolved in one liter of Isopar G, rinsed with Isopar G and dried. By this treatment, the surface of amorphous silicon light-sensitive element was modified so as to exhibit the desired releasability and its adhesive strength was decreased from 200 gf to 3 gf.

Compound (S-1)
Silicone surface active agent (SILWet FZ-2171 manufactured by Nippon Unicar Co., Ltd.)

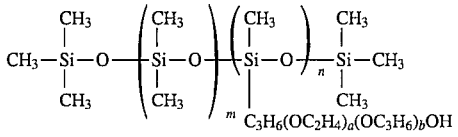

(presumptive structure)

The electrophotographic light-sensitive element was installed in an apparatus as shown in FIG. 2, and a transfer layer was formed thereon. Specifically, on the surface of light-sensitive element installed on a drum, whose surface temperature was adjusted to 50° C. and which was rotated at a circumferential speed of 10 mm/sec, Dispersion of Resin Grain (L-2) containing positively charged resin grains shown below was supplied using a slit electrodeposition device, while putting the light-sensitive element to earth and applying an electric voltage of 180 V to an electrode of the slit electrodeposition device, whereby the resin grains were electrodeposited and fixed. A thickness of the resulting transfer layer was 2.5 μm.

| Dispersion of Resin Grain (L-2) | |
|---|---|
| Resin Grain (AL-6) | 7 g (solid basis) |
| Positive-Charge Control Agent (CD-2) (1-hexadecene/N-decylmaleic monoamide copolymer (1/1 ratio by mole)) | 0.018 g |
| Branched tetradecyl alcohol (FOC-1400 manufactured by Nissan Chemical Industries, Ltd.) | 15 g |
| Isopar G | up to make 1.0 liter |

The electrophotographic light-sensitive material thus-obtained was subjected to formation of toner image, heat transfer onto a receiving material, preparation of a printing plate and printing in the following manner.

The light-sensitive material was charged to +700 V with a corona discharge in dark and exposed to light of a gallium-aluminum-arsenic semiconductor laser (output: 5 mW; oscillation wavelength: 780 nm) at an irradiation dose (on the surface of the light-sensitive material) of 30 erg/cm$^2$, a pitch of 25 μm, and a scanning speed of 300 cm/sec based on digital image data of an original read by a color scanner and memorized in a hard disc. The residual potential of the exposed areas was +120 V. The light-sensitive material was then subjected to development using Liquid Developer (LD-2) having the composition shown below while applying a bias voltage of +300 V to a development electrode to thereby electrodeposit the toner particles on the non-exposed areas. The light-sensitive material was then rinsed in a bath of Isopar H alone to remove stains on the non-image areas. The toner image was fixed by heating.

Liquid Developer (LD-2)

A copolymer of octadecyl methacrylate and methyl methacrylate (9:1 ratio by mole) as a coating resin and carbon black (#40 manufactured by Mitsubishi Kasei Corp.) were thoroughly mixed in a weight ratio of 2:1 and kneaded by a three-roll mill heated at 140° C. A mixture of 12 g of the resulting kneading product, 4 g of a copolymer of styrene and butadiene (Sorprene 1205 manufactured by Asahi Kasei Kogyo K.K.) and 76 g of Isopar G was dispersed in a Dyno-mill. The toner concentrate obtained was diluted with Isopar G so that the concentration of solid material was 6 g per liter, and $1\times10^{-4}$ mol per liter of sodium dioctylsulfosuccinate was added thereto to prepare Liquid Developer (LD-2).

A sheet of OK Master PS Type (manufactured by Ohji Koko Co., Ltd.), as a receiving material, was superposed on the developed light-sensitive material with its image-receiving layer side being in contact with the light-sensitive material, and they were passed at a speed of 100 mm/sec through a pair of rubber rollers whose surface temperature was controlled to maintain constantly at 105° C., under a nip pressure of 4 Kgf/cm$^2$.

After cooling the both materials while in contact with each other to room temperature, the OK Master was stripped from the light-sensitive element whereby the whole toner image on the light-sensitive material was thermally transferred together with the transfer layer to the OK Master. Only a very little difference in image quality was observed between the toner image before the heat-transfer and that transferred on the OK Master.

The OK Master bearing the toner image together with the transfer layer was then treated with Oil-Desensitizing Solution (E-2) prepared by adding 50 g of dimethylethanolamine to 1 liter of PS plate processing solution (DP-4 manufactured by Fuji Photo Film Co., Ltd.) and diluting the resulting aqueous solution 50-fold with distilled water at a temperature of 25° C. for 20 seconds with moderate rubbing to remove the transfer layer.

The non-image areas and toner image areas of the thus-obtained printing plate were visually observed using an optical microscope of 200 magnifications. It was found that the non-image areas had no residual transfer layer, and the image areas suffered no defects in high definition regions (i.e., cutting of fine lines and fine letters).

The printing plate was subjected to printing on neutral paper with various offset printing color inks using an offset printing machine (Ryobi 3200 MCD Model manufactured by Ryobi Ltd.), and an aqueous solution (pH: 7.0) prepared by diluting dampening water for PS plate (SG-23 manufactured by Tokyo Ink K.K.) 130-fold with distilled water, as dampening water. As a result, more than 3,000 prints with clear images free from background stains were obtained irrespective of the kind of color inks.

EXAMPLE 17

An amorphous silicon electrophotographic light-sensitive element was installed in an apparatus as shown in FIG. 2. Impartation of releasability and formation of transfer layer onto the surface of light-sensitive element was conducted at the same time using Dispersion of Resin Grain (L-3) having the composition shown below.

| Dispersion of Resin Grain (L-3) | |
|---|---|
| Resin Grain (AL-8) | 8 g (solid basis) |
| Positive-Charge Control Agent (CD-1) | 0.015 g |
| Compound (S-2) shown below | 0.8 g |
| Isopar G | up to make 1 liter |

Compound (S-2)

Polyether-modified polydimethyl siloxane (KF-353A manufactured by Shin-Etsu Silicone Co., Ltd.)

-continued

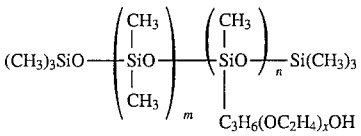

(presumptive structure)

Using the electrophotographic light-sensitive material thus-obtained, formation of toner image and transfer of toner image together with transfer layer onto an aluminum substrate for PS-Plate (FPD) were conducted in the same manner as in Example 1.

As a result of visual evaluation of the image transferred on the aluminum substrate it was found that the toner image was completely transferred together with the layer from the light-sensitive element to provide clear images without loss of toner image. It is believed that according to the treatment with the dispersion of electrodeposition for forming transfer layer containing the compound for imparting releasability, the compound dissolved in the dispersion is adsorbed on the surface of light-sensitive element as soon as the surface thereof is wetted with the dispersion of electrodeposition, and then the resin grains (AL) migrated by electrophoresis adhere to or deposite on the surface thereof.

Then, the plate was subjected to flash fixing to perform sufficient fixation of toner image areas. The plate was immersed in Oil-Desensitizing Solution (E-3) having the composition shown below at 30° C. for 20 seconds with moderate rubbing of the surface of plate to remove the transfer layer, thoroughly washed with water, and gummed to obtain a printing plate.

| Oil-Desensitizing Solution (E-3) | |
|---|---|
| PS plate processing solution (DP-4 manufactured by Fuji Photo Film Co., Ltd.) | 143 g |
| N,N-Dimethylethanolamine | 100 g |
| Distilled water | up to make 1 l (pH: 13.1) |

The printing plate thus prepared was observed visually using an optical microscope of 200 magnifications with respect to the removal of transfer layer in the non-image areas and the occurrence of loss of toner image.

From these results it can be seen that the image forming property of the light-sensitive element having the transfer layer provided thereon according to the present invention was good and that the transferability of transfer layer was also good and the transfer layer was completely transferred onto a receiving material. With respect to characteristics of printing plate precursor, the aptitude of oil-desensitizing treatment was good and the transfer layer was completely removed without the formation of background stain. Further, resisting property of image areas was good and loss of toner image was not observed even in highly accurate image portions, for example, fine letters, fine lines and dots for half tone areas of continuous gradation. As a result of printing using the printing plate and various color inks, more than 60,000 prints were obtained.

EXAMPLES 18 TO 27

A printing plate was prepared in the same manner as in Example 17 except for using 8 g (solid basis) in total of each of the resin grains shown in Table M below to form a transfer layer in place of Resin Grain (AL-8) employed in Example 17.

Using each of the printing plates thus obtained, offset printing was conducted in the same manner as in Example 17. More than 60,000 prints with clear images free from background stains similar to those in Example 17 were obtained.

TABLE M

| Example | Resin Grain (AL) |
|---|---|
| 18 | AL-15 |
| 19 | AL-17 |
| 20 | AL-19 |
| 21 | AL-20 |
| 22 | AL-21 |
| 23 | AL-24 |
| 24 | AL-25/AL-3 (1/4 by weight ratio) |
| 25 | AL-6/AL-27 (7/3 by weight ratio) |
| 26 | AL-2/AL-14 (1/1 by weight ratio) |
| 27 | AL-12 |

EXAMPLE 28

A mixture of 100 g of photoconductive zinc oxide, 20 g of Binder Resin (B-2) having the structure shown below, 3 g of Resin (P-6), 0.01 g of uranine, 0.02 g of Rose Bengal, 0.01 g of bromophenol blue, 0.15 g of maleic anhydride and 150 g of toluene was dispersed by a homogenizer (manufactured by Nippon Seiki K.K.) at a rotation of $9\times10^3$ r.p.m. for 10 minutes. To the dispersion were added 0.02 g of phthalic anhydride and 0.001 g of o-chlorophenol, and the mixture was dispersed by a homogenizer at a rotation of $1\times10^3$ r.p.m. for 1 minute.

Binder Resin (B-2)

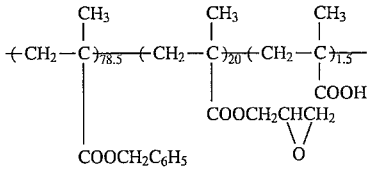

Mw $6\times10^4$

The resulting dispersion was coated on base paper for a paper master having a thickness of 0.2 mm, which had been subjected to electrically conductive treatment and solvent-resistant treatment, by a wire bar at a coverage of 25 g/m$^2$, set to touch and heated in a circulating oven at 120° C. for one hour. The adhesive strength of the surface of the thus-obtained electrophotographic light-sensitive element was 4 gf.

On the light-sensitive element having the light-sensitive layer containing Resin (P-6) was supplied Dispersion of Resin Grain (L-1) described in Example 1 while applying an electric voltage of 200 V to electrodeposite Resin Grain (AL-1), followed by drying at 80° C. for one minute, whereby a transfer layer having a thickness of 2.5 μm was formed.

The electrophotographic light-sensitive element having the transfer layer thereon thus-obtained was allowed to stand overnight under the condition of 25° C. and 60% RH. Then, the light-sensitive element was subjected to image formation by a plate making machine (ELP-404 V manufactured by Fuji Photo Film Co., Ltd.) with a bias voltage of 100 V in a development part using a liquid developer (ELP-TX manufactured by Fuji Photo Film Co., Ltd.) and then rinsed in a bath of Isopar G. The duplicated images formed on the transfer layer were good and clear even in highly accurate image portions such as letters, fine lines and continuous tone areas composed of dots. Also, background stain in the non-image areas was not observed.

The light-sensitive material having the toner images was brought into contact with a sheet of Straight Master (manufactured by Mitsubishi Paper Mills, Ltd.) as a receiving material and they were passed between a pair of hollow metal rollers covered with silicone rubber each having an infrared lamp heater integrated therein. A surface temperature of each of the rollers was 90° C., a nip pressure between the rollers was 3 kgf/cm$^2$ and a transportation speed was 100 mm/sec.

After cooling the both sheets while being in contact with each other to room temperature, the Straight Master was separated from the light-sensitive element whereby the toner images were transferred together with the transfer layer to the Straight Master.

As a result of visual evaluation of the images transferred on the Straight Master, it was found that the transferred images were almost same as the duplicated images on the light-sensitive material before transfer and degradation of image was not observed. Also i on the surface of the light-sensitive element after transfer, the residue of the transfer layer was not observed at all. These results indicated that the transfer had been completely performed.

For comparison, an electrophotographic light-sensitive element was prepared in the same manner as described above except for eliminating 3 g of Resin (P-6). The adhesive strength of the surface thereof was more than 400 gf. Using the electrophotographic light-sensitive element for comparison, the formation of transfer layer, electrophotographic process and heat-transfer of transfer layer were conducted in the same manner as described above. It was found, however, that release at the interface between the surface of light-sensitive element and the transfer layer was not recognized at all.

Then, the sheet of Straight Master having thereon the transfer layer was subjected to an oil-desensitizing treatment (i.e., removal of transfer layer) to prepare a printing plate and its printing performance was evaluated. Specifically, the plate was immersed in an oil-desensitizing solution having a pH of 13.1 prepared by diluting a commercially available PS plate processing solution (DP-4 manufactured by Fuji Photo Film Co., Ltd.) 7-fold with distilled water at a temperature of 25° C. for 1 minute with moderate rubbing to remove the transfer layer, thoroughly and washed with water to obtain a printing plate.

The printing plate thus prepared was observed visually using an optical microscope of 200 magnifications. It was found that the non-image areas had no residual transfer layer, and the image areas suffered no defects in high definition regions (i.e., cutting of fine lines and fine letters).

The printing plate was subjected to printing on neutral paper with various offset printing color inks using an offset printing machine (Ryobi 3200 MCD Model manufactured by Ryobi Ltd.), and an aqueous solution (pH: 7.0) prepared by diluting dampening water for PS plate (SG-23 manufactured by Tokyo Ink K.K.) 130-fold with distilled water, as dampening water. As a result, more than 1,000 prints with clear images free from background stains were obtained irrespective of the kind of color inks.

In a conventional system wherein an electrophotographic light-sensitive element utilizing zinc oxide is oil-desensitized with an oil-desensitizing solution containing a chelating agent as the main component under an acidic condition to prepare a lithographic printing plate, printing durability of the plate is in a range of several hundred prints without the occurrence of background stain in the non-image areas when neutral paper are used for printing or when offset printing color inks other than black ink are employed. Contrary to the conventional system, the method for preparation of a printing plate by an electrophotographic process according to the present invention can provide a printing plate having excellent printing performance in spite of using zinc oxide-containing light-sensitive element.

EXAMPLE 29

An amorphous silicon electrophotographic light-sensitive element was installed in an apparatus as shown in FIG. 2. The adhesive strength of the surface of the light-sensitive element was 200 gf.

Impartation of releasability to the surface of light-sensitive element was conducted by dipping the light-sensitive element in a solution of the compound (S) according to the present invention (dip method) in the apparatus. Specifically, the light-sensitive element rotated at a circumferential speed of 10 mm/sec was brought into contact with a bath containing a solution prepared by dissolving 1.0 g of Compound (S-3) shown below in one liter of Isopar G for 7 seconds and dried using air-squeezing. The adhesive strength of the surface of the light-sensitive element thus-treated was 3 gf and the light-sensitive element exhibited good releasability.

Compound (S-3)

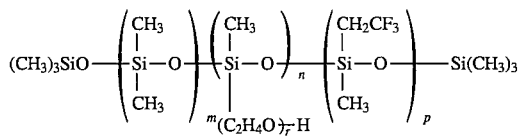

On the surface of light-sensitive element installed on a drum, whose surface temperature was adjusted to 50° C. and which was rotated at a circumferential speed of 10 mm/sec, Dispersion of Resin Grains (L-4) containing positively charged resin grains shown below was supplied using a slit electrodeposition device, while putting the light-sensitive element to earth and applying an electric voltage of 130 V to an electrode of the slit electrodeposition device to cause the resin grains to electrodeposite and fix, whereby a transfer layer having a thickness of 2.0 μm was formed.

| Dispersion of Resin Grains (L-4) | |
|---|---|
| Resin Grain (AL-7) | 10 g (solid basis) |
| Positive-Charge Control Agent (CD-1) | 0.020 g |
| Branched hexadecyl alcohol (FOC-1600 manufactured by Nissan Chemical Industries, Ltd.) | 10 g |
| Isopar G | up to make 1.0 liter |

The resulting light-sensitive material was charged to 700 V with a corona charge and exposed to light using a semiconductor laser having an oscillation wavelength of 780 nm at an irradiation dose on the surface of light-sensitive material of 25 erg/cm$^2$ based on digital image data. The residual potential of the exposed areas was 120 V. The light-sensitive material was then developed with Liquid Developer (LD-2) described above while applying a bias voltage of 300 V to a development electrode to thereby electrodeposit the toner particles on the non-exposed areas. The light-sensitive material was then rinsed in a bath of Isopar H alone to remove stains on the non-image areas. The toner image was fixed by heating.

The light sensitive material having the toner images was brought into contact with an aluminum substrate for SP-Plate (FPD) as a receiving material, and they were passed between a pair of rubber rollers which were in contact with each other under a pressure of 4 Kgf/cm$^2$ and whose surface temperature was controlled to constantly maintain at 100° C. at a transportation speed of 100 mm/sec and the aluminum substrate was stripped from the light-sensitive element whereby the toner images were transferred together with the transfer layer to the aluminum substrate.

The printing plate precursor thus-obtained was further heated using a device (RICOH FUSER Model 592 manufactured by Ricoh Co., Ltd.) to fix the toner portion on the aluminum substrate.

The printing plate precursor was immersed in Oil-Desensitizing Solution (E-3) described in Example 17 at 30° C. for 30 seconds with moderate rubbing of the surface of precursor to remove the transfer layer, thoroughly washed with water and gummed to obtain a printing plate.

The printing plate thus prepared was observed visually using an optical microscope of 200 magnifications. It was found that the non-image areas had no residual transfer layer, and the image areas suffered no defects in high definition regions (i.e., cutting of fine lines and fine letters). Specifically, the toner image was easily transferred together with the transfer layer onto a receiving material by the heat-transfer process as described above and the toner image was not adversely affected by the heat treatment after the transfer.

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with clear images free from background stains were obtained irrespective of the kind of color inks.

As described above, for the purpose of maintaining sufficient adhesion of toner image to a receiving material and increasing mechanical strength of toner image at the time of printing, a means for improving adhesion of toner image to a receiving material can be performed after the heat-transfer of toner image together with the transfer layer depending on the kind of liquid developer used for the formation of toner image.

Also, similar results to the above were obtained by a flash fixing method or a heat roll fixing method as the means for improving adhesion of toner image.

EXAMPLE 30

A printing plate was prepared in the same manner as in Example 29, except for replacing the means for imparting releasability to the surface of light-sensitive element with the following method. Specifically, a metering roll having a silicone rubber layer on the surface thereof was brought into contact with a bath containing an oil of Compound (S-4) shown below on one side and with the light-sensitive element one the other side and they were rotated at a circumferential speed of 15 mm/sec for 20 seconds. The adhesive strength of the surface of resulting light-sensitive element was 5 gf.

Compound (S-4)
Carboxy-modified silicone oil (TSF 4770 manufactured by Toshiba Silicone Co., Ltd.)

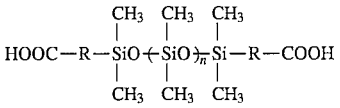

Further, a transfer roll having a styrene-butadiene layer on the surface thereof was placed between the metering roll dipped in the silicone oil bath of Compound (S-4) and the light-sensitive element, and the treatment was conducted in the same manner as above. Good releasability of the surface of light-sensitive element similar to the above was obtained.

Figure 3:
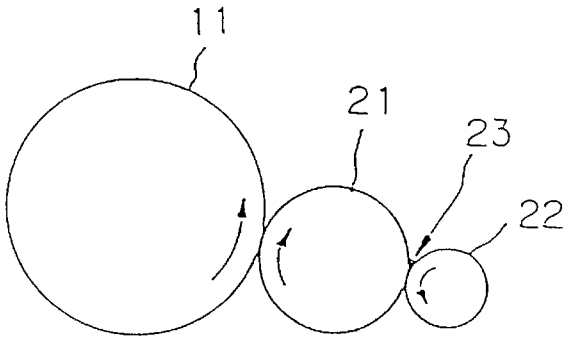
FIG. 3 is a schematic view of a device for supplying compound (S) according to the present invention.

Moreover, Compound (S-4) 23 was supplied between the metering roll 22 and the transfer roll 21 as shown in FIG. 3 and the treatment was conducted in the same manner as above. Again, good result similar to the above was obtained.

As a result of printing in the same manner as in Example 29, each printing plate exhibited the good performance similar to that in Example 29.

EXAMPLE 31

A printing plate was prepared and offset printing was conducted using the resulting printing plate in the same manner as in Example 29, except for replacing the means for imparting releasability to the surface of light-sensitive element with the following method. Specifically, an AW-treated felt (material: wool having a thickness of 15 mm and a width of 20 mm) impregnated uniformly with 2 g of Compound (S-5), i.e., dimethyl silicone oil KF-96L-2.0 (manufactured by Shin-Etsu Silicone Co., Ltd.) was pressed under a pressure of 200 g on the surface of light-sensitive element and the light-sensitive element was rotated at a circumferential speed of 20 mm/sec for 30 seconds. The adhesive strength of the surface of light-sensitive element thus-treated was 6 gf. The results of printing were good similar to those in Example 29.

EXAMPLE 32

A printing plate was prepared and offset printing was conducted using the resulting printing plate in the same manner as in Example 29, except for replacing the means for imparting releasability to the surface of light-sensitive element with the following method. Specifically, a roller having a heating means integrated therein and covered with cloth impregnated with Compound (S-6), i.e., fluorine-containing surface active agent (Sarflon S-141 manufactured by Asahi Glass Co., Ltd.) was heated to a surface temperature of 60° C., then brought into contact with the light-sensitive element and they were rotated at a circumferential speed of 20 mm/sec for 30 seconds. The adhesive strength of the surface of light-sensitive element thus-treated was 4 gf. The results of printing was good similar to those in Example 29.

EXAMPLE 33

A printing plate was prepared and offset printing was conducted using the resulting printing plate in the same manner as in Example 29, except for replacing the means for imparting releasability to the surface of light-sensitive element with the following method. Specifically, a silicone rubber roller comprising a metal axis covered with silicone rubber (manufactured by Kinyosha K.K.) was pressed on the light-sensitive element at a nip pressure of 800 gf/cm$^2$ and rotated at a circumferential speed of 15 mm/sec for 10 seconds. The adhesive strength of the surface of light-sensitive element thus-treated was 20 gf/cm$^2$. The results of printing was good similar to those in Example 29.

EXAMPLES 34 TO 53

Each printing plate was prepared and offset printing was conducted using each of the resulting printing plates in the same manner as in Example 1, except for using each of the resins (P) and/or resin grains (L) shown in Table N below for a light-sensitive layer in place of 2.0 g of Resin (P-2) employed in Example 1.

The image quality of prints obtained and printing durability of each printing plate were good similar to those in Example 1.

TABLE N

| Example | Resin (P) and/or Resin Grain (L) | Amount |
|---|---|---|
| 34 | P-2 | 0.2 g |
| 35 | L-14 | 0.5 g |
| 36 | P-6 | 0.3 g |
| 37 | P-11 | 0.3 g |
| 38 | L-19 | 0.4 g |
| 39 | P-19 | 0.2 g |
| | L-23 | 0.3 g |
| 40 | P-13 | 0.8 g |
| 41 | P-16 | 1.0 g |
| 42 | P-32 | 0.5 g |
| 43 | P-17 | 0.4 g |
| 44 | P-22 | 0.2 g |
| | L-9 | 0.4 g |
| 45 | P-28 | 0.4 g |
| 46 | P-30 | 0.3 g |
| 47 | L-2 | 0.6 g |
| 48 | P-34 | 0.3 g |
| 49 | P-36 | 0.25 g |
| 50 | P-31 | 0.1 g |
| | L-15 | 0.3 g |
| 51 | P-35 | 0.3 g |
| 52 | L-22 | 0.6 g |
| 53 | P-38 | 0.25 g |

EXAMPLES 54 TO 64

Each printing plate was prepared and offset printing was conducted using each of the resulting printing plates in the same manner as in Example 1 except for using each of the compounds shown in Table O below in place of Resin (P-2), phthalic anhydride and o-chlorophenol employed in Example 1.

The image quality of prints obtained and printing durability of each printing plate were good as those in Example 1.

TABLE O

| Example | Resin (P) or Resin Grain (L) | Amount | Compound for Crosslinking | Amount |
|---|---|---|---|---|
| 54 | P-30 | 0.5 g | Phthalic anhydride | 0.2 g |
| | | | Zirconium acetylacetone | 0.01 g |
| 55 | P-22 | 0.6 g | Gluconic acid | 0.008 g |
| 56 | P-25 | 0.8 g | N-Methylaminopropanol | 0.25 g |
| | | | Dibutyltin dilaurate | 0.001 g |
| 57 | P-9 | 0.8 g | N,N'-Dimethylpropanediamine | 0.3 g |
| 58 | P-7 | 0.6 g | Propylene glycol | 0.2 g |
| | | | Tetrakis(2-ethylhexane-diolato)titanium | 0.008 g |
| 59 | L-18 | 1.0 g | — | |
| 60 | L-15 | 0.9 g | N,N-Dimethylpropanediamine | 0.25 g |
| 61 | P-13 | 0.7 g | Divinyl adipate | 0.3 g |
| | | | 2,2'-Azobis(isobutyronitrile) | 0.001 g |
| 62 | P-14 | 0.8 g | Propyltriethoxysilane | 0.01 g |
| 63 | L-21 | 1.0 g | N,N-Diethylbutanediamine | 0.3 g |
| 64 | P-5 | 1.0 g | Ethylene diglycidyl ether | 0.2 g |
| | | | o-Chlorophenol | 0.001 g |

EXAMPLE 65

5 g of 4,4'-bis(diethylamino)-2,2'-dimethyltriphenylmethane as an organic photoconductive substance, 4 g of Binder Resin (B-3) having the structure shown below, 0.4 g of Resin (P-27), 40 mg of Dye (D-1) having the structure shown below, and 0.2 g of Anilide Compound (B) having the structure shown below as a chemical sensitizer were dissolved in a mixed solvent of 30 ml of methylene chloride and 30 ml of ethylene chloride to prepare a solution for light-sensitive layer.

Binder Resin (B-3)

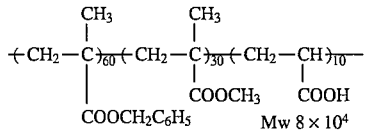

Dye (D-1)

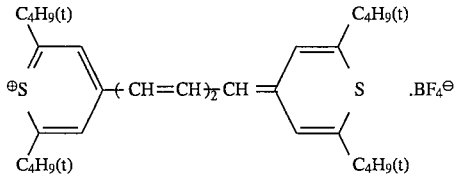

Anilide Compound (B)

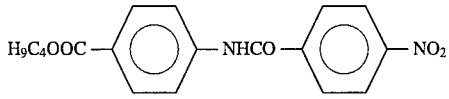

The resulting solution for light-sensitive layer was coated on a conductive transparent substrate composed of a 100 μm thick polyethylene terephthalate film having a deposited layer of indium oxide thereon (surface resistivity: $10^3$ Ω) by a wire round rod to prepare a light-sensitive element having an organic light-sensitive layer having a thickness of about 4 μm. The adhesive strength of the surface of light-sensitive element was 8 gf.

The procedure same as in Example 1 was repeated except for using the resulting light-sensitive element in place of the light-sensitive element employed in Example 1 to prepare a printing plate. Using the printing plate, printing was conducted in the same manner as in Example 1. The prints obtained had clear images without the formation of background stain and printing durability of the printing plate was good similar to Example 1.

EXAMPLE 66

The same procedure as in Example 16 was repeated except for using an amorphous silicon electrophotographic light-sensitive element having provided thereon a surface layer for imparting releasability having a thickness of 1.5 μm shown below as the electrophotographic light-sensitive element to prepare a printing plate. Offset printing was conducted using the resulting printing plate in the same manner as in Example 16 and good results similar to those in Example 16 were obtained.

Formation of Surface Layer for Imparting Releasability

A coating composition comprising 10 g of silicone resin having the structure shown below, 1 g of crosslinking agent having the structure shown below, 0.1 g of platinum as a catalyst for crosslinking and 100 g of n-hexane was coated by a wire round rod, set to touch, and heated at 120° C. for 10 minutes to form the surface layer having a thickness of 1.5 μm. The adhesive strength of the surface of the resulting light-sensitive element was not more than 1 gf.

Silicon Resin

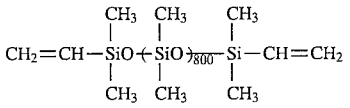

(presumptive structure)

Crosslinking Agent

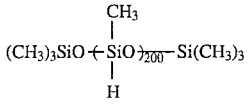

(presumptive structure)

EXAMPLE 67

A mixture of 5 g of a bisazo pigment having the structure shown below, 95 g of tetrahydrofuran and 5 g of a polyester resin (Vylon 200 manufactured by Toyobo Co., Ltd.) was thoroughly pulverized in a ball mill. The mixture was added to 520 g of tetrahydrofuran with stirring. The resulting dispersion was coated on a conductive transparent substrate used in Example 65 by a wire round rod to prepare a charge generating layer having a thickness of about 0.7 μm.

Bisazo Pigment

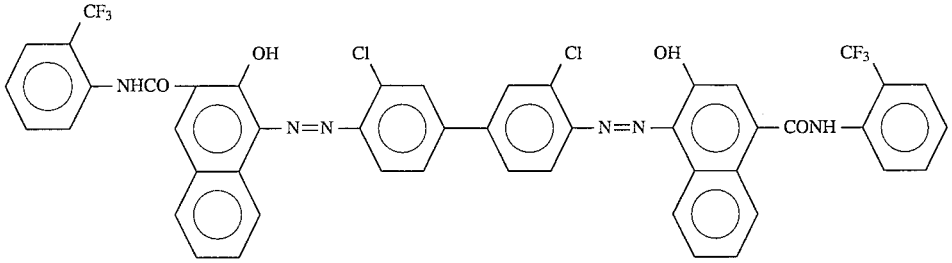

A mixed solution of 20 g of a hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive layer of a double-layered structure was prepared.

Hydrazone Compound

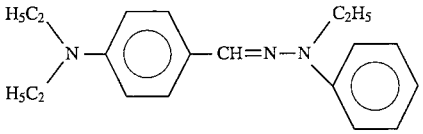

A mixed solution of 13 g of Resin (P-39) having the structure shown below, 0.2 g of phthalic anhydride, 0.002 g of o-chlorophenol and 100 g of toluene was coated on the light-sensitive layer by a wire round rod, set to touch and heated at 120° C. for one hour to prepare a surface layer for imparting releasability having a thickness of 1 μm. The adhesive strength of the surface of the resulting light-sensitive element was 5 gf.

Resin (P-39)

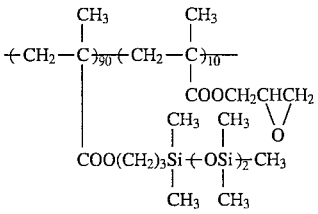

Mw $3 \times 10^4$

The resulting light-sensitive element was charged to a surface potential of +500 V in dark and exposed imagewise using a helium-neon laser of 633 nm at an irradiation dose on the surface of the light-sensitive element of 30 erg/cm$^2$, followed by conducting the same procedure as in Example 1 to prepare a printing plate. As a result of offset printing using the resulting printing plate in the same manner as in Example 1, the printing plate exhibited the good performance similar to that in Example 1.

EXAMPLE 68

The same procedure as in Example 16 was repeated except for using a sheet of Straight Master (manufactured by Mitsubishi Paper Mills, Ltd.) in place of a sheet of OK Master PS Type employed in Example 16 to prepare a printing plate.

As a result of visual evaluating the toner image formed on the Straight Master for fog and image quality, it was found that the whole toner image on the light-sensitive material was transferred together with the transfer layer onto the Straight Master to provide a clear image without background fog on the Straight Master. The printing plate was subjected to offset printing in the same manner as in Example 16. As a result, 1,500 prints of clear images free from background stains were obtained.

EXAMPLES 69 TO 80

An offset printing plate was prepared by subjecting some of the image receiving materials bearing the transfer layers (i.e., printing plate precursors) prepared in Examples 1 to 68 to the following oil-desensitizing treatment. Specifically, to 0.2 moles of each of the nucleophilic compounds shown in Table P below, 100 g of each of the organic solvents shown in Table P below, and 2 g of Newcol B4SN (manufactured by Nippon Nyukazai K.K.) was added distilled water to make one liter, and the solution was adjusted to a pH of 12.5. Each printing plate precursor was immersed in the resulting treating solution at a temperature of 35° C. for one minute with moderate rubbing to remove the transfer layer.

Printing was carried out using the resulting printing plate under the same conditions as in each of the basis examples. Each plate exhibited good characteristics similar to those in each of the basis examples.

TABLE P

| Example | Basis Example for Printing Plate Precursor | Nucleophilic Compound | Organic Solvent |
|---|---|---|---|
| 69 | Example 21 | Sodium sulfite | N,N-Dimethylformamide |
| 70 | Example 8 | Monoethanolamine | Sulfolane |
| 71 | Example 9 | Diethanolamine | Tetrahydrofuran |
| 72 | Example 11 | Thiomalic acid | Ethylene glycol dimethyl ether |
| 73 | Example 17 | Thiosalicylic acid | Benzyl alcohol |
| 74 | Example 3 | Taurine | Ethylene glycol monomethyl ether |
| 75 | Example 4 | 4-Sulfobenzenesulfinic acid | Benzyl alcohol |
| 76 | Example 19 | Thioglycolic acid | Tetramethylurea |
| 77 | Example 22 | 2-Mercaptoethylphosphonic acid | Dioxane |
| 78 | Example 20 | Cysteine | N-Methylacetamide |
| 79 | Example 23 | Sodium thiosulfate | Methyl ethyl ketone |
| 80 | Example 27 | Ammonium sulfite | N,N-Dimethylacetamide |

EXAMPLES 81 TO 86

Each printing plate was prepared and offset printing was conducted using the resulting printing plate in the same manner as in Example 29 except for employing each of the compounds (S) shown in Table Q below in place of 1.0 g/l of Compound (S-3) employed in Example 29.

The results obtained were the same as those in Example 29. Specifically, the releasability is effectively imparted on the surface of light-sensitive element using each of the compounds (S).

TABLE Q

| Example | | Compound (S) containing Fluorine and/or Silicon Atom | Amount (g/l) |
|---|---|---|---|
| 81 | (S-7) | Higher fatty acid-modified silicone (TSF 411 manufactured by Toshiba Silicone Co., Ltd.) 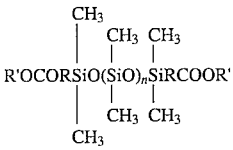 (presumptive structure) | 1.0 |
| 82 | (S-8) | Carboxy-modified silicone (X-22-3701E manufactured by Shin-Etsu Silicone Co., Ltd.) 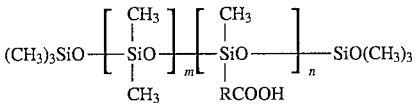 (presumptive structure) | 0.5 |
| 83 | (S-9) | Carbinol-modified silicone (X-22-176B manufactured by Shin-Etsu Silicone Co., Ltd.) 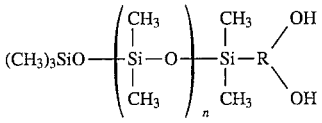 (presumptive structure) | 1.0 |
| 84 | (S-10) | Mercapto-modified silicone (X-22-167B manufactured by Shin-Etsu Silicone Co., Ltd.) 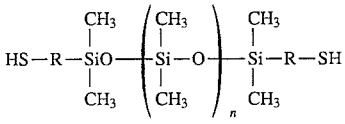 (presumptive structure) | 2 |
| 85 | (S-11) | 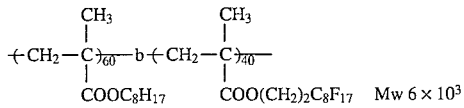 Mw $6\times10^3$ | 1.5 |
| 86 | (S-12) | 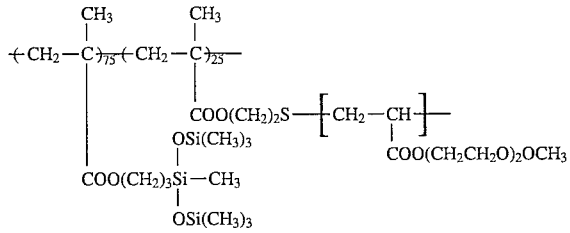 Mw $8\times10^3$ (Mw of graft portion $3\times10^3$) | 2 |

While the invention has been described in detail and with reference to specific embodiments thereof, it will be apparent to one skilled in the art that various changes and modifications can be made therein without departing from the spirit and scope thereof.

What is claimed is:

1. A method for preparation of a printing plate by an electrophotographic process comprising forming a peelable transfer layer capable of being removed upon a chemical reaction treatment on a surface of an electrophotographic light-sensitive element, forming a toner image by an electrophotographic process on the transfer layer, heat-transferring the toner image together with the transfer layer onto a receiving material having a surface capable of providing a hydrophilic surface suitable for lithographic printing at the time of printing, and removing the transfer layer on the receiving material by the chemical reaction treatment, wherein the transfer layer is formed by an electrodeposition coating method using thermoplastic resin grains (AL) each containing a resin ($A_1$) having a glass transition point of from 10° C. to 140° C. or a softening point of from 35° C. to 180° C. and a resin ($A_2$) having a glass transition point of not more than 45° C. or a softening point of not more than 60° C. and its glass transition point or softening point is at least 2° C. lower than that of the resin ($A_1$).

2. A method for preparation of a printing plate by an electrophotographic process as claimed in claim 1, wherein the electrodeposition coating method comprises supplying the thermoplastic resin grains (AL) as a dispersion thereof in an electrically insulating solvent having an electric resistance of not less than $10^8$ Ω.cm and a dielectric constant of not more than 3.5.

3. A method for preparation of a printing plate by an electrophotographic process as claimed in claim 1, wherein the electrodeposition coating method comprising supplying the thermoplastic resin grains (AL) between the electrophotographic light-sensitive element and an electrode placed in face of the light-sensitive element, and migrating the grains by electrophoresis according to a potential gradient applied from an external power source to cause the grains to adhere to or electrodeposit on the electrophotographic light-sensitive element.

4. A method for preparation of a printing plate by an electrophotographic process as claimed in claim 1, wherein the resins ($A_1$) and ($A_2$) each contains at least one of polymer component (a) containing at least one group selected from a —$CO_2H$ group, a —CHO group, a —$SO_3H$ group, a —$SO_2H$ group, a —P(=O)(OH)$R^1$ group (wherein $R^1$ represents a —OH group, a hydrocarbon group or a —$OR^2$ group (wherein $R^2$ represents a hydrocarbon group)), a phenolic hydroxy group, a cyclic acid anhydride-containing group, a —CONHCO$R^3$ group (wherein $R^3$ represents a hydrocarbon group) and a —CONH$SO_2R^3$ group, and polymer component (b) containing at least one functional group capable of forming at least one group selected from a —$CO_2H$ group, a —CHO group, a —$SO_3H$ group, a —$SO_2H$ group, a —P(=O)(OH)$R^1$ group (wherein $R^1$ has the same meaning as defined above) and a —OH group upon a chemical reaction.

5. A method for preparation of a printing plate by an electrophotographic process as claimed in claim 4, wherein the resins ($A_1$) and ($A_2$) each contains both the polymer component (a) and polymer component (b).

6. A method for preparation of a printing plate by an electrophotographic process as claimed in claim 4, wherein at least one of the resins ($A_1$) and ($A_2$) further contains a polymer component (c) containing a moiety having at least one of a fluorine atom and a silicon atom.

7. A method for preparation of a printing plate by an electrophotographic process as claimed in claim 6, wherein the polymer components (c) are present as a block in the resin.

8. A method for preparation of a printing plate by an electrophotographic process as claimed in claim 1, wherein the surface of an electrophotographic light-sensitive element has an adhesive strength measured according to JIS Z 0237-1980 "Testing methods of pressure sensitive adhesive tapes and sheets" of not more than 100 gram-force.

9. A method for preparation of a printing plate by an electrophotographic process as claimed in claim 8, wherein the electrophotographic light-sensitive element comprises amorphous silicon as a photoconductive substance.

10. A method for preparation of a printing plate by an electrophotographic process as claimed in claim 8, wherein the electrophotographic light-sensitive element contains a polymer having a polymer component containing at least one of a silicon atom and a fluorine atom in the region near to the surface thereof.

11. A method for preparation of a printing plate by an electrophotographic process as claimed in claim 10, wherein the polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks.

12. A method for preparation of a printing plate by an electrophotographic process as claimed in claim 10, wherein the polymer further contains a polymer component containing a photo- and/or heat-curable group.

13. A method for preparation of a printing plate by an electrophotographic process as claimed in claim 10, wherein the electrophotographic light-sensitive element further contains a photo- and/or heat-curable resin.

14. A method for preparation of a printing plate by an electrophotographic process as claimed in claim 11, wherein the polymer further contains a polymer component containing a photo- and/or heat-curable group.

15. A method for preparation of a printing plate by an electrophotographic process as claimed in claim 11, wherein the electrophotographic light-sensitive element further contains a photo- and/or heat-curable resin.

16. A method for preparation of a printing plate by an electrophotographic process as claimed in claim 1, wherein before the formation of transfer layer, a compound (S) containing a fluorine atom and/or a silicon atom is applied to the surface of electrophotographic light-sensitive element.

17. A method for preparation of a printing plate by an electrophotographic process as claimed in claim 2, wherein the dispersion of thermoplastic resin grains (AL) further contains a compound (S) which containing a fluorine atom and/or a silicon atom.

* * * * *